US009163491B2

(12) United States Patent
Kerr

(10) Patent No.: US 9,163,491 B2
(45) Date of Patent: Oct. 20, 2015

(54) STEAM ASSISTED GRAVITY DRAINAGE PROCESSES WITH THE ADDITION OF OXYGEN

(71) Applicant: Richard Kelso Kerr, Calgary (CA)

(72) Inventor: Richard Kelso Kerr, Calgary (CA)

(73) Assignee: NEXEN ENERGY ULC, Calgary, AB (CA)

( * ) Notice: Subject to any disclaimer, the term of this patent is extended or adjusted under 35 U.S.C. 154(b) by 59 days.

(21) Appl. No.: 13/628,164

(22) Filed: Sep. 27, 2012

(65) Prior Publication Data

US 2013/0098603 A1 Apr. 25, 2013

Related U.S. Application Data

(63) Continuation-in-part of application No. 13/543,012, filed on Jul. 6, 2012.

(60) Provisional application No. 61/549,770, filed on Oct. 21, 2011.

(51) Int. Cl.
*E21B 43/24* (2006.01)
*E21B 43/30* (2006.01)

(52) U.S. Cl.
CPC ..... *E21B 43/2408* (2013.01); *E21B 43/24* (2013.01); *E21B 43/305* (2013.01)

(58) Field of Classification Search
CPC ... E21B 43/2408; E21B 43/305; E21B 43/24; E21B 43/2406; E21B 43/243; E21B 43/241
USPC ..... 166/50, 57, 245, 260, 268, 272.1, 166/272.3, 272.7, 303, 305.1, 401
See application file for complete search history.

(56) References Cited

U.S. PATENT DOCUMENTS 3,905,422 A 9/1975 Woodward
3,938,590 A 2/1976 Redford et al.

(Continued)

FOREIGN PATENT DOCUMENTS

CA 1027856 1/1976
CA 1032078 1/1976

(Continued)

OTHER PUBLICATIONS

Adams et al., "Controls on the Variability of Fluid Properties of Heavy Oils and Bitumen in Foreland Basin: A Case History From the Albertan Oil Sands", Search & Discovery Article #40275, Mar. 10, 2008.

(Continued)

*Primary Examiner* — Daniel P Stephenson
(74) *Attorney, Agent, or Firm* — Norton Rose Fulbright Canada LLP

(57) ABSTRACT

A steam assisted gravity drainage process that includes the addition of oxygen for recovering hydrocarbons from a hydrocarbon reservoir is described. Steam and an oxygen-containing gas are separately and continuously injected into the hydrocarbon reservoir to heat hydrocarbons and water to drain, by gravity, to a horizontal production well. The process can include controlling the ratio of oxygen and steam from about 0.05 to about 1.00 (v/v). The steam assisted gravity drainage process can further include removing non-condensable combustion gases from the reservoir to avoid undesirable pressures in the reservoir. The non-condensable combustion gases can be removed from the reservoir by at least one separate vent-gas well.

34 Claims, 37 Drawing Sheets

(56) References Cited

U.S. PATENT DOCUMENTS

| | | | | |
|---|---|---|---|---|
| 3,976,137 | A | 8/1976 | Bousaid | |
| 3,978,925 | A | 9/1976 | Redford | |
| 3,991,828 | A | 11/1976 | Allen et al. | |
| 3,993,132 | A | 11/1976 | Cram et al. | |
| 4,006,778 | A | 2/1977 | Redford et al. | |
| 4,024,915 | A | 5/1977 | Allen | |
| 4,026,357 | A | 5/1977 | Redford | |
| 4,048,078 | A | 9/1977 | Allen | |
| 4,083,404 | A | 4/1978 | Allen | |
| 4,114,690 | A | 9/1978 | Cram et al. | |
| 4,124,071 | A | 11/1978 | Allen et al. | |
| 4,127,172 | A | 11/1978 | Redford et al. | |
| 4,133,382 | A | 1/1979 | Cram et al. | |
| 4,217,956 | A | 8/1980 | Goss et al. | |
| 4,252,191 | A | 2/1981 | Pusch et al. | |
| 4,265,310 | A | 5/1981 | Britton et al. | |
| 4,565,249 | A | 1/1986 | Pebdani et al. | |
| 4,573,530 | A * | 3/1986 | Audeh et al. | 166/260 |
| 4,612,989 | A | 9/1986 | Rakach et al. | |
| 4,649,997 | A | 3/1987 | Bousaid | |
| 4,682,652 | A * | 7/1987 | Huang et al. | 166/272.3 |
| 4,772,395 | A | 9/1988 | Tungatt et al. | |
| 4,860,827 | A * | 8/1989 | Lee et al. | 166/261 |
| 4,993,490 | A | 2/1991 | Stephens et al. | |
| 5,217,076 | A | 6/1993 | Masek | |
| 5,407,009 | A | 4/1995 | Butler et al. | |
| 5,456,315 | A * | 10/1995 | Kisman et al. | 166/245 |
| 5,626,193 | A | 5/1997 | Nzekwu et al. | |
| 6,015,015 | A | 1/2000 | Luft et al. | |
| 6,412,557 | B1 | 7/2002 | Ayasse et al. | |
| 7,581,587 | B2 | 9/2009 | Pfefferle | |
| 7,740,062 | B2 | 6/2010 | Lim et al. | |
| 7,770,646 | B2 | 8/2010 | Klassen et al. | |
| 7,780,152 | B2 | 8/2010 | Rao | |
| 7,900,701 | B2 | 3/2011 | Weiers et al. | |
| 8,118,095 | B2 | 2/2012 | Sarathi et al. | |
| 8,176,982 | B2 | 5/2012 | Gil et al. | |
| 2005/0045332 | A1 | 3/2005 | Howard et al. | |
| 2005/0211434 | A1 | 9/2005 | Gates et al. | |
| 2006/0042794 | A1 | 3/2006 | Pfefferle | |
| 2006/0207762 | A1 | 9/2006 | Ayasse | |
| 2006/0213658 | A1 | 9/2006 | Maguire | |
| 2006/0231252 | A1 | 10/2006 | Shaw et al. | |
| 2007/0187093 | A1 | 8/2007 | Pfefferle | |
| 2007/0187094 | A1 | 8/2007 | Pfefferle | |
| 2008/0190813 | A1 | 8/2008 | Dana et al. | |
| 2008/0264635 | A1 * | 10/2008 | Chhina et al. | 166/260 |
| 2009/0188667 | A1 | 7/2009 | Lim et al. | |
| 2009/0194278 | A1 | 8/2009 | De Francesco | |
| 2009/0200024 | A1 | 8/2009 | Ayasse et al. | |
| 2009/0236092 | A1 | 9/2009 | O'Brien | |
| 2009/0288827 | A1 | 11/2009 | Coskuner | |
| 2010/0065268 | A1 | 3/2010 | Gates et al. | |
| 2010/0096126 | A1 | 4/2010 | Sullivan et al. | |
| 2010/0212894 | A1 * | 8/2010 | Latimer et al. | 166/272.3 |
| 2010/0276148 | A1 | 11/2010 | Wylie et al. | |
| 2012/0247773 | A1 | 10/2012 | Schneider et al. | |
| 2013/0098603 | A1 | 4/2013 | Kerr | |
| 2013/0146283 | A1 | 6/2013 | Ayasse | |
| 2013/0146284 | A1 | 6/2013 | Ayasse | |
| 2013/0175031 | A1 | 7/2013 | Kerr | |
| 2013/0248177 | A1 | 9/2013 | Kerr | |
| 2013/0284435 | A1 | 10/2013 | Kerr | |
| 2013/0284461 | A1 | 10/2013 | Kerr et al. | |
| 2014/0076555 | A1 | 3/2014 | Kerr | |
| 2014/0096960 | A1 | 4/2014 | Kerr | |
| 2014/0096962 | A1 | 4/2014 | Kerr | |
| 2014/0166278 | A1 | 6/2014 | Kerr | |
| 2014/0166279 | A1 | 6/2014 | Kerr | |
| 2014/0190689 | A1 | 7/2014 | Warren et al. | |

FOREIGN PATENT DOCUMENTS

| | | | |
|---|---|---|---|
| CA | 1054928 | | 5/1977 |
| CA | 1056720 | | 6/1979 |
| CA | 1122113 | | 4/1980 |
| CA | 2532811 | A1 | 7/2003 |
| CA | 2492308 | A1 | 7/2006 |
| CA | 2594413 | C | 7/2006 |
| CA | 2594414 | C | 7/2006 |
| CA | 2678347 | | 2/2010 |
| CA | 2647088 | A1 | 6/2010 |
| CA | 2692204 | A1 | 8/2010 |
| CA | 2709241 | A1 | 1/2011 |
| CA | 2678348 | C | 3/2011 |
| CA | 2706399 | A1 | 11/2011 |
| CA | 2827655 | A1 | 9/2012 |
| CA | 2847742 | A1 | 12/2012 |
| CA | 2782308 | A1 | 1/2013 |
| CA | 2791318 | A1 | 4/2013 |
| CA | 2759356 | A1 | 5/2013 |
| CA | 2759357 | C | 5/2013 |
| CA | 2759362 | A1 | 5/2013 |
| CA | 2492306 | A1 | 7/2013 |
| CA | 2766844 | A1 | 8/2013 |
| CA | 2771703 | A1 | 9/2013 |
| CA | 2820702 | A1 | 12/2013 |
| CA | 2804521 | A1 | 7/2014 |
| CA | 2852542 | A1 | 11/2014 |
| CA | 2856914 | A1 | 1/2015 |
| RU | 2425969 | C1 * | 8/2011 |
| WO | 9967504 | | 12/1999 |
| WO | 9967505 | | 12/1999 |
| WO | 2005121504 | | 12/2005 |
| WO | WO 2006-074555 | A1 | 7/2006 |
| WO | WO 2008-060311 | A2 | 5/2008 |
| WO | 2009129449 | | 10/2009 |
| WO | WO 2010-092338 | A2 | 8/2010 |
| WO | WO 2010-101647 | A2 | 9/2010 |
| WO | 2012119076 | | 9/2012 |
| WO | WO 2013-006950 | A2 | 1/2013 |
| WO | 2014028137 | | 2/2014 |
| WO | 2014035788 | | 3/2014 |

OTHER PUBLICATIONS

Aherne et al., "Fluid Movement in the SAGD Process: A Review of the Dover Project", Journal of Canadian Petroleum Technology, Jan. 2008.

Akram, "Reservoir Simulation Optimizes SAGD", American Oil & Gas Reporter (AOGR), Sep. 2010.

Alberta Chamber of Resources, "Oil Sands Technology Roadmap", Jan. 30, 2004, p. 27-32.

Alberta Energy, "Gas Over Bitumen Technical Solution—Technical Solution Roadmap", www.energy.alberta.ca, 2011.

Ashrafi et al., "Numerical Simulation Study of SAGD Experiment and Investigating Possibility of Solvent Co-Injection", Society of Petroleum Engineers, Jul. 19-21, 2011.

Asia Industrial Gases Association (AIGA), "Oxygen Pipeline Systems", 2005.

Balog et al., "The Wet Air Oxidation Boiler for Enhanced Oil Recovery", Journal of Canadian Petroleum, Sep.-Oct. 1982, p. 73-79.

Belgrave et al., "SAGD Optimization With Air Injection", Society of Petroleum Engineers, SPE 106901, Apr. 15-18, 2007.

Bennion et al., "The Use of Carbon Dioxide as Enhanced Recovery Agent for Increasing Heavy Oil", Joint Canada/Romania Heavy Oil Symposium, Mar. 3-7, 1993, p. 1-37.

Berkowitz, "Fossil Hydrocarbons", Academic Press, 1997.

Braswell, "New Heavy Oil Solvent Extraction Pilot to Test Experimental Process", Journal of Petroleum Technology Online, Jan. 9, 2012.

Brennan, "Screw Pumps Provide High Efficiency in Transport of Orinoco Bitumen", Pipeline & Gas Journal, vol. 222, Issue 3, Mar. 1995, p. 36-39.

Brigham et al., "In Situ Combustion", Chptr. 16, Reservoir Engineering, May 16, 2005.

(56) References Cited

OTHER PUBLICATIONS

Business Wire, "ELAN Energy Announces Nine Months Results", Nov. 1996.
Business Wire, "ELAN Energy Announces Six Months Results", Aug. 1996.
Butler, "Thermal Recovery of Oil and Bitumen", Prentice Hall, 1991, p. 4-15.
Canadian Association of Petroleum Producers (CAPP), "The Facts on Oil Sands", 2010.
Carcoana, "Enhanced Oil Recovery in Rumania", Society of Petroleum Engineers, SPE/DOE 10699, Apr. 4-7, 1982.
Chen et al., "Effects of Reservoir Heterogeneities on Steam-Assisted Gravity-Drainage Process", Society of Petroleum Engineers, V.11, No. 5, Oct. 2008.
Chen, "Assessing and Improving SAGD: Reservoir Homogeneities, Hydraulic Fractures and Mobility Control Foams" Stanford PhD Thesis, May 2009.
Chu, "A Study of Fireflood Field Projects", Journal of Petroleum Technology, Feb. 1977, p. 111-120.
Craig et al., "A Multipilot Evaluation of the COFCAW Process", Journal of Petroleum Technology, Jun. 1974, p. 659-666.
Dang et al., "Investigation of SAGD in Complex Reservoirs", SPE 133849-MS, Society of Petroleum Engineers, 2010.
Das, "Well Bore Hydraulics in a SAGD Well Pair, Society of Petroleum Engineers," 97922-MS, Nov. 1-3, 2005.
Dietz et al., "Wet and Partially Quenched Combustion", Journal of Petroleum Technology, Apr. 1968, p. 411-415.
Donaldson, et al., "Enhanced Oil Recovery II, Process and Operations", Chapter 11, Elsevier, 1989.
Dusseault, "Comparing Venesuelan and Canadian Heavy Oil and Tar Sands", Canadian Inst. Mining (CIM), Jun. 12-14, 2011.
Edmunds et al., "Economic Optimum Operating Pressure for SAGD Projects in Alberta", Journal of Canadian Petroleum Technology, V. 40, Dec. 2001, p. 13-17.
Elliot et al., "Computer Simulation of Single-Well Steam Assisted Gravity Drainage", U.S. Dept. of Energy Contract No. DE-FG22-96BC14994, Jul. 1999.
El-Sayed et al., "Horizontal Well Length: Drill Short or Long Wells?", Society of Petroleum Engineers, Nov. 18-20, 1996, p. 423-431.
Escobar, et al., "Optimization Methodology for Cyclic Steam Injection With Horizontal Wells", Society of Petroleum Engineers, Nov. 6-8, 2000.
Fadillah, "12 Oil Companies to Use EOR Methods to Boost Production", The Jakarta Post, Jun. 4, 2013.
Falk et al, "A Review of Insulated Concentric Coiled Tubing for Single Well, Steam Assisted Gravity Drainage (SWSAGD)", Society of Petroleum Engineers, Feb. 26-28, 1996.
Farouq Ali et al., "The Promise and Problems of Enhanced Oil Recovery Methods", Journal of Canadian Petroleum Technology, V. 35, No. 7, Sep. 1996, p. 57-63.
Fatemi et al., "Injection Well-Producer Well Combinations for Toe-to-Heel Steam Flooding (THSF)", Society of Petroleum Engineers, 140703-MS, May 23-26, 2011.
Fatemi et al., "Preliminary considerations on the application of toe-to-heel steam flooding (THSF): Injection well-producer well configurations", Chem. Eng. Res. & Design, V. 8, No. 11, 2011, p. 2365-2379.
Finan et al., "Nuclear Technology & Canadian Oil Sands: Integration of Nuclear Power with In-Situ Oil Extraction", MIT Thesis, Jun. 2007.
Frauenfeld et al., "Effect of an Initial Gas Content on Thermal EOR as Applied to Oil Sands", Journal of Petroleum Technology, Mar. 1988.
Gates et al., "In-Situ Combustion in the Tulare Formation, South Belridge Field, Kern County, California", Journal of Petroleum Technology, May 1978, p. 798-806.
Godin, "Clean Bitumen Technology Action Plan—From Strategy to Action", PTSC Water forum, May 16, 2011.
Greaves et al., "In Situ Combustion (ISC) Process Using Horizontal Wells", Journal of Canadian Petroleum Technology, vol. 35, No. 4, Apr. 1996, p. 49-55.
Greaves et al., "THAI—New Air Injection Technology", Society of Petroleum Engineers, Report 99-15, Jun. 14-18, 1995.
Green Car Congress, "Chevron Leveraging Information Technology to Optimize Thermal Production of Heavy Oil with Increased Recovery and Reduced Costs", Jun. 23, 2011.
Gutierrez et al., "The Challenge of Predicting Field Performance of Air Injection Projects Based on Laboratory and Numerical Modelling", Journal of Canadian Petroleum Technology, vol. 48, No. 4, Apr. 2009, p. 23-34.
Haggett et al., "Update 3-Long Lake Oil Sands Output May Lag Targets", Reuters, Feb. 10, 2011.
Halliburton, "Zonal Isolation For Steam Injection Applications", www.halliburton.com, 2010.
Hanzlik et al., "Forty Years of Steam Injection in California—The Evolution of Heat Management", Society of Petroleum Engineers, SPE 84848, Oct. 20-21, 2003.
Healing, "Petrobank Technology Earns Zero Grade", Calgary Herald, Mar. 10, 2012.
Heidrick et al., "Oil Sands Research and Development", Alberta Energy Research Inst., Mar. 2006.
Herbeck et al., "Fundamentals of Tertiary Oil Recovery", Energy Publications, 1977.
Herrera et al., "Wellbore Heat Losses in Deep Steam Injection Wells," The Society of Petroleum Engineers Regional Mtg., Apr. 12, 1978.
Hong et al., "Effects of Noncondensable Gas Injection on Oil Recovery by Steamflooding", Journal of Petroleum Technology, Dec. 1984.
Huygen et al., "Wellbore Heat Losses and Leasing Temperatures During Steam Injection", Apr. 1966, p. 25-32.
Improved Recovery Week, "Thermal System Ups Heavy Oil Flow; Lighter Crudes Eligible?", Dec. 4, 1995.
Integra Engineering Ltd., "Pushwater Systems Extend Heavy Oil Collection", 2011.
Ipek et al, "Numerical Study of Shale Issues in SAGD", Canadian Int'l Pet. Conf., Calgary, Jun. 17, 2008.
Jacos, "Jacos Hangingstone Expansion Project", www.jacos.com, Apr. 2010.
Jaremko, "Pressure Communication", Oilweek, Feb. 2006.
Javad et al., "Feasibility of In-Situ Combustion in the SAGD Chamber", Journal of Canadian Petroleum Technology, Jan. 27, 2011, p. 31-44.
Johnson et al., "Production Optimization at Connacher's Pod One (Great Divide) Oil Sands Project", Society of Petroleum Engineers, SPE Report No. 145091-MS, Jul. 19-21, 2011.
Jorshari, "Technology Summary", Journal of Canadian Petroleum Technology, 2011.
Kerr et al., "Sulphr Plant Waste Gasses: Incineration Kinetics and Fuel Consumption", Western Research & Development Ltd., Jul. 1975.
Kisman et al., "Development and Economic Application of Anti-Water Coning Methods to Alleviate a Widespread Problem", 5th Unitar Int'l Conf. on Heavy Crude and Tar Sands, 1991, p. 279-287.
Kristoff et al., Winter Horizontal Well EOR Project, Phase III, Wascana Energy Inc., SRC Pub. No. P-110-436-C-99, Nov. 1999.
Kumar et al., "Cyclic Steaming in Heavy Oil Diatomite", Society of Petroleum Engineers, Mar. 8-10, 1995, p. 109-122.
Lai et al, "Factors Affecting the Application of Anti-Water Coning Technology (AWACT) at the South Jenner Oil Field, Southeast Alberta", Journal of Canadian Petroleum Technology, vol. 38, No. 3, Mar. 1999, p. 25-37.
Lake et al., "A Niche for Enhanced Oil Recovery in the 1990s", Oilfield Rev., Jan. 1992.
Lange, "Handbook of Chemistry", McGraw Hill, 1973.
Leung, "Numerical Evaluation of the Effect of Simultaneous Steam and Carbon Dioxide Injection on the Recovery of Heavy Oil", Society of Petroleum Engineers, Sep. 1983, p. 1591-1599.
Li et al, "Gas-Over-Bitumen Geometry and its SAGD Performance Analysis with Coupled Reservoir Gas Mechanical Simulation", Journal of Canadian Petroleum Technology, Jan. 2007, p. 42-49.

(56) References Cited

OTHER PUBLICATIONS

Li et al., "Numerical Investigation of Potential Injection Strategies to Reduce Shale Barrier Impacts on SAGD Process", Journal of Canadian Petroleum Technology, Mar. 2011, p. 57-64.
Liebe et al., Winter Horizontal Well EOR Project, Phase IV, Wascana Energy Inc., SRC Pub. No. P-110-606-C-02, Dec. 2002.
Lowey, "Bitumen Strategy Needs Better Grounding: EUB Study Offers Bad News for Athabasca Gas Producers", Business Edge, V. 4, No. 2, Jan. 15, 2004.
Luft, et al., "Thermal Performance of Insulated Concentric Coiled Tubing (ICCT) for Continuous Steam Injection in Heavy Oil Production.", Society of Petroleum Engineers, 37534-MS, Feb. 10-12, 1997.
Luhning et al., "The AOSTRA Anti Water Coning Technology (AWACT) Process—From Invention to Commercial Application", SPE Paper No. CIM/SPE 90-132, 1990, p. 132.1-132.8.
Luo et al., "Feasibility Study of CO2 Injection for Heavy Oil Reservoir After Cyclic Steam Simulation: Liaohe Oil Field Test", Society of Petroleum Engineers, Nov. 1-3, 2005.
Marufuzzanan, "Solubility and Diffusivity of Carbon Dioxide, Ethane, and Propane in Heavy Oil", University of Regina, M.A.Sc. Thesis, Nov. 2010.
McColl, "Nuclear Energy: Hedging Option for the Oil Sands", Nov. 2, 2006.
Moore et al., "In Situ Combustion Performance in Steam Flooded Heavy Oil Cores", Journal of Canadian Petroleum Technology, vol. 38, No. 13, 1999.
Moore et al., "Parametric Study of Steam Assisted In Situ Combustion", Final Report, vols. 1-2, 1994, p. 1-336.
Nasr, et al., "Thermal Techniques for the Recovery of Heavy Oil Bitumen", Society of Petroleum Engineers, Dec. 5-6, 2005.
New Technology Magazine, "EnCana Plans First Commercial Use of Solvent in New Oilsands Project", Nov. 2009, p. 10.
New Technology Magazine, "Excelsior Files Patent for ISC Process", www.newtechmagazine.com, Sep. 25, 2009.
New Technology Magazine, "Excelsior Searching for Joint Venture Partner for Hangingstone COGD Project", www.newtechmagazine.com, Nov. 20, 2009.
New York Times, Business Wire, "Ranger Oil in $408M Deal for Elan Energy", Sep. 3, 1997.
Nexen Inc., "Nexen Announces Second Quarter Results", Aug. 4, 2011.
N-solv Corporation, "Developing an In Situ Process for the Oilsands", 2012.
Oil & Gas Journal, "Self-Setting Thermal Packers Help Cyclic Steam", www.ogj.com Dec. 14, 1998.
Oil & Gas Journal, "Special Report: More US EOR Projects Start But EOR Production Continues Decline", Apr. 21, 2008.
Oilsands Quest, "Management Presentation", 2011.
Pacheco et al., "Wellbore Heat Losses and Pressure Drop in Steam Injection", The Journal of Petroleum Technology, Feb. 12, 1972, p. 139-144.
Parappilly et al., "SAGD With a Longer Wellbore", Journal of Canadian Petroleum Technology, V. 48, No. 6, Jun. 2009, p. 71-77.
Parrish et al., "Laboratory Study of a Combination of Forward Compustion and Waterflooding—The COFCAW Process, Journal of Petroleum Technology", Jun. 1969, p. 753-761.
Patton et al., "Carbon Dioxide Well Stimulation: Part 1—A Parametric Study", Journal of Petroleum Technology, Aug. 1982, p. 1798-1804.
Piers, "Coping With Water From Oil & Gas Wells", C-FER Technologies, Jun. 14, 2005.
Pooladi-Darvish et al., "SAGD Operations in the Presence of Underlying Gas Cap and Water Layer-Effect of Shale Layers", Journal of Canadian Petroleum Technology, V. 41, No. 6, Jun. 2002.
Prats et al., "In Situ Combustion Away From Thin, Horizontal Gas Channels", Society of Petroleum Engineers Journal, Mar. 1968, p. 18-32.
Ramey, "In Situ Combustion", Proc. 8th World Pet. Long., 1970, p. 253-262.
Roche, "Beyond Steam", New Technology Magazine, Sep. 2011.
Roche, "No Analogue", New Technology Magazine, Apr. 2009, p. 10.
Ross, "Going the Distance", New Technology Magazine, Dec. 2008, p. 34.
Ross, "Injecting Air Replaces Gas in Depleted Gas Over Bitumen Reservoir", New Technology Magazine, May 2009, p. 34-46.
Saltuklaroglu et al., "Mobil's SAGD Experience at Celtic, Saskatchewan", SPE, 99-25, 1999, p. 45-51.
Sarathi, "In-Situ Combustion Handbook—Principals and Practices", Report Prepared for U.S. Department of Energy, Jan. 1999.
Sarkar et al., "Comparison of Thermal EOR Processes Using Combinations of Vertical and Horizontal Wells", Society of Petroleum Engineers, SPE 25793 Feb. 8-10, 1993, p. 175-181.
Satter, "Heat Losses During Flow of Steam Down a Wellbore", The Journal of Petroleum Technology, Jul. 1965, p. 845-851.
Schindelar et al., Mideast Heavy Oil Pilot Delivers for Chevron, The Daily Oil, Oct. 21, 2010.
Schlumberger Ltd., www.slb.com, "Packer Systems", May 2012.
Shin et al., "Shale Barrier Effects on SAGD Performance", Society of Petroleum Engineers, SPE 125211-MS, Oct. 19-21, 2009.
Shore, "Making the Flare Safe", Journal of Loss Prevention in the Process Industries, V.9, No. 6, 1996, p. 363-381.
Singhal et al., "A Mechanistic Study of Single-Well Steam Assisted Gravity Drainage", SPE, 59333-MS, Apr. 3-5, 2000.
Stalder, "Cross-SAGD (XSAGD)—An Accelerated Bitumen Recovery Alternative", Society of Petroleum Engineers, V. 10, No. 1, Nov. 1-3, 2005.
Stevens et al., "A Versatile Model for Evaluating Thermal EOR Production Economics", Society of Petroleum Engineers, No. 1998. 113, 1998.
Stockwell et al., "Transoil Technology for Heavy Oil Transportation: Results of Field Trials at Wolf Lake", Society of Petroleum Engineers, 1988, p. 248-258.
Stone et al., "Flares", Chptr. 7, www.gasflare.org, Dec. 1995, p. 7.1-7.44.
Stone et al., "Flares", Chptr. 7, www.gasflare.org, Dec. 2012, p. 7.1-7.44.
Tan et al., "Application of a Thermal Simulator with Fully Coupled Discretized Wellbore Simulation to SAGD", Journal of Canadian Petroleum Technology, vol. 41, No. 1, 2002, p. 25-30.
Tavallali, "Assessment of SAGD Well Configuration Optimization in Lloydminster Heavy Oil Reserve", Society of Petroleum Engineers, SPE 153128, Mar. 20-22, 2012.
Thimm et al., "A Statistical Analysis of the Early Peace River Thermal Project Performance", Journal of Canadian Petroleum Technology, V. 32, No. 1, Jan. 1993.
Thomas, "Enhanced Oil Recovery—An Overview", Oil & Gas Science & Technology, V. 63, No. 1, 208, p. 9-19, 2008.
Triangle Three Engineering, "Technical Audit Report—Gas Over Bitumen Technical Solutions", 2010.
Turta et al., "Preliminary Considerations on Application of Steamflooding in a Toe-to-Heel Configuration", 130444-PA, Journal of Canadian Petroleum Technology, V. 48, No. 11, Nov. 2009.
U.S. Department of Energy, "Enhanced Geothermal Systems—Wellfield Construction Workshop", San Francisco, Oct. 16, 2007.
U.S. Environmental Protection Agency, "Industrial Flares", www.epa.gov/ttn/chief/ap42/ch13/final/c13s05.pdf, Jun. 2012.
Vanderklippe, "Long Lake Project Hits Sticky Patch", The Globe and Mail, Feb. 10, 2011.
Walley, Middle East Enhanced Oil Recovery, www.arabianoilandgas.com, May 5, 2011.
Wikipedia, "Orimulsion", 2013.
Willhite et al., "Wellbore Refluxing in Steam Injection Wells", Journal of Petroleum Technology, Mar. 1987,, p. 353-362.
www.lloydministerheavyoil.com, "Completions and Workovers", 2012.
Xinhua's China Economic Information Service, "China's First Orimulsion Pipeline Comes on Steam", Nov. 7, 2006.
Yang et al., "Combustion Kinetics of Athabasca Bitumen From ID Combustion Tube Experiments", Int'l Assoc. for Mathematical Geology, Sep. 2009, p. 193-211.

(56) References Cited

OTHER PUBLICATIONS

Yang et al., "Design and Optimization of Hybrid Ex Situ / In Situ Steam Generation Recovery Processes for Heavy Oil and Bitumen", Canadian Heavy Oil Association, SPE 117643, Oct. 20-23, 2008.

Yang et al., "Design of Hybrid Steam—In Situ Combustion Bitumen Recovery Process", 2009, p. 213-223.

Yang et al., "The Design of Hybrid Steam—In Situ Combustion Bitumen Recovery Processes", Proceedings of the Canadian Int'l Petroleum Conference/SPE Gas Technology Symp. Joint Conference, Paper 2008-114, Jun. 17-19, 2008.

Zawierucha et al., Material Compatibility and Systems Considerations in Thermal EOR Environments Containing High-Pressure Oxygen, Journal of Petroleum Technology, Nov. 1988, p. 1477-1483.

Restriction Requirement for U.S. Appl. No. 13/543,012, mailed Aug. 11, 2014, 6 pages.

Official Action for U.S. Appl. No. 13/543,012, mailed Oct. 3, 2014, 28 pages.

U.S. Appl. No. 14/582,819, filed Dec. 24, 2014, Kerr.

United States Patent and Trademark Office, Office Action dated Feb. 26, 2015, issued in U.S. Appl. No. 14/058,488.

United States Patent and Trademark Office, Office Action dated Mar. 6, 2015, issued in U.S. Appl. No. 14/078,983.

United States Patent and Trademark Office, Office Action dated Apr. 9, 2015, issued in U.S. Appl. No. 13/888,874.

United States Patent and Trademark Office, Office Action dated Apr. 10, 2015, issued in U.S. Appl. No. 13/889,775.

United States Patent and Trademark Office, Office Action dated Jul. 17, 2015, issued in U.S. Appl. No. 13/543,012.

* cited by examiner

SAGDOX Geometry 1

SAGDOX Geometry 2

SAGDOX Geometry 4

SAGDOX Geometry 5

SAGDOX Geometry 6

SAGDOX Geometry 7

SAGDOX Geometry 9

SAGDOX - 3 Well - Pair Pattern

SAGD Steam Chamber

Early Stage SAGD

Mature SAGD

The original THAI process

Temperature and Saturation Profiles for Wet Combustion

STEAM ASSISTED GRAVITY DRAINAGE PROCESSES WITH THE ADDITION OF OXYGEN

FIELD OF THE INVENTION

A process to conduct an improved SAGD process for bitumen recovery, by injecting oxygen and steam separately, into a bitumen reservoir; and to remove, as necessary, non-condensable gases produced by combustion, to control the reservoir pressures. In one aspect of the invention a cogeneration operation is locally provided to supply oxygen and steam requirements.

Acronyms Used Herein

SAGD Steam Assisted Gravity Drainage
SAGDOX SAGD+Oxygen
SAGDOX (9) SAGDOX with 9% (v/v) oxygen in steam+oxygen
ISC In Situ Combustion
EOR Enhanced Oil Recovery
LTO Low Temperature Oxidation (150-300° C.)
HTO High Temperature Oxidation (380-800° C.)
ETOR Energy to Oil Ratio (MMBTU/bbl)
ETOR (steam) ETOR of steam component
VT Vertical (well)
HZ Horizontal (well)
OBIP Original Bitumen in Place
STARS Steam Thermal and Advanced Reservoir Simulator (CMG, Calgary)
SOR Steam to Oil Ratio (bbls/bbl)
PG Produced (non-condensable) Gas
ASU Air Separation Unit (to produce oxygen gas)
JCPT Journal of Canadian Petroleum Technology
OGJ Oil & Gas Journal
JPT Journal of Petroleum Technology
SPE Society of Petroleum Engineers
COFCAW Combination of Forward Combustion and Waterflood
CAGD Combustion Assisted Gravity Drainage
CHOA Canadian Heavy Oil Association
DOE (US) Department of Energy
GOR Gas to Oil Ratio

BACKGROUND OF THE INVENTION

References Used

Anderson, R. E. et al.—"Method of Direct Steam Generation using an Oxyfuel Combustor", Int'l Pat. WO2010/101647 A2, 2010.
Balog, S. et al—"The WAO Boiler for Enhanced Oil Recovery", JCPT, 1982.
Belgrave, J. D. M. et al—"SAGD Optimization with Air Injection" SPE 106901, 2007
Bousard, J. S.—"Recovery of Oil by a Combustion of LTO and Hot Water or Steam Injection", U.S. Pat. No. 3,976,137, Avg., 1976
Butler, R. M.—"Thermal Recover of Oil & Bitumen", Prentice-Hall, 1991
Cenovus—OGT, Sep. 6, 2010
Chinna, H. et al—"Hydrocarbon Recovery Facilitated by In Situ Combustion using Horizontal Well", Int'l Pat. WO 2006/074555 A1, 2006.
Chu, C.—"A Study of Fireflood Field Projects", JPT, February 1977

Craig. F. F. et al—"A Multipilot Evaluation of the COFCAW Process", JPT, June 1974
Dietz D. N. et al—"Wet and Partially Quenched Combustion", JPT, April, 1968
Doschner, T. M.—"Factors that Spell Success in Steaming Viscous Crudes". OGJ, Jul. 11, 1996
Gates, I. et al—"A Process for In Situ Recovery of Bitumen and Heavy Oil" US Pat. 2005/0211434 A 1, September 2005
Gates, I. et al—"In Situ Heavy Oil and Bitumen Recovery Process" US Pat. 2010/0065268 A 1, March 2010.
Gates. C. F. et al—"In Situ Combustion in the Tulane Formation, South Belridge Field, Kerm County California", SPE 6554, April 1977
Graves, M. et al, "In Situ Combustion (ISC) Process Using Horizontal Wells" JCPT, April, 1996
Gutierrez, D. et al—"In Situ Combustion Modeling", JCPT, April 2009
Herbeck, E. F. et al—"Fundamentals of Tertiary Oil Recovery, Pet. Eng., February, 1977
Javad, S et al, Feasibility of In Situ Combustion in the SAGD Chamber", JCPT, April 2001
Kerr, R. et al—"Sulphur Plant Waste Gases: Incineration Kinetics and Fuel Consumption"—Report for Alberta Gov't, July, 1975.
Kjorholt, H.—"Single Well SAGD", Int'l Pat. WO 2010/092338 A2, June 2010.
Lim. G. et al—"System and Method for the Recovery of Hydrocarbons by In Situ Combustion", U.S. Pat. No. 7,740,062, June, 2010
Moore, R. E. et al—"In Situ Performance in Steam Flooded Heavy Oil Cores", JCPT, September 1999
Moore, R. G. et al—"Parametric Study of Steam Assisted In Situ Combustion", published, February, 1994
New Tech, Magazine, November 2009.
Parrish D. R. et al—"Laboratory Study of a Combination of Forward Combustion and Waterflooding—the COFCAW Process", JPT, February June 1969
Petrobank, website, 2009
Pfefferle, W. C. "Method for In Situ Combustion of In-Place Oils", U.S. Pat. No. 7,581,587 B2, Sep. 1, 2009
Pfefferle, W. C.—"Method for CAGD Recovery of Heavy Oil", Int'l Pat. WO 2008/060311 A2, May 2008
Pfefferle, W. C. "Method for CAGD Recovery of Heavy Oil" US Pat. 2007/0187094 A1, Aug. 16, 2007
Prats, M. et al—"Situ Combustion Away from Thin, Horizontal Gas Channels", SPE 1898, October 1967
Praxair, website, 2010
Ramey Jr., H. J.—"In Situ Combustion", Proc. 8$^{th}$ World Pet. Long., 1970
Sarathi, P. "In Situ Combustion EOR Status", DOE, 1999
Sullivan, J. et al—"Low Pressure Recovery Process for Acceleration of In Situ Bitumen Recovery", US Pat. 2010/0096126 A1, April 2010.
Weiers, L. et al—"In Situ Combustion in Gas over Bitumen formations", U.S. Pat. No. 9,700,701 B2, March 2011
Wylie, I. et al—"Hot Fluid Recovery of Heavy Oil with Steam and Carbon Dioxide", US Pat. 2010/0276148 A1, November 2010.
Yang X et al—"Design of Hybrid Steam—ISC Bitumen Recovery Processes" Nat. Resources Res., Sep. 3, 2009(1)
Yang, X. et al—"Design and Optimization of Hybrid Ex Situ/In Situ Steam Generation Recovery Processes for Heavy Oil and Bitumen". SPE Symposium, Calgary, Alta., Can., October, 2008.

Yang, X. et al—"Combustion Kinetics of Athabasca Bitumen from 1 D Combustion Tube Experiments", Nat. Res. 18 No 3, September 2009(x)

Today (2011), the leading in situ EOR process to recover bitumen from oil sands reservoirs, such as found in the Athabasca region of Alberta in Canada, is SAGD (steam assisted gravity drainage). Bitumen is a very heavy type of oil that is essentially immobile at reservoir conditions, so it is difficult to recover. In situ combustion (ISC) is an alternative process that, so far, has shown little application for bitumen recovery.

SAGDOX (SAGD with oxygen) is another alternative process, for bitumen EOR that can be considered as a hybrid process combining the attributes of SAGD (steam) and ISC (oxygen). SAGDOX uses a modified SAGD geometry with extra wells or segregated injector systems to allow for separate continuous injection of oxygen and steam and removal on non-condensable gases produced by combustion.

1. Prior Art Review—Bitumen EOR 2.1 SAGD

In the early days of steam EOR, the focus was on heavy oil (not bitumen) and two process types, using vertical well geometry—steam floods (SF), where a steam injector would heat and drive oil to a producer well (California heavy oil EOR used this process) and cyclic steam simulation (CCS); where, using a single vertical well, steam was injected, often at pressures that fractured the reservoir. This was followed by a soak period to allow oil time to be heated by conduction and then a production cycle (Cold Lake, Alberta oil is recovered using this process).

But, compared to these processes and heavy oil, bitumen causes some difficulties. At reservoir conditions, bitumen viscosity is large (>100,000 cp.), bitumen will not flow and gas/steam injectivity is very poor or near zero. Vertical well geometry will not easily work for bitumen EOR. We need a new geometry with short paths for bitumen recovery and a method to start-up the process so we can inject steam to heat bitumen.

In the 1970-1980's using new technology to directionally drill wells and position the wells accurately, it became possible to drill horizontal wells for short-path geometry. Also, in the early 1970's, Dr. Roger Butler invented the SAGD process, using horizontal wells to recover bitumen (Butler (1991)). FIG. 1 shows the basic SAGD geometry using twin parallel horizontal wells with a separation of about 5 m, with the lower horizontal well near the reservoir bottom (about 2 to 8 m. above the floor), and with a pattern length of about 500 to 1000 m. The SAGD process is started by circulating steam until the horizontal well pair can communicate and form a steam (gas) chamber containing both wells. FIG. 17 shows how the process works. Steam is injected through the upper horizontal well and rises into the steam chamber. The steam condenses at/near the cool chamber walls (the bitumen interface) and releases latent heat to the bitumen and the matrix rock. Hot bitumen and condensed steam drain by gravity to the lower horizontal production well and are pumped (or conveyed) to the surface. FIG. 18 shows how SAGD matures—A young steam chamber has oil drainage from steep sides and from the chamber top. When the chamber grows and hits the ceiling (top of the net pay zone), drainage from the chamber top ceases and the sides become flatter, so bitumen drainage slows down.

Steam injection (i.e. energy injection) is controlled by pressure targets, but there also may be a hydraulic limit. The steam/water interface is controlled to be between the steam injector and the horizontal production well. But when fluids move along the production well there is a natural pressure drop that will tilt the water/steam interface (FIG. 13). If the interface floods the steam injector, we reduce the effective length. If the interface hits the producer, we short circuit the process and produce some live steam, reducing process efficiency. With typical tubulars/pipes, this can limit well lengths to about 1000 m.

SAGD has another interesting feature. Because it is a saturated-steam process and only latent heat contributes directly to bitumen heating, if pressure is raised (higher than native reservoir pressure) the temperature of saturated-steam is also increased, Bitumen can be heated to a higher temperature, viscosity reduced and productivity increased. But, at higher pressures, the latent heat content of steam is reduced, so energy efficiency is reduced (SOR increases). This is a trade off. But, productivity dominates the economics, so most producers try to run at the highest feasible pressures.

For bitumen SAGD, we expect recoveries of about 50 to 70% OBIP and the residual bitumen in the steam-swept chamber to be about 10 to 20% of the pore volume, depending on steam temperatures (FIG. 19). Since about 1990, SAGD has now become the dominant in situ process to recover Canadian bitumen and the production growth is exponential (FIG. 20). Canada has now exceeded USA EOR steam heavy oil production and it is the world leader.

The current SAGD process is still similar to the original concept, but there are still expectations of future improvements (FIG. 21). The improvements are focused on 2 areas—using steam additives (solvents or non-condensable gases) e.g. Gates (2005) or improvements/alterations in SAGD geometry (Sullivan (2010), Kjorholt (2010), Gates (2010)).

2.2 In Situ Combustion (ISC)

In situ combustion (ISC) started with field trials in the 1950's (Ramey (1970)). ISC was the "holy grail" of EOR, because it was potentially the low-cost process. Early applications were for medium and heavy oils (not bitumen), where the oil had some in situ mobility. A simple vertical well was used to inject compressed air that would "push" out heated oil toward a vertical production well. The first version of ISC was dry combustion using only compressed air as an injectant (Gates (1977)) (FIG. 24). A combustion-swept zone is behind the combustion front. Downstream of the combustion front, in order, is a vaporizing zone with oil distillate and superheated steam, a condensing zone where oil and steam condense and an oil bank that is "pushed" by the injectant gas toward a vertical production well. The vaporizing zone fractionates oil and pyrolyzes the residue to produce a "coke" that is consumed as the combustion fuel.

Another version of ISC also emerged, called wet combustion or COFCAW. After a period of dry combustion, liquid water was injected with compressed air (or alternating injection). The idea was that water would capture heat inventoried in the combustion-swept zone to produce steam prior to the combustion front. This would improve productivity and efficiency (Dietz (1968), Parrish (1969), Craig (1974)). FIG. 31 shows how wet combustion worked, using the same simple vertical well geometry as dry combustion. A liquid water zone precedes the combustion-swept zone, otherwise the mechanisms are similar to dry ISC as shown in FIG. 24. The operator of a wet combustion process has to be careful not to inject water too early in the process or not to inject too much water, or the water zone can overtake the combustion front and quench HTO combustion.

The principles of dry and wet ISC were well known in the early days (Doschner (1966), Ramey (1970), Chu (1977)). The mechanisms were well documented. It was also recognized that these were two kinds of in situ combustion—low temperature oxidation (LTO), from about 150 to 300° C., where oxidation is incomplete, some oxygen can break through to the production well, organic compounds containing oxygen are formed, acids and emulsions are produced and the heat release per unit oxygen injected is lower; and high temperature oxidation (HTO), from about 400 to 800° C. where most (all) oxygen is consumed to produce combustion gases ($CO_2$, CO, $H_2O$ . . . ) and the heat release per unit oxygen consumed is maximized. It was generally agreed that HTO was desirable and LTO was undesirable (Butler (1991)). [For Athabasca bitumen, LTO is from 150 to 300° C. and HTO is from 380 to 800° C. (Yang (2009(2))]. A screening guide for ISC (Chu (1977)) ($\phi$>0.22, $S_0$>50%, $\phi$ $S_0$>0.13, API<24, $\mu$<1000 cp) indicates that ISC, using vertical-well geometry, is best applied to heavy or medium oils, not bitumen.

Despite decades of field project trials, ISC has only seen limited success, for a variety of reasons. In a 1999 DOE review (Sarathi (1999)), more than half of the North American field tests of ISC were deemed "failures". By the turn of the century the total world ISC projects dropped to 28 (Table 12).

ISC using oxygen or enriched air (ISC($O_2$)) was attempted in a few field projects. In the 1980's "hey day" for EOR, there were 10 ISC($O_2$) projects active in North America—4 in the USA and 6 in Canada (Sarathi (1999)). The advantages of using oxygen were purported as higher energy injectivity, production of near-pure CO, gas as a product of combustion, some $CO_2$ solubility in oil to reduce viscosity, sequestration of some $CO_2$, improved combustion efficiency, better sweep efficiency and reduced GOR for produced oil. The purported disadvantages of using oxygen were safety, corrosion, higher capital costs and LTO risks (Sarathi (1999), Butler (1991)).

Only a few tests of ISC were undertaken for bitumen recovery using vertical well geometries. For a true bitumen (>100, 000 c.p in situ viscosity) gas injectivity (air or oxygen) is very poor. So, even though bitumen is very reactive and has lower HTO and LTO temperatures than other oils and HTO can be sustained at very low oxygen/air flux rates (FIG. 25), bitumen ISC EOR processes are very difficult. New well geometries using horizontal wells, with short paths for bitumen recovery and perhaps a gravity drainage recovery mechanism, can improve the prospects for bitumen ISC EOR.

One such process that is currently field testing is the THAI process using a horizontal production well and horizontal or vertical air injector wells (FIG. 22, Graves (1996), Petrobank (2009)).

So far, success has been only limited. Another geometry is shown in FIG. 23 for the COSH or COGD process (New Tech. Magazine (2009)).

Others (Moore 1999, Javad (2001), Belgrave (2007)) have proposed to conduct bitumen ISC in the steam-swept gravity drainage chamber produced by a SAGD process, using the residual bitumen in the steam-swept zone as ISC fuel after the SAGD process has matured or reached its economic limit. These studies have concluded that ISC is feasible for these conditions.

2.3 Steam+Oxygen

It may be considered that COFCAW (water+air/oxygen injection for ISC) may be similar to steam+oxygen processes. ISC using COFCAW and air or oxygen could create steam+oxygen or steam+$CO_2$ mixtures when water was vaporized in the combustion-swept zone prior to (or after) the combustion front. But, if we have a modern geometry suited to bitumen recovery, we have short paths between wells. If liquid water is injected we would have a serious risk of quenching HTO reactions. COFCAW works for vertical well geometries (eg. Parrish (1969)) because of the long distance between injector and producer and the ability to segregate liquid water from the combustion zone until it is vaporized.

There is not much literature on steam+oxygen, but steam+$CO_2$ has been considered for EOR for some time. Assuming we have good HTO combustion, a steam+oxygen mixture will produce a steam+$CO_2$ mixture in the reservoir. Also, there has been some focus to produce steam+oxygen or steam+flue gas mixtures using surface or down hole equipment (Balog (1982), Wylie (2010), Anderson (2010)). Carbon dioxide can improve steam-only processes by providing other mechanisms for recovery—e.g. Solution gas drive or gas drive mechanisms. For example, steam+$CO_2$ was evaluated by Balog (1982) for a CSS process, using a mathematical simulation model. Compared to steam, steam+$CO_2$ (about 9% (v/v) $CO_2$) improved productivity by 35 to 38%, efficiency (OSR) by 49 to 57% and showed considerable $CO_2$ retention in the reservoir—about 1.8 MSCF/bbl. heavy oil after 3 CSS cycles.

There have only been a few studies of steam+$O_2$. Combustion tube tests have been performed using mixtures of steam and oxygen (Moore (1994) (1999)). The results have been positive, showing good HTO combustion, even for very low oxygen concentrations in the mixture (FIG. 28). The combustion was stable and more complete than other oxidant mixes (FIG. 29). Oxygen concentrations in the mix varied from just under 3% (v/v) to over 12% (v/v).

Yang ((2008) (2009(1)) proposed to use steam+oxygen as an alternative to steam in a SAGD process. The process was simulated using a modified STARS simulation model, incorporating combustion kinetics. Yang demonstrated that for all oxygen mixes, the combustion zone was contained in the gas/steam chamber, using residual bitumen as a fuel and the combustion front never intersected the steam chamber walls. FIG. 30 shows production forecasts using steam+oxygen mixtures varying from 0 to 80% (v/v) oxygen. But, the steam/gas chamber was contained with no provision to remove non-condensable gases. So, back pressure in the gas chamber inhibited gas injection and bitumen production, using steam+oxygen mixtures, was worse than steam-only (SAGD) performance (FIG. 30). Also, there was no consideration of the corrosion issue for steam+oxygen injection into a horizontal well, nor was there any consideration of minimum oxygen flux rates to initiate and sustain HTO combustion using a long horizontal well for $O_2$ injection.

Yang ((2008), 2009(1)) also proposed an alternating steam/oxygen process as an alternative to continuous injection of steam+$O_2$ mixes. But, issues of corrosion, minimum oxygen flux maintenance, ignition risks and combustion stability, were not addressed.

Bousard (1976) proposed to inject air or oxygen with hot water or steam to propogate LTO combustion as a method to inject heat into a heavy oil reservoir. But HTO is desirable and LTO is undesirable, as discussed above.

Pfefferle (2008) suggested using oxygen+steam mixtures in a SAGD process, as a way to reduce steam demands and to partially upgrade heavy oil. Combustion was purported to occur at the bitumen interface (the chamber wall) and combustion temperature was controlled by adjusting oxygen concentrations. But, as shown by Yang, combustion will not occur at the chamber walls. It will occur inside the steam chamber, using coke produced from residual bitumen as a fuel not bitumen from/at the chamber wall. Also, combustion temperature is almost independent of oxygen concentration (Butler, 1991). It is dependant on fuel (coke) lay down rates by the combustion/pyrolysis process. Pfefferle also suggested oxygen injection over the full length of a horizontal well and did not address the issues of corrosion, nor of maintaining minimum oxygen flux rates if a long horizontal well is used for injection.

Pfefferle, W. C. "Method for CAGD Recovery of Heavy Oil" US Pat. 2007/0187094 A1, Aug. 16, 2007 describes—a process similar to SAGD to recover heavy oil, using a steam chamber.

There are 2 versions described. The first version, injects a steam+oxygen mixture using a SAGD steam injector well. The second version injects oxygen into a new horizontal well, parallel to the SAGD well pair, but completed in the upper part of the reservoir. With the separate oxygen injector, steam is injected into the reservoir from the upper SAGD well to limit access of oxygen to the lower SAGD producer. Pfefferle (2007) proposes combustion occurs at the chamber walls (i.e. the steam-cold bitumen interface) and that temperature of combustion can be controlled by changing oxygen concentrations. It is proposed to increase combustion temperatures at the chamber walls sufficiently to crack and upgrade the oil. But Pfefferle (2007)

(1) doesn't focus on bitumen but uses the term oil or heavy oil.

(2) there is no provision to remove non-condensable gases produced by combustion (3) except for the second version of the process, oxygen and steam are not segregated to control/minimize corrosion (4) there is no consideration for a preferred range of oxygen/steam ratios or oxygen concentrations (5) in both cases oxygen injection is spread out over a long horizontal well. In the first case oxygen is also diluted with steam. There is no consideration to limiting oxygen-reservoir contact to ensure and control oxygen flux rates.

Pfefferle (2007) alleges that combustion will occur at the steam chamber wall (claims 1, 2, 7, 9). In reality this will never occur. Combustion will always occur in the steam-swept zone, using a coke fraction of residual bitumen as a fuel. Even without steam injected, a steam-swept zone will be formed using connate water from the reservoir. The combustion zone will always be far away from the steam chamber walls.

Pfefferle (2007) also alleges that the combustion temperature can be adjusted by changing the oxygen concentration (claims 2, 7, 9). This is not possible. Combustion temperature is controlled by the coke concentration in the matrix where combustion occurs. This has been confirmed by lab combustion tube tests. Combustion temperatures are substantially independent of oxygen concentration at the combustion site.

Finally Pfefferle (2007) also alleges that temperature at the chamber walls can be controlled by oxygen concentration (claims 7, 9) even to the extent of cracking and upgrading oil at the walls. In view of the discussion above, this will not happen.

Pfefferle, W. C. "Method for In Situ Combustion of In-Place Oils", U.S. Pat. No. 7,581,587 B2, Sep. 1, 2009 describes a geometry for dry in situ combustion using a vertical well and a horizontal production well. The vertical well has a dual completion and is located near the heel of the production well. The lower completion in the vertical well is near the horizontal producer and is used to inject air for ISC. The concentric upper completion is near the top of the reservoir and is used to remove non-condensable gases produced by combustion. Production is adjusted so the lower horizontal well is full of liquids (oil+water) at all times. The bleed well (gas removal well) may also have a horizontal section. Multiple bleed wells are also proposed. This is a heel-to-toe process. Most ISC processes using horizontal producers (eg THAI) are toe-to-heel processes. This process is for dry ISC and really doesn't apply to SAGDOX except, perhaps, for well configurations.

None of the SAGDOX versions described herein are for heel-to-toe processes. SAGDOX always has steam injection. Pfefferle doesn't discuss steam as an additive or as an option.

There exists therefore a long felt need to provide an effective SAGDOX process which is energy efficient and can be utilized to recover bitumen from a reservoir over a number of years until the reservoir is depleted.

It is therefore a primary object of the invention to provide a SAGDOX process wherein oxygen and steam are injected separately into a bitumen reservoir.

It is a further object of the invention to provide at least one well to vent produced gases from the reservoir to control reservoir pressures.

It is yet a further object of the invention to provide production wells extending a distance of greater than 1000 meters.

It is yet a further object of the invention to provide oxygen at an amount of substantially 35% (v/v) and corresponding steam levels at 65%.

It is yet a further object of the invention to provide oxygen and steam from a local cogeneration and air separation unit located proximate a SAGDOX process.

Further and other objects of the invention will be apparent to one skilled in the art when considering the following summary of the invention and the more detailed description of the preferred embodiments illustrated herein.

SUMMARY OF THE INVENTION

According to a primary aspect of the invention there is provided a process to recover hydrocarbons from a hydrocarbon reservoir, namely bitumen (API<10; in situ viscosity >100,000 c.p.), said process comprising;

establishing a horizontal production well in said reservoir;

separately injecting an oxygen-containing gas and steam continuously into the hydrocarbon reservoir to cause heated hydrocarbons and water to drain, by gravity, to the horizontal production well, the ratio of oxygen/steam injectant gases being controlled in the range from 0.05 to 1.00 (v/v).

removing non-condensable combustion gases from at least one separate vent-gas well, which is established in the reservoir to avoid undesirable pressures in the reservoir.

In one embodiment steam is injected into a horizontal well of the same length as the production well, and parallel to said production well with a separation of 4 to 10 m, directly above the production well using for example a typical SAGD geometry.

Preferably vertical oxygen injection and vent gas wells are established in the reservoir.

In another embodiment said vertical wells for oxygen injection and vent gas removal are not separate wells but tubing strings are inserted within the existing horizontal steam injection well proximate the vertical section of the well, and packers are used to segregate oxygen injection and/or vent-gas venting.

Preferably the oxygen-containing gas has an oxygen content of 95 to 99.9% (v/v). In another embodiment oxygen-containing gas is enriched air with an oxygen content of 20 to 95% (v/v).

In another embodiment oxygen-containing gas has an oxygen content of 95 to 97% (v/v). Alternatively the oxygen-containing gas is air.

In one embodiment said process further comprises an oxygen contact zone portion of the well within the reservoir less than 50 m long and said zone being implemented by aspects therein selected from perforations, slotted liners, and open holes.

In another embodiment the horizontal wells are part of an existing SAGD recovery process and incremental SAGDOX wells, for oxygen injection and for non-condensable vent gas removal, are added subsequent to SAGD operation.

In another embodiment said process further comprises a SAGDOX process that is started up by operating a horizontal well pair in the SAGD process and subsequently circulating steam in incremental SAGDOX wells until all the wells are communicating, prior to starting oxygen injection and vent gas removal.

Preferably the SAGDOX process is started by circulating steam in all wells until all the wells are communicating, prior to starting oxygen injection and vent gas removal.

In another embodiment a SAGDOX process is controlled and operated by steps selected from:

i. Adjusting steam and oxygen flows to attain a predetermined; oxygen/steam ratio and energy injection rate targets, ii. Adjusting vent gas removal rates to control process pressures and to improve/control conformance, iii. Controlling bitumen and water production rates to attain sub-cool targets, assuming fluids close to the production well are steam-saturated (steam trap control).

Steam trap control (also called sub cool control) for steam EOR or SAGDOX is used to control the production well rate so that only liquids (bitumen and water) are produced, not steam or other gases. The way this is done is as follows:

(1) it is assumed that the region around the well is predominantly saturated steam. For SAGD this is easy since steam is the only injectant. For SAGDOX this means that noncondesable gases produced from combustion are near the top of the reservoir away from the production well. This has been confirmed by several lab tests and some field tests.

(2) pressure is measured either at the steam injection well or at the production well. Saturated steam T is calculated using the measured pressure.

(3) the production well fluid production rate is controlled (pump or gas lift rates) so that the average T (or heel T) is less than the saturated steam T calculated, usually by 10 to 20 C of sub cool.

Preferably oxygen/steam ratios start at about 0.05 (v/v) and ramp up to about 1.00 (v/v) as the process matures.

In a preferred embodiment the oxygen/steam ratio is between 0.4 and 0.7 (v/v).

Preferably when SAGDOX is implemented the horizontal well length of the pattern is extended when compared to an original SAGD design.

In one example the horizontal well length extends beyond 1000 m.

In one embodiment the process further comprises conversion of a mature SAGD project whereat adjacent patterns are in communication, to a SAGDOX project using 3 adjacent patterns where the steam injector of the central pattern is converted to an oxygen injector and the injector wells of the peripheral patterns are continued to be used as steam injectors.

Preferably the oxygen/steam ratio is between 0.05 and 1.00 (v/v). Preferably the gases are produced, as separate streams, by an integrated ASU: Cogen Plant.

In another embodiment further process steps are selected from:

i. The ratio of oxygen/steam is between 0.4 and 0.7 (v/v), ii. The oxygen purity in the oxygen-containing gas is between 95 and 97% (v/v), iii. Steam and oxygen are produced in an integrated ASU: Cogen plant, iv. The oxygen contact zone with the reservoir is less than 50 m.

In another preferred embodiment of the process the oxygen injection well is no more than 50 m. of contact with the reservoir, to avoid oxygen flux rates dropping to less than that needed to start ignition or to sustain combustion.

In a further preferred embodiment of the process steam provides energy directly to the reservoir and oxygen provides energy by combusting residual bitumen (coke) in the steam chamber whereat the combustion zone is contained; residual bitumen being heated, fractionated and finally pyrolyzed by hot combustion gases, to make coke, the actual fuel for combustion.

Preferably the bitumen and water production well is controlled assuming saturated conditions using steam-trap control, without producing significant amounts of live steam, non-condensable combustion gases or unused oxygen.

In another embodiment the steam-swept zone of the steam chamber in a SAGDOX process further comprises;

a combustion-swept zone with substantially zero residual bitumen and connate water, a combustion front, a bank of bitumen heated by combustion gases, a superheated steam zone, a saturated-steam zone, and a gas/steam bitumen interface or chamber wall where steam condenses and releases latent heat.

In one embodiment:

bitumen drains, by gravity, from a hot bitumen bank and from a bitumen interface, water drains, by gravity, from a saturated steam zone and from the bitumen interface, and energy (heat) in the hot bitumen and in the superheated-steam zone is partially used to reflux some steam. The fuel for combustion and the source of bitumen in the hot bitumen zone is residual bitumen in the steam-swept zone, combustion being contained inside of the steam chamber and preferably wherein hot combustion gases transfer heat to bitumen, in addition to steam mechanisms.

In another embodiment carbon dioxide, produced as a combustion product, can dissolve into bitumen and reduce viscosity.

In an alternative embodiment oxygen purity is reduced to substantially the 95-97% range whereat energy needed to produce oxygen from an ASU drops by about 25% and SAGDOX efficiencies improve significantly.

In a preferred embodiment of the process the SAGDOX process uses water directly as steam is injected, but it also produces water directly from 2 sources, namely water produced as a combustion product and connate water vaporized in the combustion-swept zone.

Preferably the maximum oxygen/steam ratio is 1.00 (v/v) with an oxygen concentration of 50.0%.

In another embodiment of the process as a SAGDOX process matures, the combustion front will move further away from the oxygen injector and requires increasing oxygen rates to sustain High Temperature Oxidation reactions.

Preferably the SAGDOX gas mix is between 20 and 50% (v/v), oxygen in the steam/oxygen mixture.

More preferably the SAGDOX gas mix is 35% oxygen (v/v), oxygen in the steam/oxygen mixture.

In a preferred embodiment the oxygen injection point needs to be preheated to about 200° C. so oxygen will spontaneously react with residual fuel.

According to yet another aspect of the invention there is provided a method of starting up of a SAGDOX process described herein comprising the following steps:

1. Start oxygen injection and reduce steam flow to achieve a proscribed oxygen concentration target at the same energy rates as SAGD,
2. as reservoir pressures approach a target pressure, partially open one (or more) produced gas (PG) removal wells to remove non-condensable combustion gases and to control P,
3. If split/multiple PG wells are provided adjust PG removal rates to improve/optimize $O_2$ conformance,
4. If oxygen gas is present in PG removal well gas, the well should be choked back or shut in.
5. If non-condensable gas ($CO_2$, CO, $O_2$ . . . ) is present in the horizontal producer fluids, the production rate should be slowed and/or oxygen conformance adjusted and/or PG removal rates increased.

DETAILED DESCRIPTION OF THE INVENTION

Figure 1:
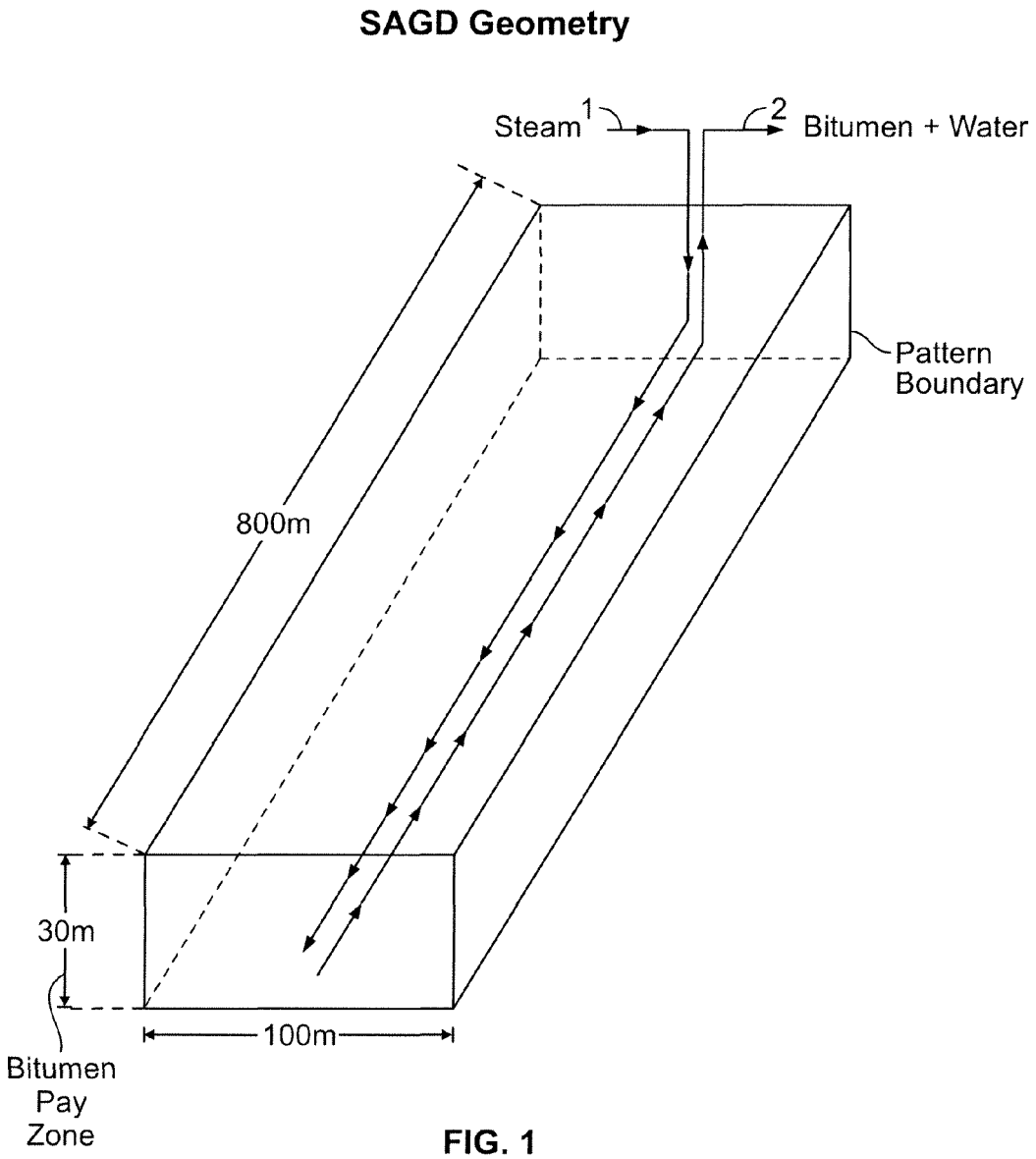
FIG. 1 is a SAGD Geometry.

Problems Solved 3.1 SAGD Problems (1) Steam is costly
(2) SAGD uses a lot of water (0.25 to 0.50 bbl water/bbl bitumen)
(3) Production well (bitumen+water) pressure gradients can limit SAGD productivity and energy (steam) injectivity. For a typical horizontal well length of 1000 m., using a typical tubing/pipe sizes fluid productivity is limited to about 4000 bbl/d, otherwise the liquid/gas interface (steam/water) can flood the toe of the steam injector and/or steam can break through to the producer heel. Alternately for the above production rates, the effective well length is limited to about 1000 m, so the pattern size is also limited. If the well separation is increased from say 5 to 10 meters, the effective well length (or injectivity) can be increased, but the start up period is prolonged significantly. If well/pipe sizes are increased to increase well length or injectivity, capital costs and heat losses are increased.
(4) Carbon dioxide emissions from SAGD steam boilers are significant (about 0.08 tonnes $CO_2$/bbl bitumen). The emitted $CO_2$ is not easily captured for sequestration. It is diluted in boiler flue gas, or in cogen flue gas.
(5) Steam cannot be economically transported for more than about 5 miles. A central steam plant can only service a limited area.
(6) SAGD is a steam-only, saturated-steam process. Temperature is determined by operating pressure
(7) SAGD cannot mobilize connate water by vaporization.
(8) SAGD cannot reflux steam/water in the reservoir. It is a once-through water process.
(9) SAGD, in the steam-swept zone, leaves behind (not recoverable) 10 to 20% (v/v) of the pore volume as residual bitumen.
(10) When SAGD reaches its economic limit, zones of unswept reservoir ("wedge oil") are not recovered.
(11) If we measure energy efficiency as the percentage of net energy produced, considering energy used on the surface to produce bitumen and the fuel value of the bitumen produced, SAGD is relatively inefficient.

3.2 SAGDOX Problems (1) Mixtures of saturated steam and oxygen are very corrosive to carbon steel and other alloys. New wells or a segregation system are needed to keep oxygen and steam separated prior to injection into the reservoir.
(2) One suggestion (Yang (2009)) is to use the SAGD steam injector well for alternating volumes of steam and oxygen. But to sustain HTO combustion we need a constant supply and a minimum flux of oxygen, otherwise we will breakthrough oxygen to producer wells or start LTO combustion.
(3) It has also been suggested (Yang (2009), Pfefferle (2008)) that we can simply mix oxygen with steam and use the horizontal steam injector for SAGD. Aside from severe corrosion issues noted above (I), oxygen flux rates are a concern. If oxygen is mixed with steam and injected in a horizontal well, oxygen flux is diluted over the length of the horizontal well (~1000 m.) Flux of oxygen, in some areas, may be too low to initiate and sustain HTO combustion. Even if average flux rates are satisfactory, inhomogeneities in the reservoir may cause some areas to be depleted in oxygen. As a result, oxygen breaks through to production wells or low flux oxygen can result in LTO oxidation.
(4) Separate control of oxygen and steam rates is needed to adjust energy input rates and relative contributions from each component.
(5) Oxygen needs to be injected, at first, into (or near to) a steam-swept zone, so combustion of residual fuel components occurs and injectivity is not a serious limit. The zone also needs to be preheated (at start-up) so spontaneous HTO ignition occurs (not LTO).

(6) The well configuration should ensure that oxygen (and steam) is mostly contained within the well pattern volume.

(7) If new SAGDOX wells are too far away from the steam-swept zone, start-up time to transition from SAGD to SAGDOX can be prolonged. Because SAGDOX energy is less costly than SAGD, it is desirable to start SAGDOX quickly.

How to Shut Down a SAGDOX Process

Since oxygen is much less costly than steam as a way to provide energy to a bitumen reservoir for EOR and during normal SAGDOX operations we have built up a large inventory of steam in the reservoir, when the process reaches its economic limit (i.e. when oxygen+steam costs=produced bitumen value) the following shut down procedure is suggested:

(1) shut off steam injection (2) continue to inject $O_2$ at previous rates (3) continue to use sub-cool control for the production well (4) when the process reaches its new economic limit (when O2 cost=produced bitumen value) shut in the oxygen injector (5) continue to produce bitumen until production rates fall below a predetermined target (eg 10 bbls/d)

SAGDOX Technical Description 4.1 SAGD Simulation

SAGD is a process that uses 2 parallel horizontal wells separated by about 5 m., each up to about 1000 m. long, with the lower horizontal well (the bitumen+water producer) about 2 to 8 m. above the bottom of the reservoir (see FIG. 1). After a startup period where steam is circulated in each well to attain communication between the wells, steam is injected into the upper horizontal well and bitumen+water are produced from the lower horizontal well.

We have simulated a SAGD process using the following assumptions:

(1) A homogeneous sandstone (or sand) reservoir containing bitumen (2) Generic properties for an Athabasca bitumen (3) 25 m homogeneous pay zone (4) 800 m. SAGD well pair at 100 m spacing, with 5 m spacing between the parallel horizontal wells (5) 10° C. sub cool for production control (i.e. produced fluids are 10° C. lower than saturated-steam T at reservoir P)

Figure 2:
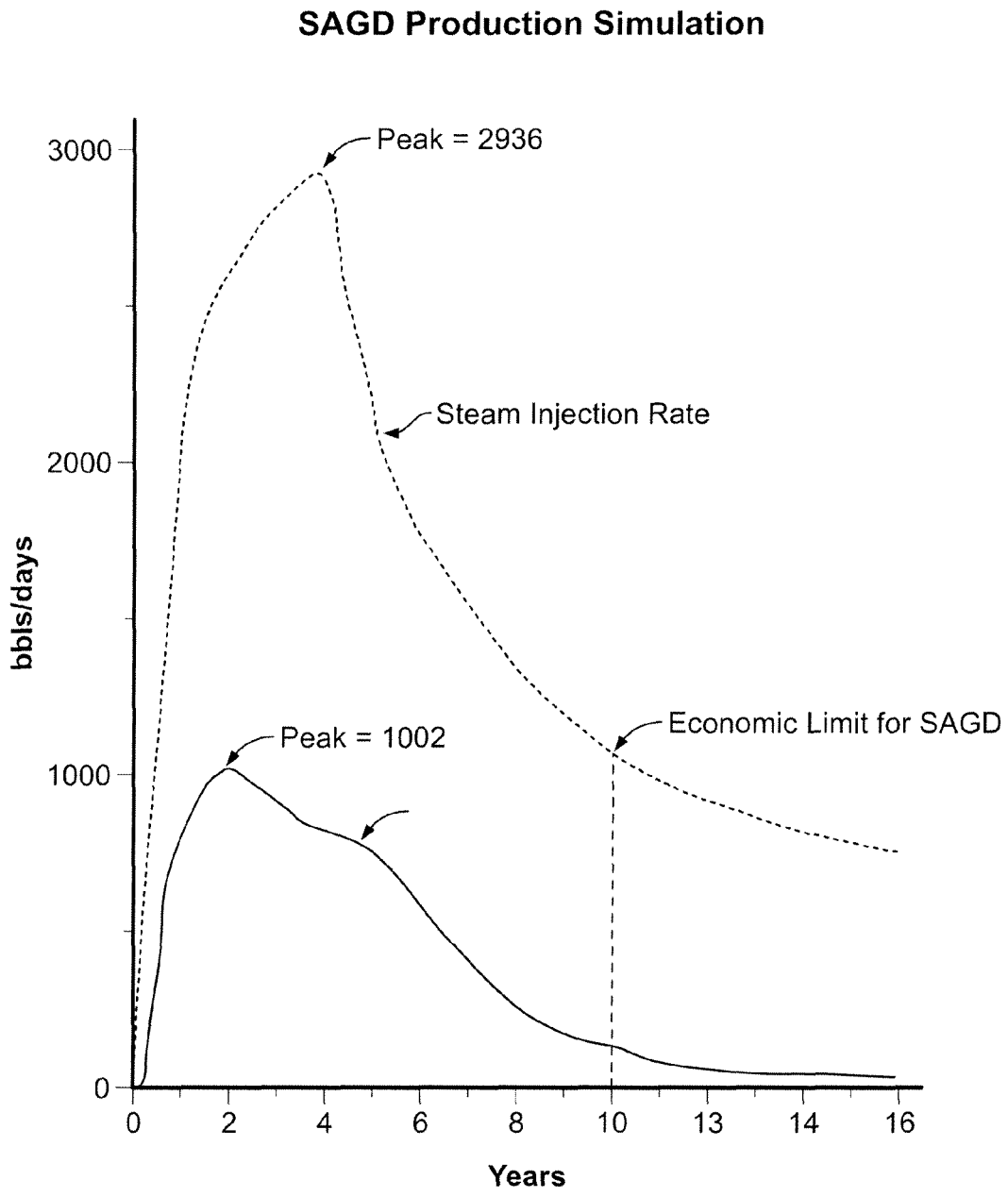
FIG. 2 is a SAGD Production Simulation.

(6) 2 MPa pressure for injection control (7) 4 mos. steam circulation prior to SAGD start-up (8) Discretized well-bore model The simulation production is shown in FIG. 2. The economic limit is taken as SOR=9.5 at the end of year 10. The following are highlights of the simulation:

(1) Bitumen recovery=33.6 $km^3$=2.099 mM bbl (2) Avg. bitumen productivity=575 bbl/d (3) Steam used=1124.9 $km^3$=7.078 mM bbl=$2.477\times10^{12}$ BTU (4) Avg. steam rate=1939 bbl/d (5) Avg. SOR=3.37; avg. ETOR (Energy to Oil Ratio) =1.180 MMBTU/bbl (6) Recovery factor=63.4% OBIP (7) OBIP for pattern=3.31 mM bbl We will use these results as the basis for SAGDOX comparison.

4.2 SAGDOX

Figure 3:
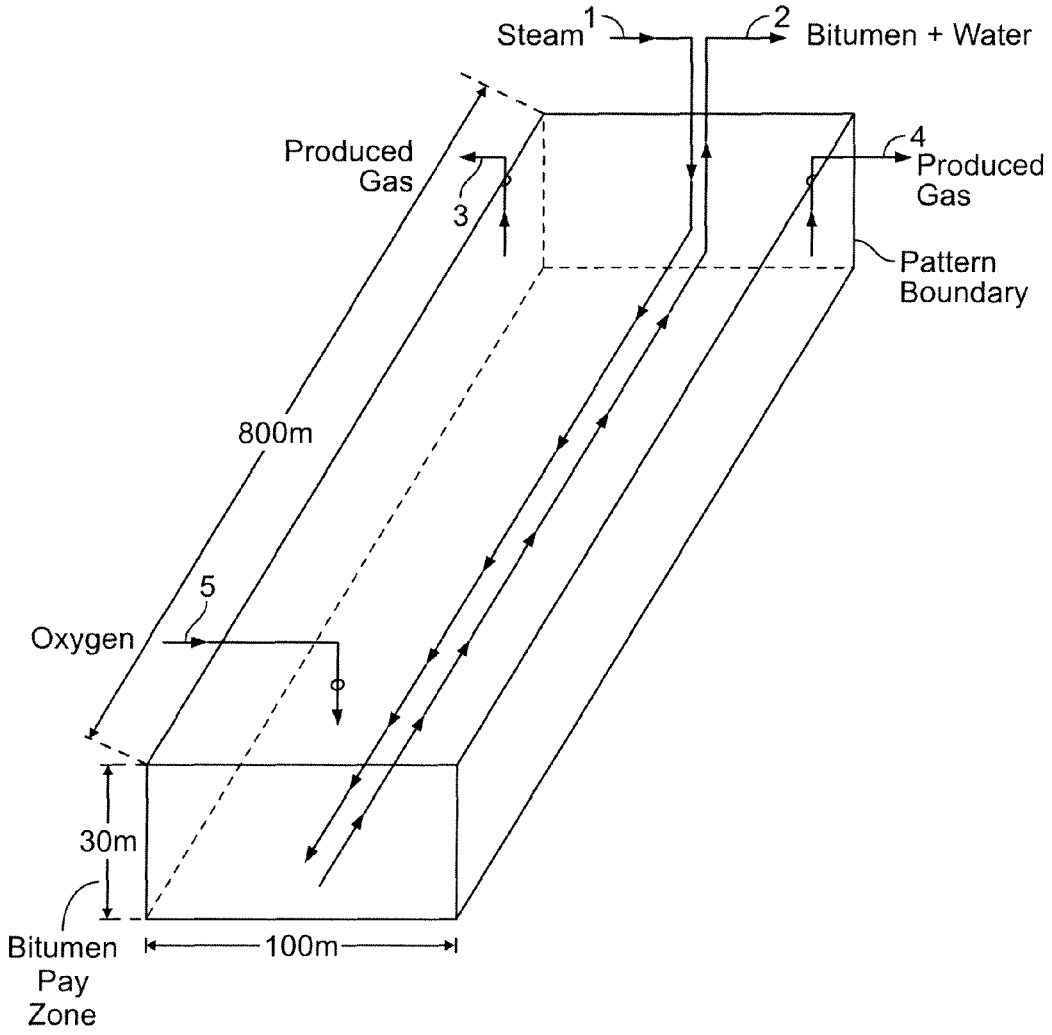
FIG. 3 is a SAGDOX Geometry 1.
Figure 3A:
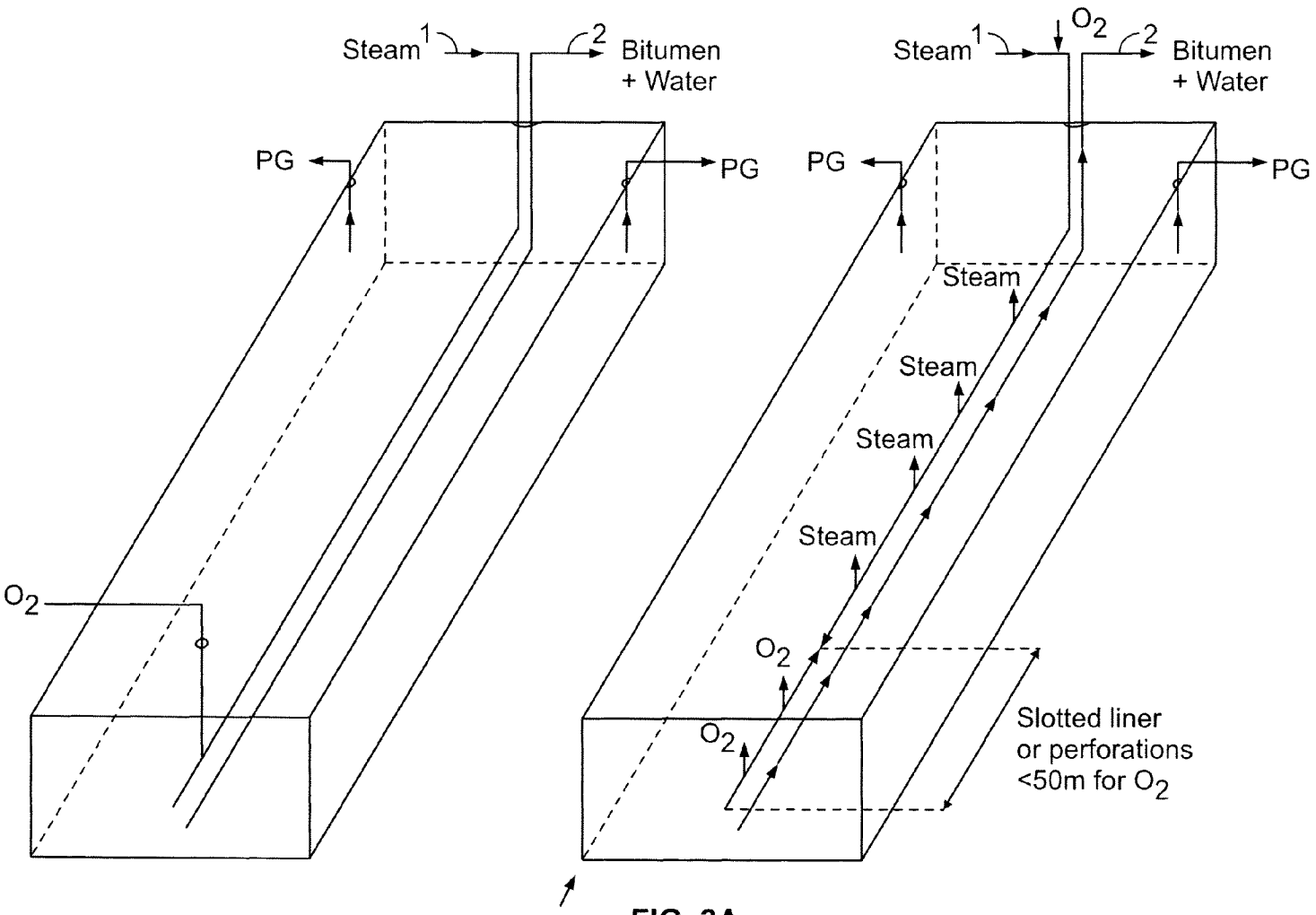
FIGS. 3A through 3E provide additional details of SAGDOX geometry regarding FIG. 3.
Figure 3B:
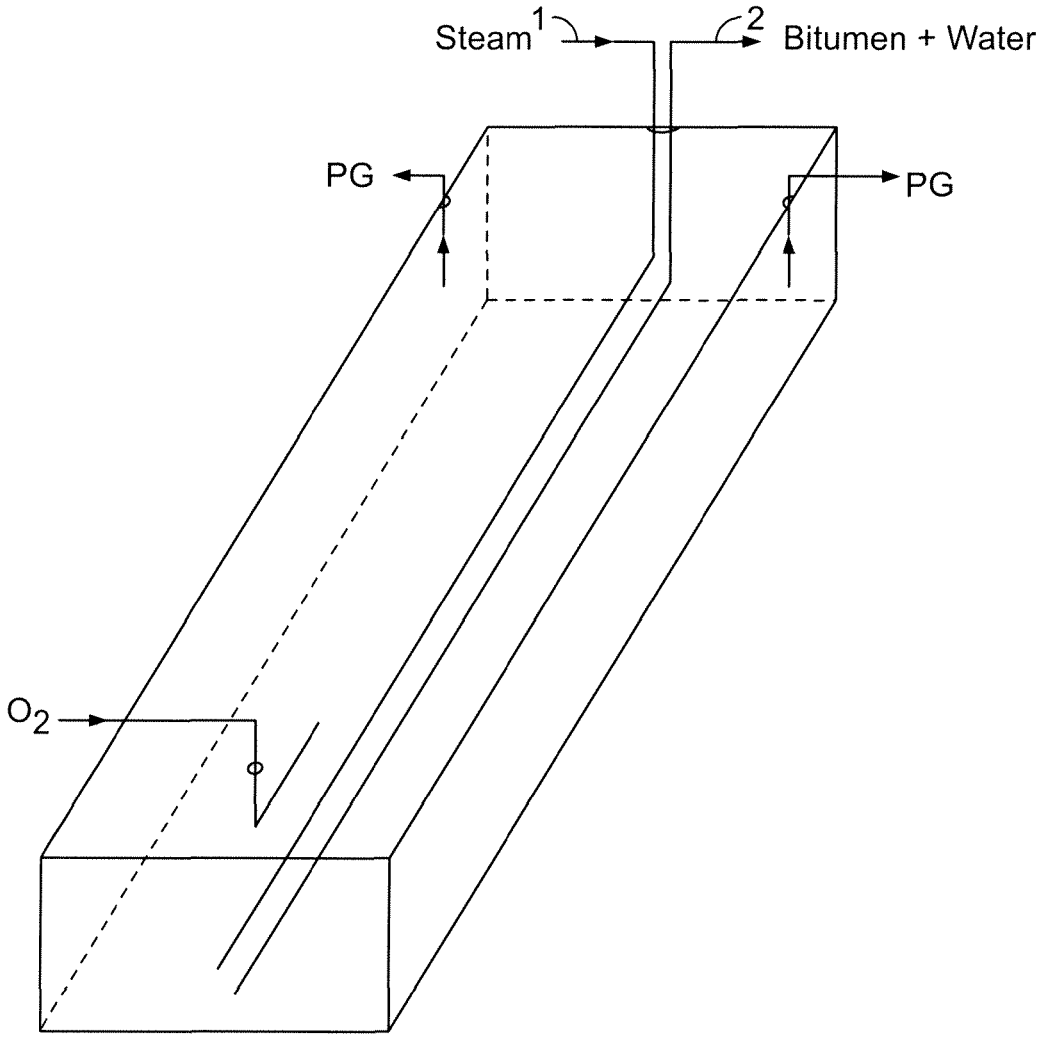
Figure 3C:
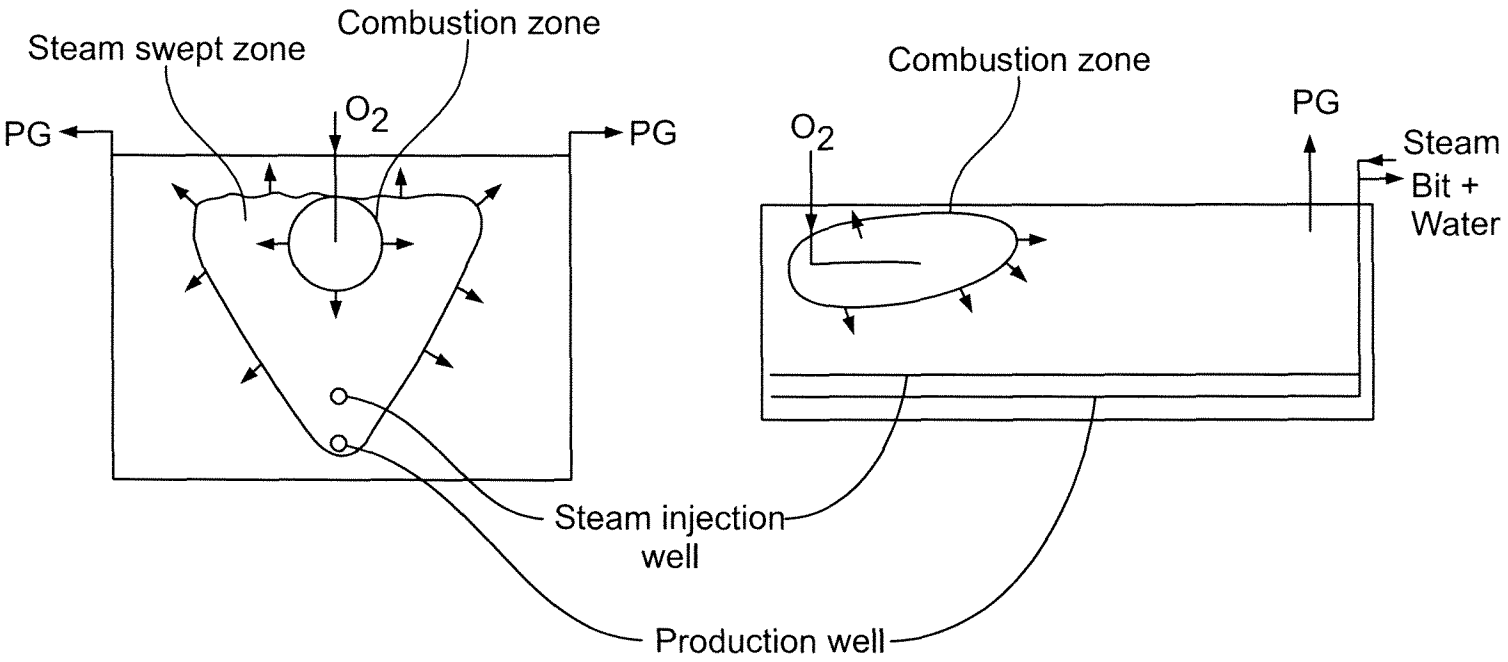
Figure 3D:
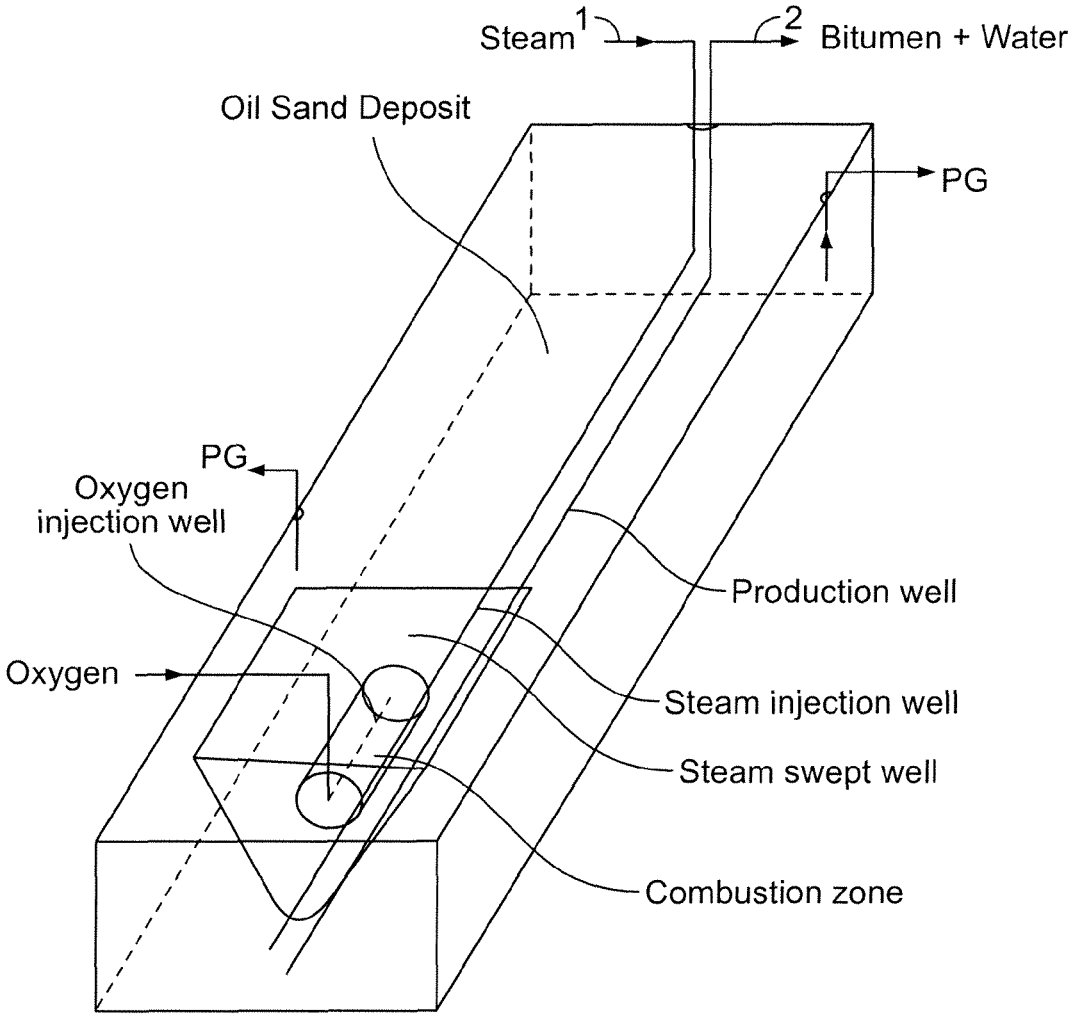
Figure 3E:
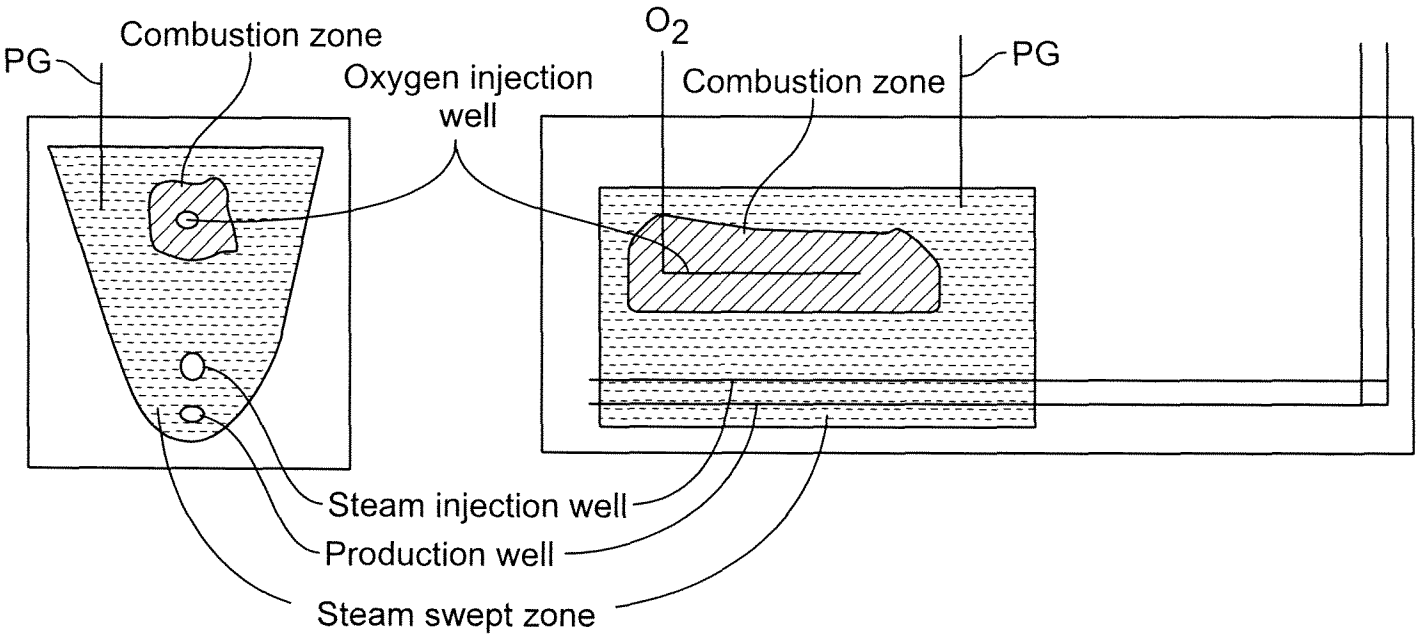
Figure 25:
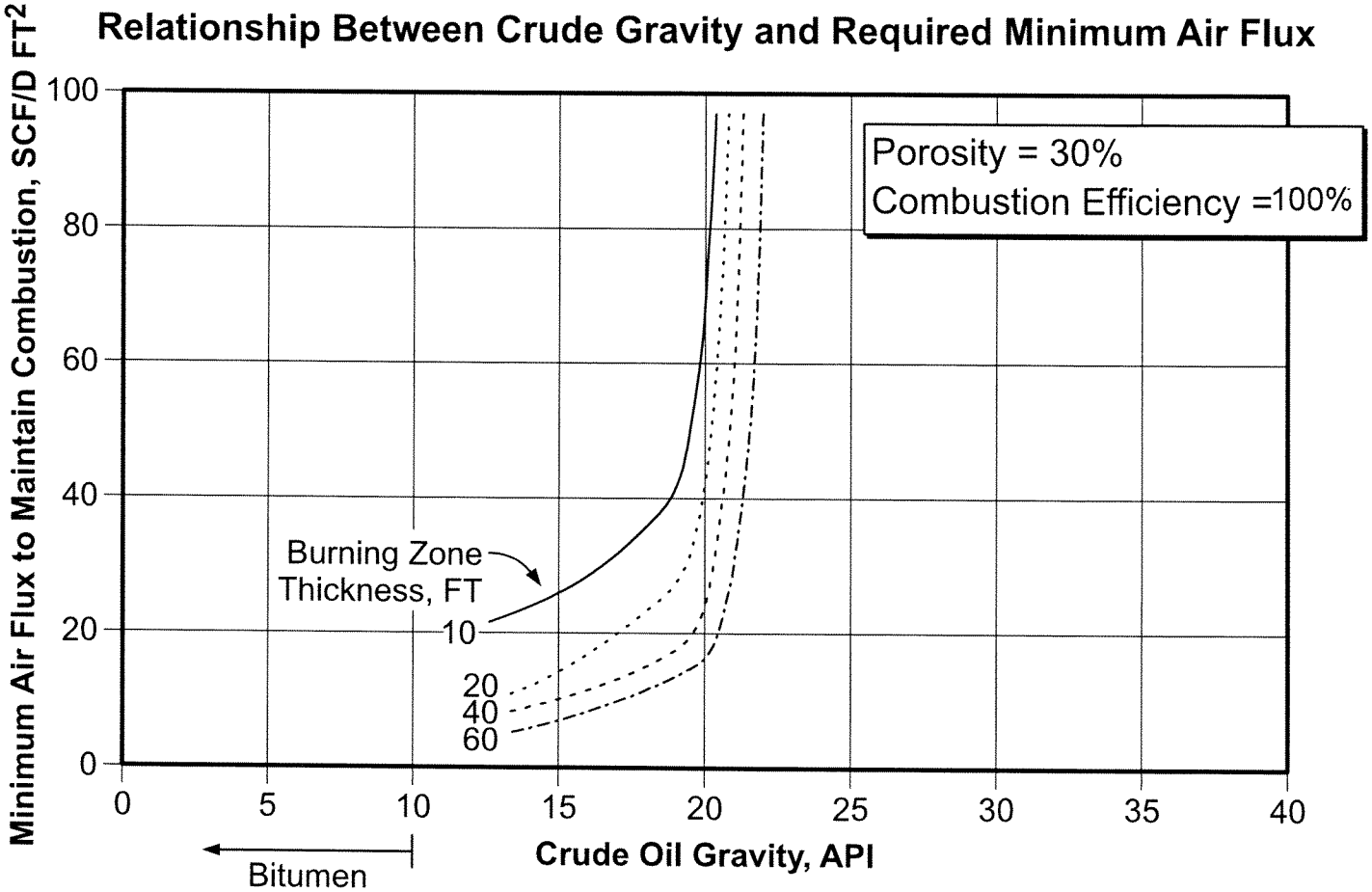
FIG. 25 is ISC Minimum Air Flux Rates.
Figure 26:
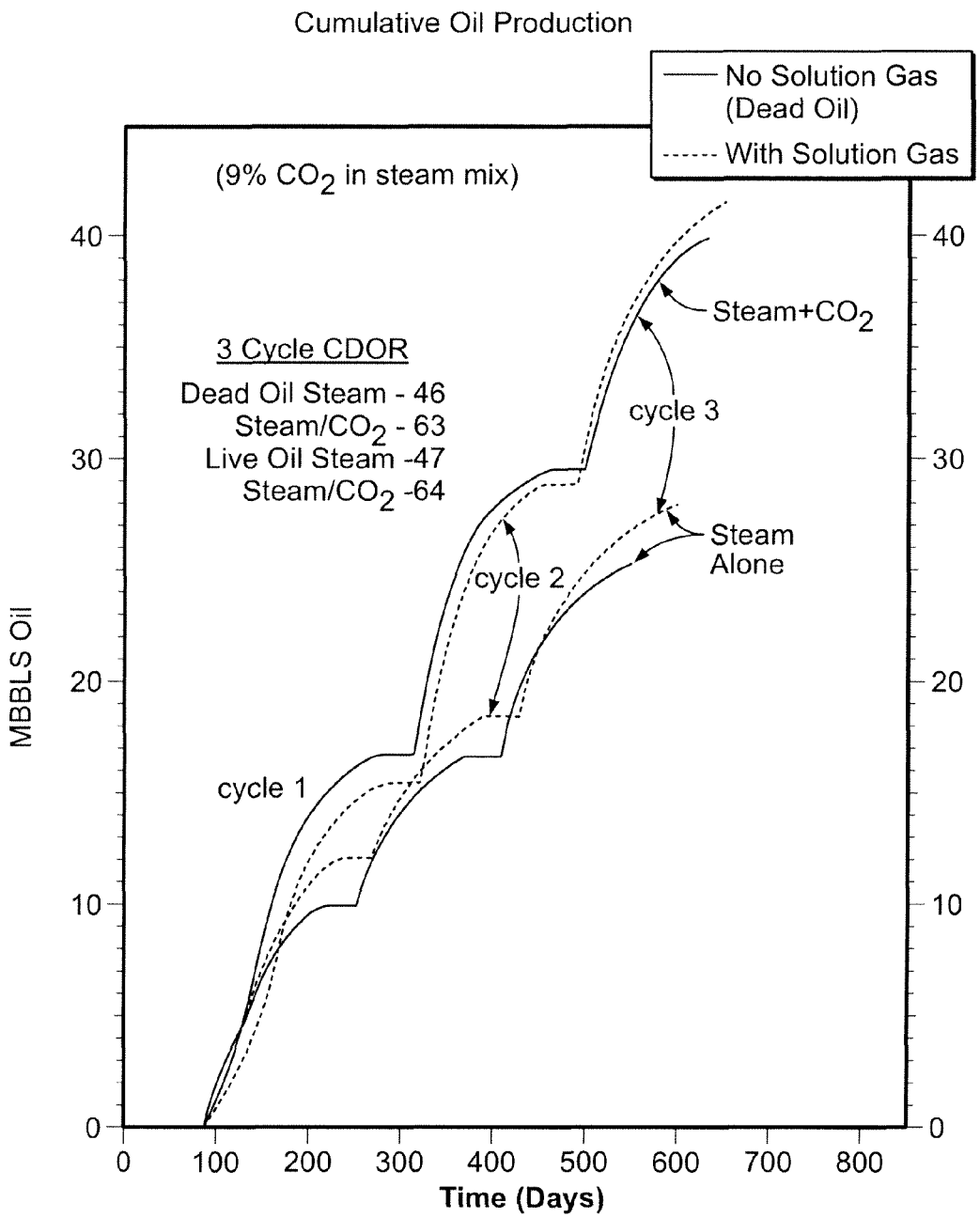
FIG. 26 is CSS using Steam+$CO_2$: Production.
Figure 27:
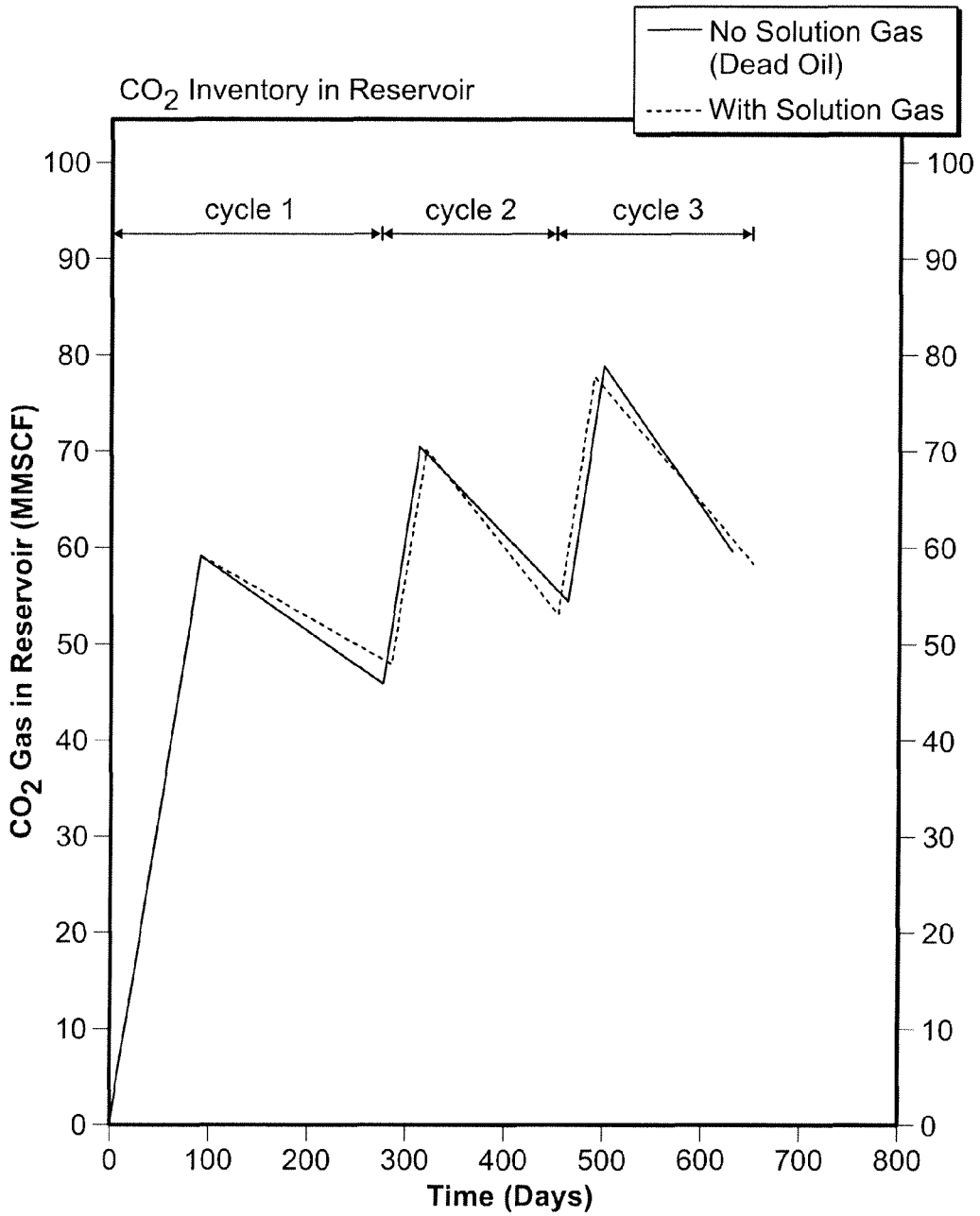
FIG. 27 is CSS using Steam+$CO_2$: Gas Retention (9% $CO_2$ in steam mix).
Figure 28:
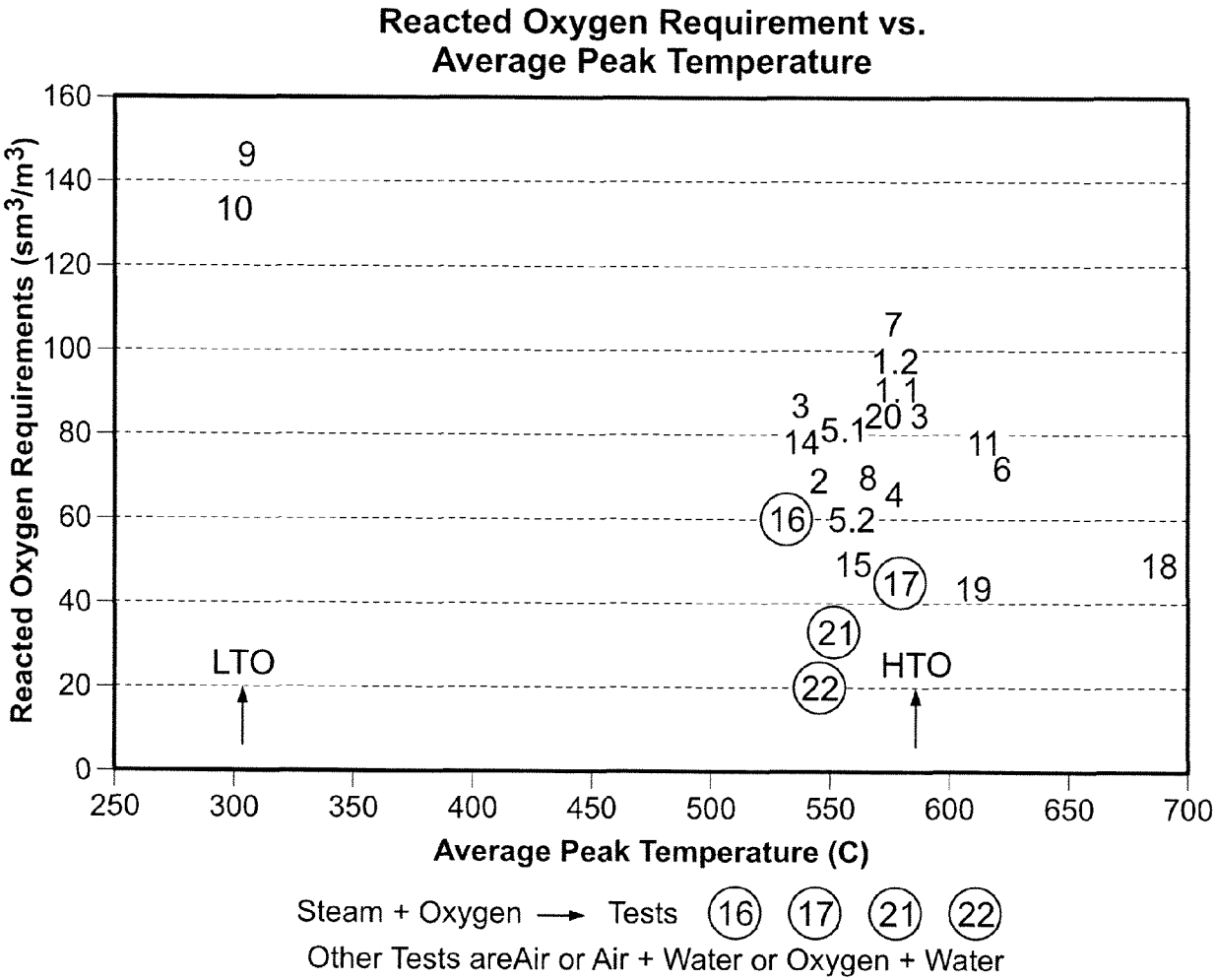
FIG. 28 is Steam+Oxygen Combustion Tube Tests I.
Figure 29:
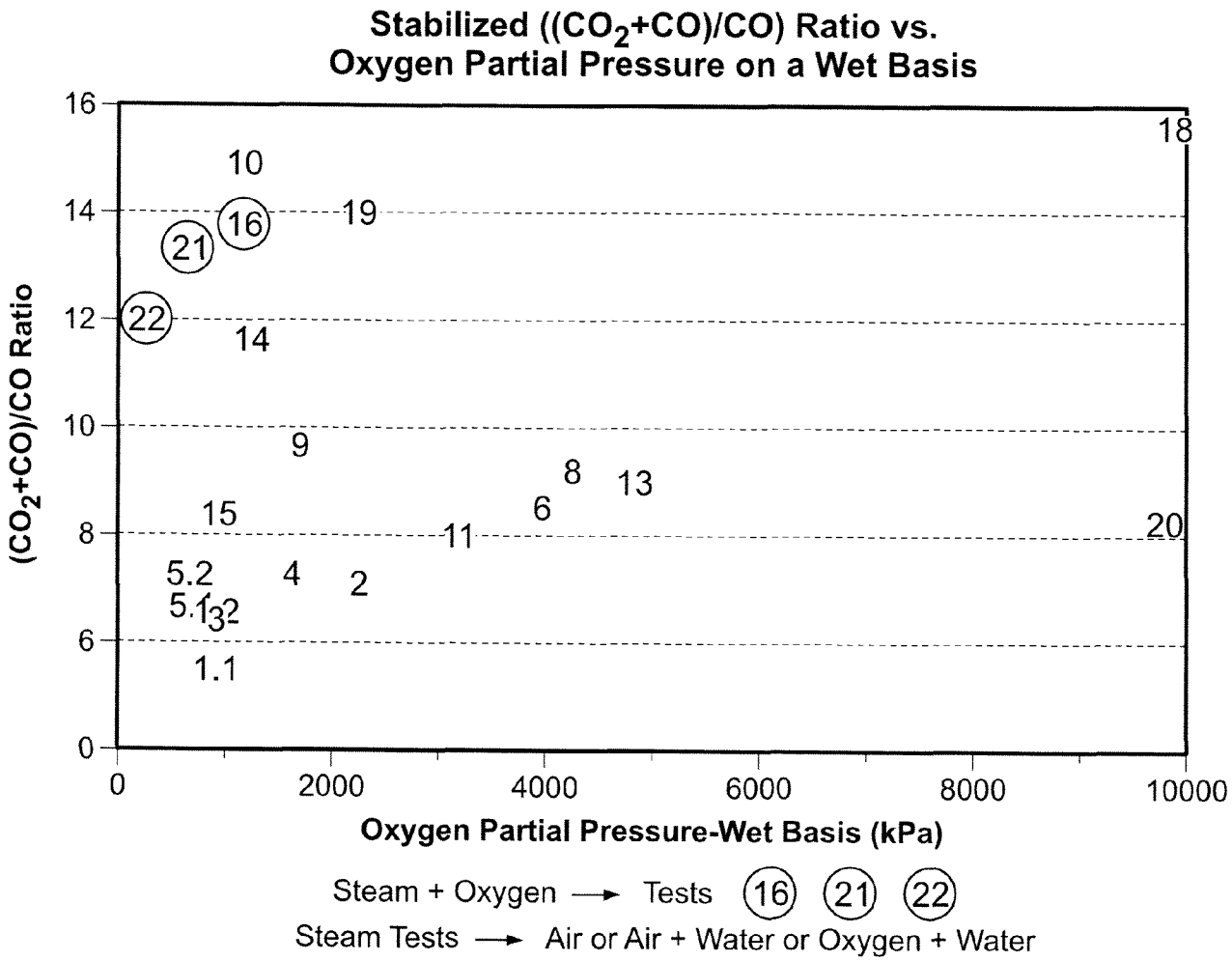
FIG. 29 is Steam+Oxygen Combustion Tube Tests II.
Figure 30:
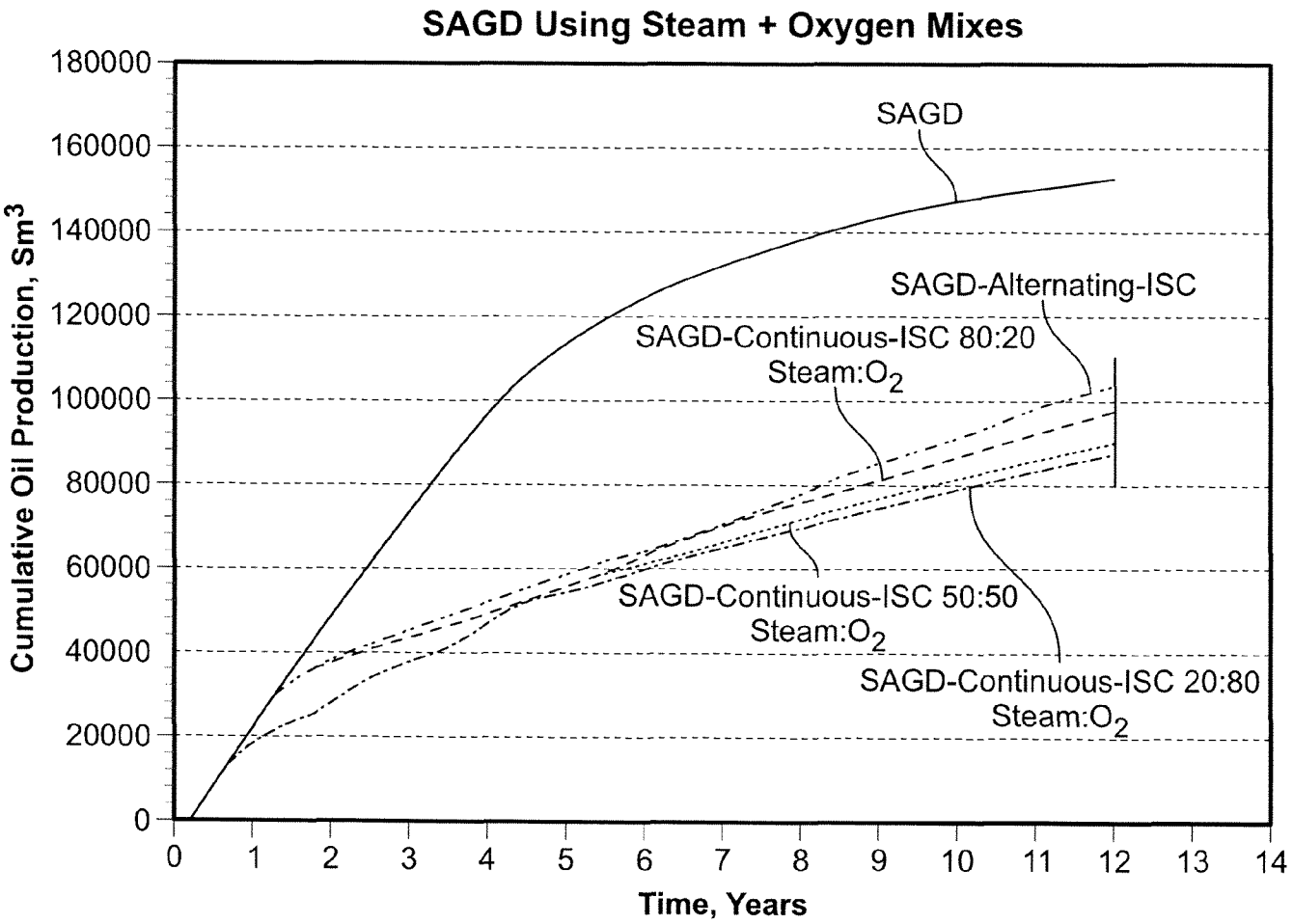
FIG. 30 is SAGD using Steam+Oxygen mixes.
Figure 31:
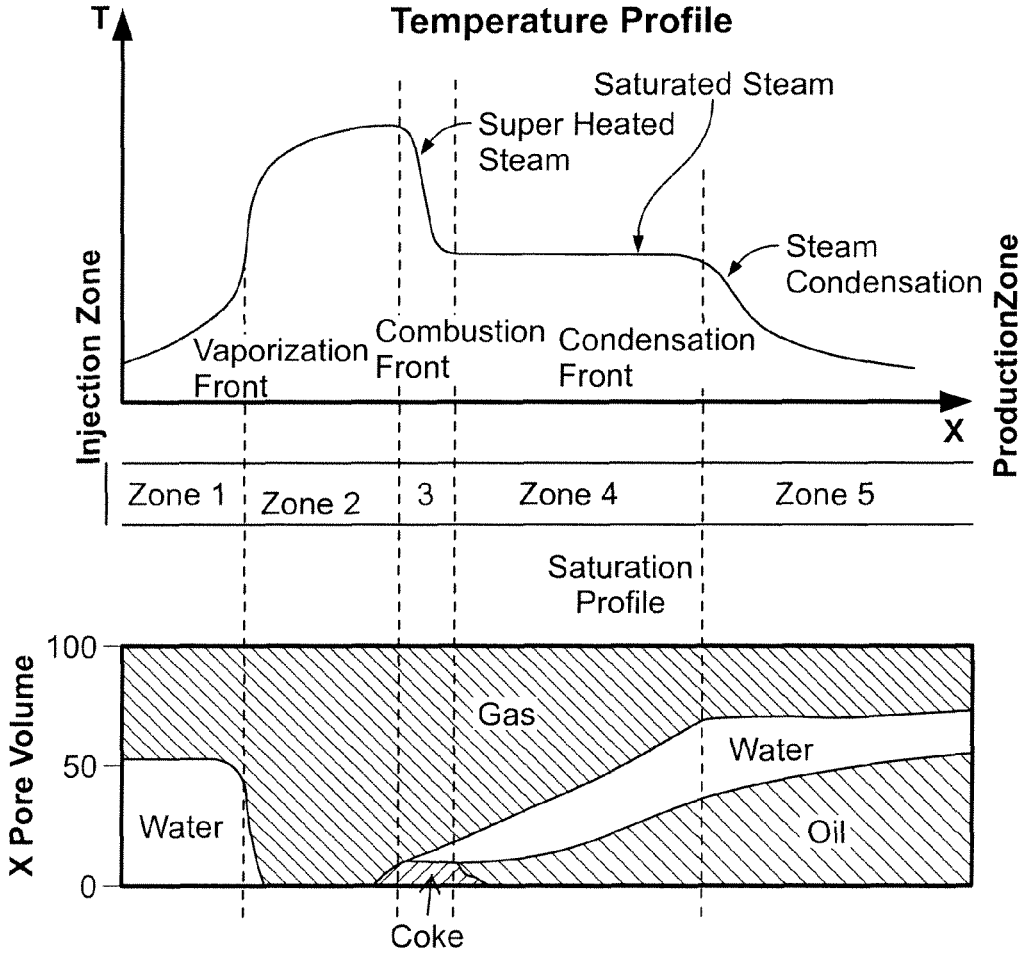
FIG. 31 is a Wet ISC.

SAGDOX is a bitumen EOR process using horizontal wells, similar to SAGD, for steam injection and for bitumen+water production, with extra vertical wells to inject oxygen gas and to remove non-condensable combustion gases (FIG. 3). Steam and oxygen are injected separately and continuously into a bitumen reservoir as sources of energy. Table 1 summarizes properties of steam/oxygen mixes, assuming 1000 BTU/lb steam and 480 BTU/SCF oxygen (Butler, 1991) used for in-situ combustion. The heat assumptions include heat released directly to the reservoir and heat recovered from produced fluids, assuming that produced fluid heat recovery is useful. The reservoir is preheated by steam either by conducting a SAGD process in the horizontal wells or by steam circulation in the SAGDOX extra wells, until communication is established between the wells. Then oxygen and steam are introduced in separate or segregated injectors, otherwise corrosion can be a problem. The oxygen injection well (or segregated section) should be no more than 50 m. of contact with the reservoir, otherwise oxygen flux rates can drop to less than that needed to start ignition or to sustain combustion (FIG. 25). Steam provides energy directly to the reservoir. Oxygen provides energy by combusting residual bitumen (coke) in the steam chamber. The combustion zone is contained within the steam chamber. Residual bitumen is heated, fractionated and finally pyrolyzed by hot combustion gases, to make coke that is the actual fuel for combustion. A gas chamber is formed containing injected steam, combustion gases, refluxed steam and vaporized connate (formation) water.

Heated bitumen drains from the gas chamber (residual bitumen) and from the chamber walls. Condensed steam drains from the saturated steam area and from the chamber walls. Condensed water and bitumen are collected by the lower horizontal well and conveyed (or pumped) to the surface. Please see FIGS. 3A through D in this regard.

FIG. 3 shows one geometry suitable for SAGDOX. A SAGD horizontal well pair (wells 1 and 2) has been augmented by 3 new vertical SAGDOX wells—2 wells to remove non-condensable combustion gases (wells 3 and 4) and a separate oxygen injection well (well 5). The vertical gas-remover wells are on the pattern boundary and are shared by neighbor patterns (i.e. only 1 net well). An oxygen injection well (well 5) is near the SAGD toe, and completed low enough in the pay zone to ensure that oxygen injection is into a steam-swept zone.

The produced gas removal wells are operated separately to control conformance and reservoir pressure, while minimizing production of steam and/or unused oxygen. Oxygen and steam injection are controlled to attain oxygen/steam ratio targets (oxygen "concentration") and energy injection rates. The bitumen+water production well is controlled assuming saturated conditions using steam-trap control, without producing significant amounts of live steam, non-condensable combustion gases or unused oxygen.

The SAGDOX process may be considered as a SAGD process using wells 1 and 2 and a simultaneous in situ combustion (ISC) process using wells 3, 4 and 5. Of course the geometry shown in FIG. 3 is not the only alternative for SAGDOX (see 4.10).

4.3 Oxidation Chemistry

SAGDOX creates some energy in a reservoir by combustion. The "coke" that is prepared by hot combustion gases fractionating and pyrolyzing residual bitumen, can be represented by a reduced formula of $CH_{.5}$. This ignores trace components (S, N, O . . . etc.) and it doesn't imply a molecular structure, only that the "coke" has a H/C atomic ratio of 0.5.

Let's assume:

(1) CO in the product gases is about 10% of the carbon combusted (2) Water-gas-shift reactions, occur in the reservoir $$CO+H_2O \rightarrow CO_2+H_2+HEAT$$

This reaction is favored by lower T (lower than combustion T) and high concentrations of steam (i.e. SAGDOX). The heat release is small compared to combustion.

Then our net combustion stoichiometry is determined as follows:

Combustion: $CH_{0.5}+1.075O_2 \rightarrow 0.9CO_2+0.1CO+0.25H_2O+HEAT$

Shift: $0.1CO+0.1H_2O \rightarrow 0.1CO_2+0.1H_2+HEAT$

Net: $CH_{0.5}+1.075O_2 \rightarrow CO_2+0.1H_2+0.15H_2O+HEAT$

Features are as follows:

(1) Heat release=480 BTU/SCF $O_2$ (Butler, 1991)

(2) Non-condensable gas make=102% of oxygen used (v/v)

(3) Combustion water make=14% of oxygen used (v/v) (net)

(4) Hydrogen gas make=9.3% of oxygen used (v/v)

(5) Produced gas composition ((v/v) %):

| | Wet | Dry |
|---|---|---|
| $CO_2$ | 80.0 | 90.9 |
| $H_2$ | 8.0 | 9.1 |
| $H_2O$ | 12.0 | — |
| Total | 100.0 | 100.0 |

(6) combustion temperature is controlled by "coke" content. Typically HTO combustion T is between about 400 and 800° C. (Yang (2009(2))).

4.4 SAGDOX Mechanisms/Productivity

SAGDOX injects both steam and oxygen gas. Each can deliver heat to a bitumen reservoir. Table 1 shows the properties of various steam+oxygen "mixtures". The term "mixture" doesn't imply that we inject a mixture or that we have expectations of good mixing in the reservoir. It is only a convenient way to label the net properties of separately injected steam and oxygen gases. We use the terminology SAGDOX (z), where z is the percentage concentration (v/v) of oxygen gas in the steam+oxygen "mixture".

Figure 4:
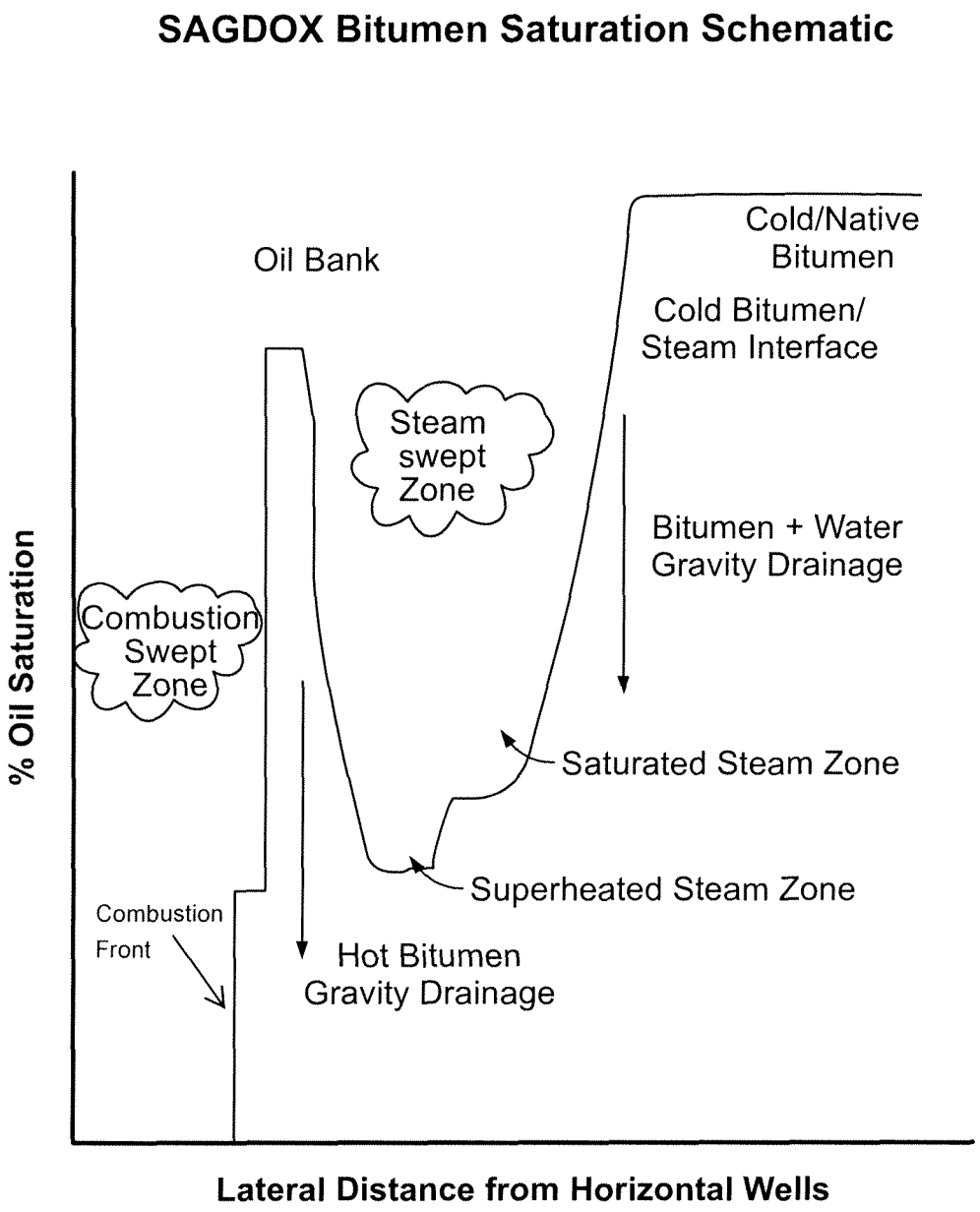
FIG. 4 is a SAGDOX Bitumen Saturation Schematic.

The mechanisms of SAGDOX are important factors to assess expected productivity of the process. FIG. 4 shows a plot of bitumen saturation, perpendicular to the horizontal well plane, about half-way in the net pay zone, for a mature SAGDOX process, based on a simulation (Yang, (2009(1)). The plot shows the extra process mechanisms of SAGDOX compared to SAGD. In addition to a steam-swept zone (steam chamber) SAGDOX has a combustion-swept zone with zero residual bitumen and no connate water, a combustion front, a bank of bitumen heated by combustion gases, a superheated steam zone, a saturated-steam zone, and a gas/steam bitumen interface (chamber wall) where steam condenses and releases latent heat. Bitumen drains, by gravity, from the hot bitumen bank and from the bitumen interface. Water drains, by gravity, from the saturated steam zone and from the bitumen interface. Energy (heat) in the hot bitumen and in the superheated-steam zone is partially used to reflux some steam.

In one dimension, (FIG. 4) the hot bitumen bank appears as a spike; in two dimensions, for a homogeneous reservoir, it appears as a circle (halo), and; in three dimensions, it appears as a sphere. The fuel for combustion and the source of bitumen in the hot bitumen zone is residual bitumen in the steam-swept zone. The combustion is contained inside of the steam chamber.

Water/steam is an important factor for heat transfer. Compared to hot non-condensable gases, steam has two important advantages to transfer heat—it contains much more energy because of latent heat and when it condenses it creates a transient-low pressure area to help draw in more steam.

Taking these mechanisms into account, the following issues can potentially decrease productivity for SAGDOX compared to SAGD:

(1) We inject less steam directly compared to SAGD steam injection (2) Particularly, in the saturated-steam zone of SAGDOX, steam is diluted by combustion gases and the steam partial-pressure is reduced, reducing temperatures compared to SAGD. Lower temperatures at the bitumen interface, increase the heated bitumen viscosity and reduce drainage rates.

(3) Non-condensable gases can block steam access to the cold bitumen interface (4) Some heat (steam) will be removed from the process in the produced-gas removal wells (FIG. 3)

(5) The flow patterns (e.g. convection) can be disrupted by non-condensable gases and harm conformance.

On the other hand, for the same energy injection, SAGDOX productivity, compared to SAGD, can be improved by the following:

(1) Extra steam, in addition to injected steam, is produced by vaporizing connate water and as a product of combustion.

(2) Since combustion temperature (380-800° C.) is greater than saturated-steam temperature (200-250° C.), on average some steam/water will be refluxed. (Table 6 shows how much reflux is needed to maintain steam inventories similar to SAGD).

(3) Hot combustion gases can transfer heat to bitumen, in addition to steam mechanisms.

(4) A hot bitumen bank is created near the combustion front (FIG. 4), sourcing residual bitumen left behind by the steam-swept zone. This bitumen can drain to the production well, add to productivity and it can contribute to steam reflux.

(5) Separate control of oxygen injection and combustion gas removal can improve conformance (or minimize the damage of poorer conformance).

(6) Carbon dioxide, produced as a combustion product, can dissolve into bitumen and reduce viscosity.

(7) Top-down gas drive and solution gas drive mechanisms can add to productivity.

(8) Non condensable gas accumulates at/near the ceiling zone of the gas chamber. This can insulate the ceiling and reduce heat losses.

The result of combining all these mechanisms is difficult to anticipate. If steam heat transfer is a dominant mechanism, we would expect SAGD to have a higher productivity per unit of energy injected than SAGDOX.

To reflect this view, Table 2 presents a scenario whereby for the same bitumen productivity, the energy to oil ratio (ETOR) for SAGDOX increases as the oxygen content increases (or as the steam content decreases)—from 1.18 MMBTU/bbl for SAGD to 1.623 MMBTU/bbl for SAGDOX (75). This scenario is used for various comparisons (Tables) herein.

4.5 SAGDOX Well Geometry

FIG. 3 shows a simple well configuration that is suitable for SAGDOX. The SAGD well pair (well 1 and 2) is conventional, with parallel horizontal wells with lengths of 400-1000 m. and separation of 4-6 m. The lower horizontal well is 2-8 m. above the bottom of the bitumen reservoir. The upper well is a steam injector and the lower horizontal well is a bitumen+ water producer. Bitumen and condensed steam drain to the lower well, by gravity, from a steam chamber formed above the steam injector (1). The oxygen injector (5) is a vertical well that is not at the end of the pattern, but it is about 5 to 20 m, in from the end. The perforated zone is less than 50 m long.

Two produced gas removal wells (3 and 4) are on the pattern lateral boundaries toward the heel area of the horizontal well pair. The wells are completed near the top of the reservoir (1 to 10 m. below the ceiling).

This configuration enables separate control of oxygen and steam injection, separation of oxygen/steam and mixing in the reservoir, oxygen containment in the pattern.

Figure 5:
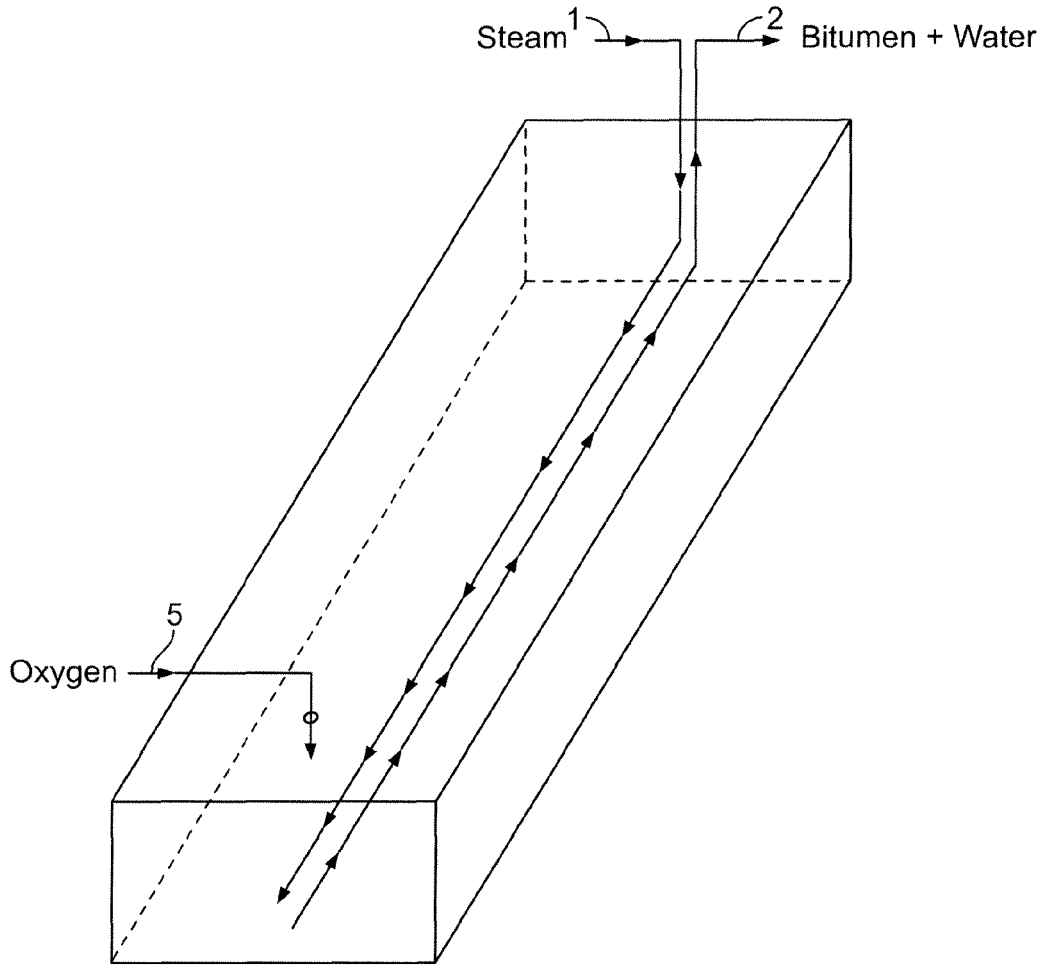
FIG. 5 is a SAGDOX Geometry 2.

If oxygen injection is low and/or the reservoir is "leaky" and can contain or disperse some non-condensable gas without pressure build-up, we may not need any produced gas removal wells. FIG. 5 shows such a scheme.

Figure 6:
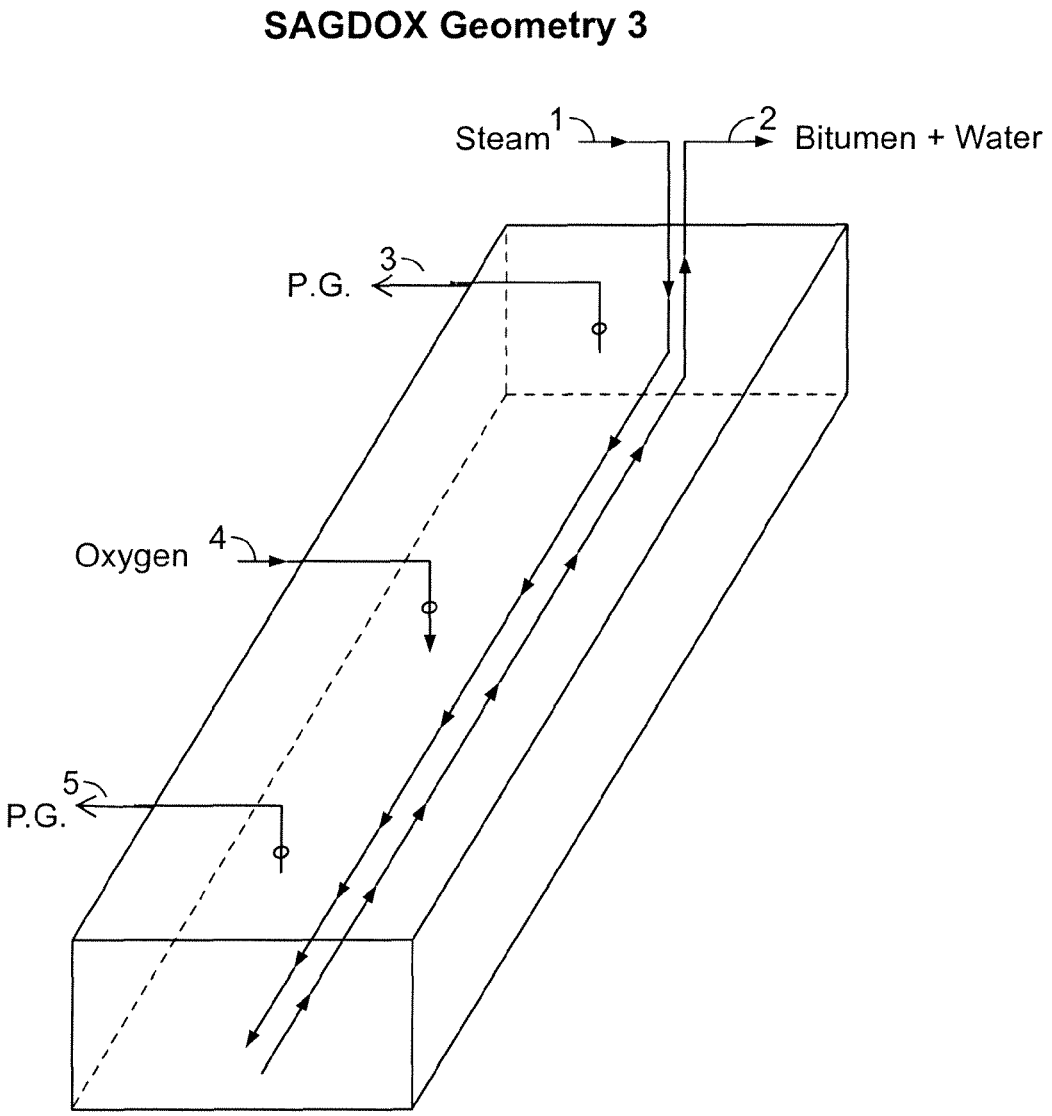
FIG. 6 is a SAGDOX Geometry 3.
Figure 7:
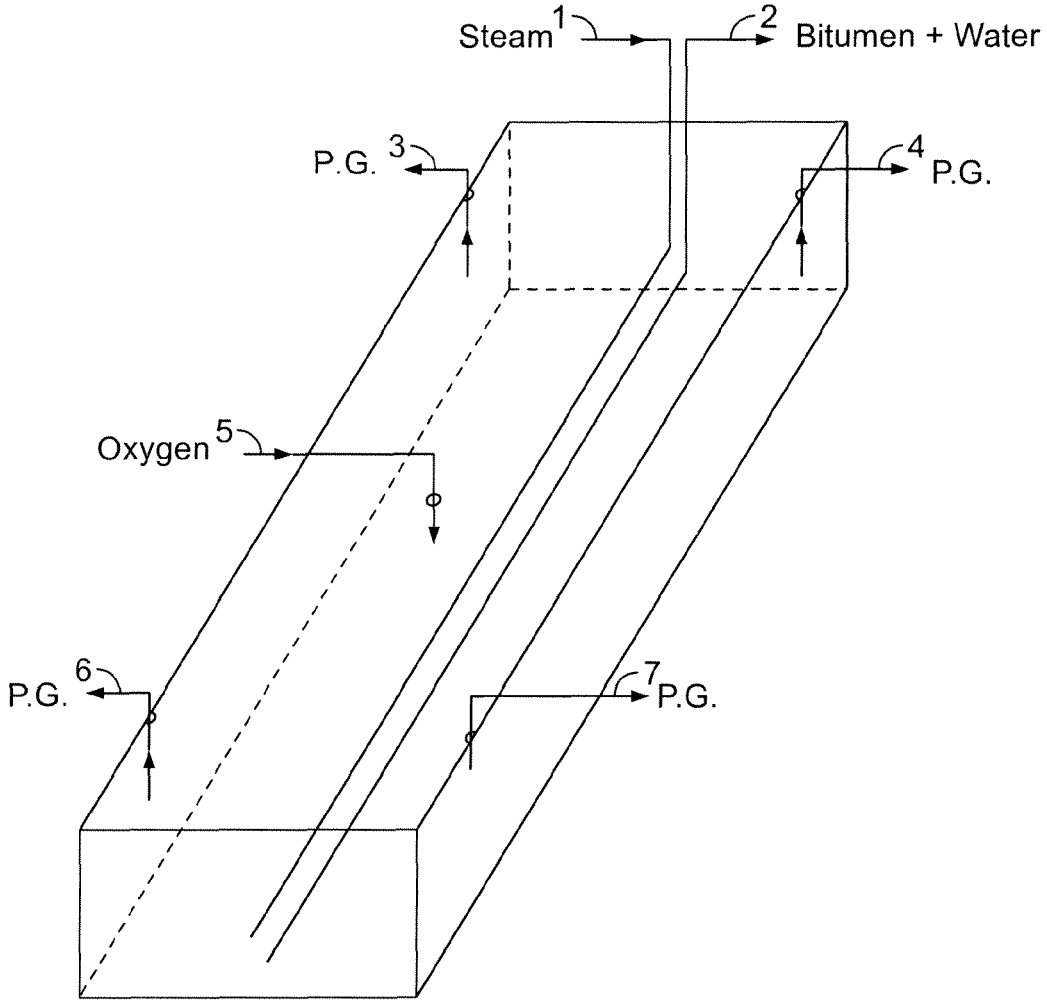
FIG. 7 is a SAGDOX Geometry 4.

If start-up is protracted or if we are concerned about retaining oxygen in the well pattern volume, we can inject oxygen near the center of the pattern as shown by well 4 in FIG. 6. We also don't necessarily need to remove produced gas at the pattern boundaries. FIG. 6 shows produced gas removal wells moved toward the center of the pattern. As an alternate, we can move the gas removal wells to the pattern boundary and share the wells with neighbor patterns (FIG. 7).

Figure 8:
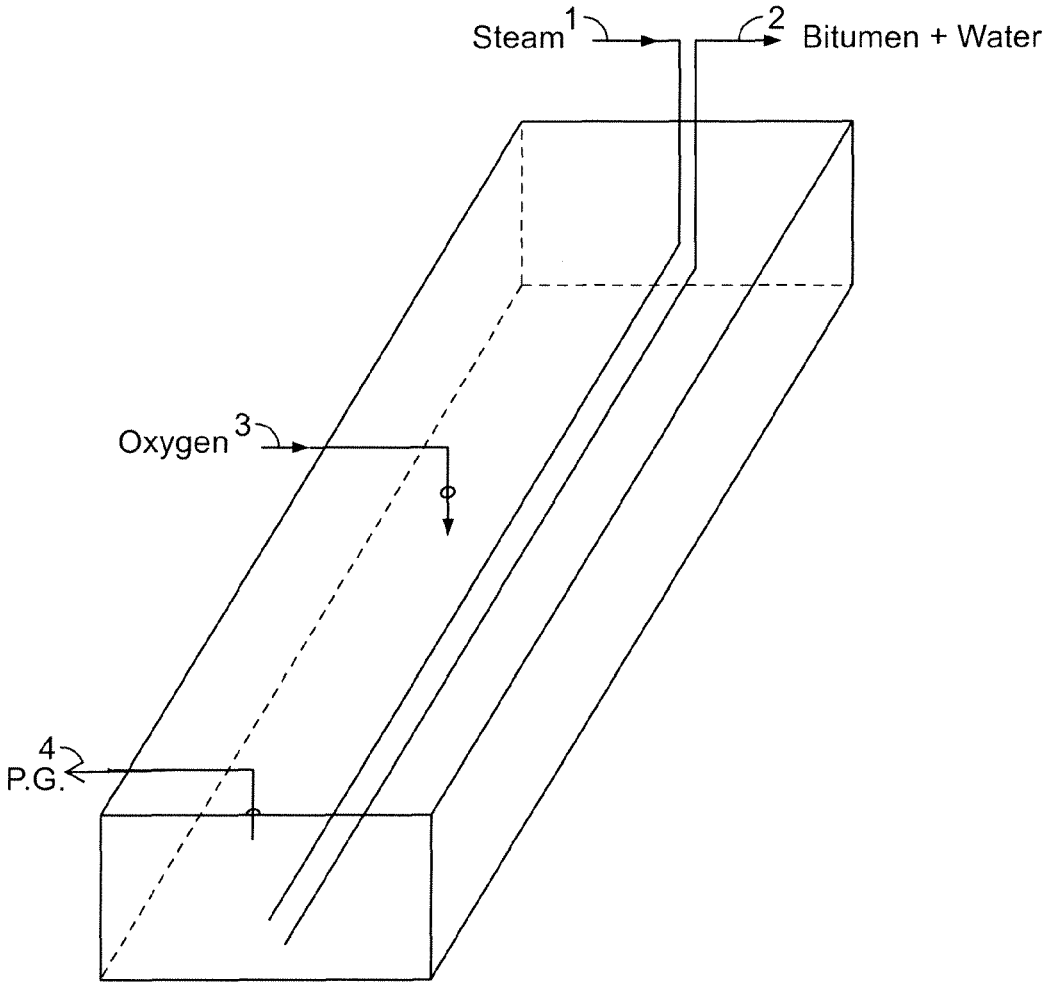
FIG. 8 is a SAGDOX Geometry 5.

We can also move the gas removal well to the pattern boundary at the end for sharing (FIG. 8) with neighboring patterns.

Figure 9:
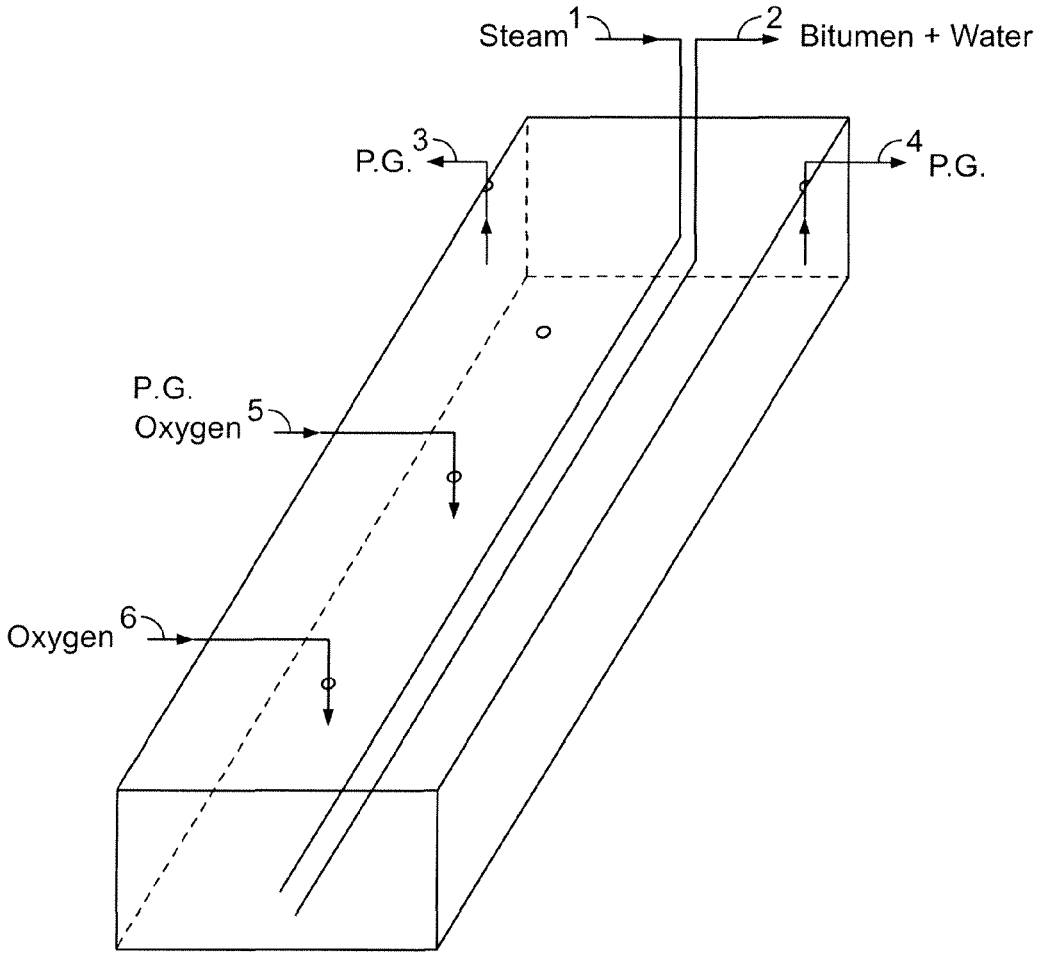
FIG. 9 is a SAGDOX Geometry 6.

We can also have dual purpose wells. FIG. 9 shows an oxygen injector (6) near the end (toe) of the pattern and a central well (5) that initially can operate as a produced gas removal well and after the process is established it can be converted to a second oxygen injector for better oxygen conformance control.

Figure 10:
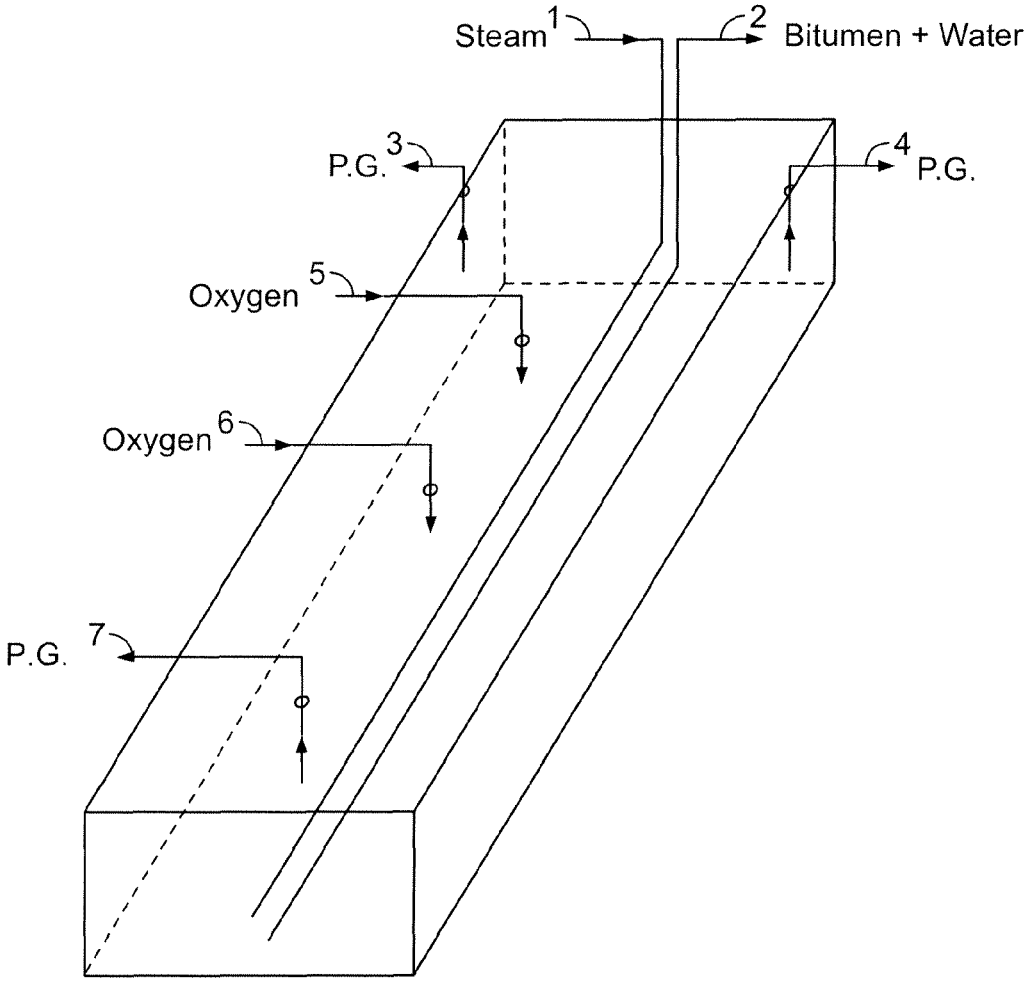
FIG. 10 is a SAGDOX Geometry 7.

Better $O_2$ conformance can also be achieved with dual $O_2$ injectors as shown in FIG. 10.

Figure 11:
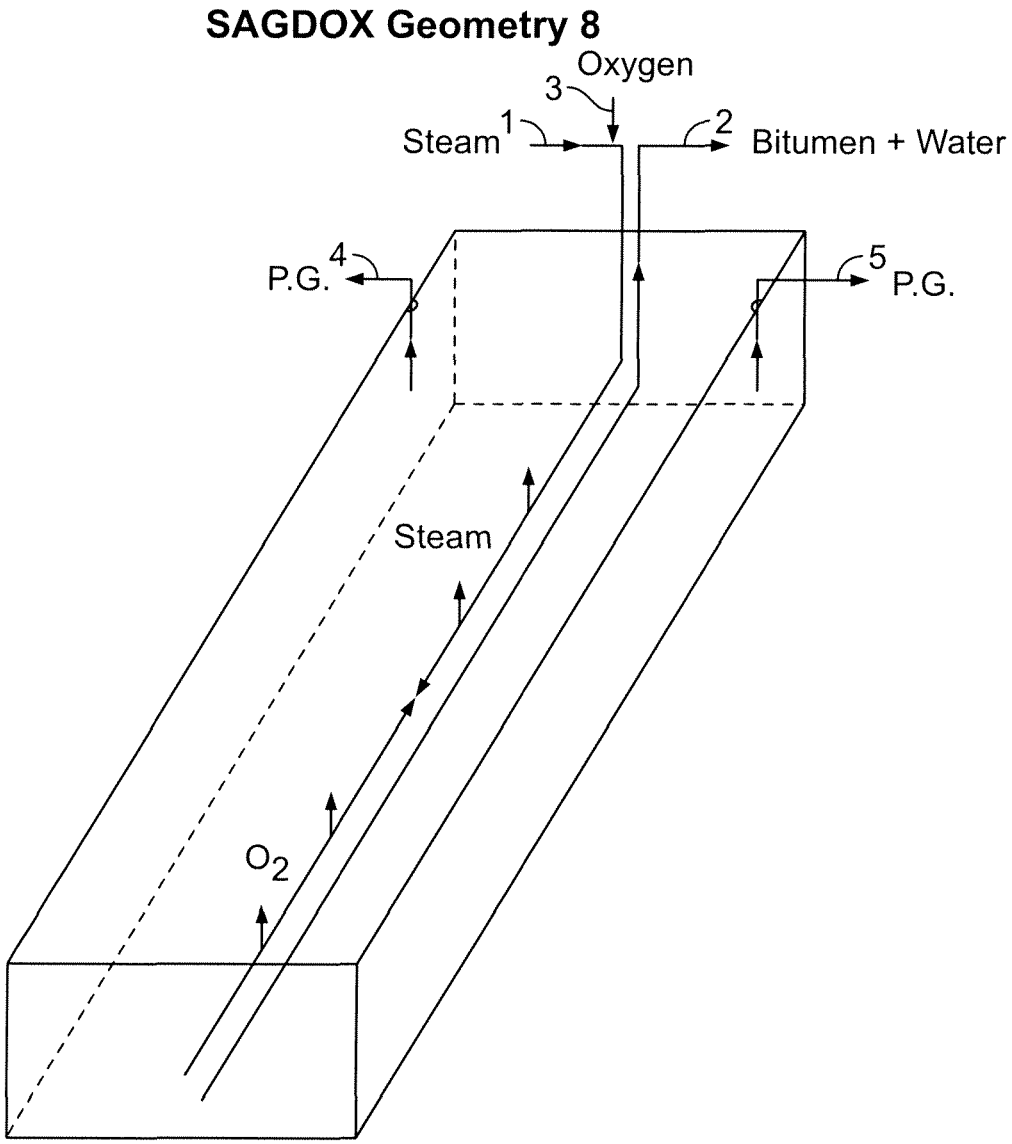
FIG. 11 is a SAGDOX Geometry 8.

We need not drill new vertical wells for oxygen injection and/or produced gas removal. FIG. 11 shows a packer in the steam injector (well 1) to segregate the well toe for oxygen injection in a separate oxygen string. The toe of the horizontal injector well can be sacrificed to corrosion, if the packer is not a good seal, with little consequence.

Figure 12:
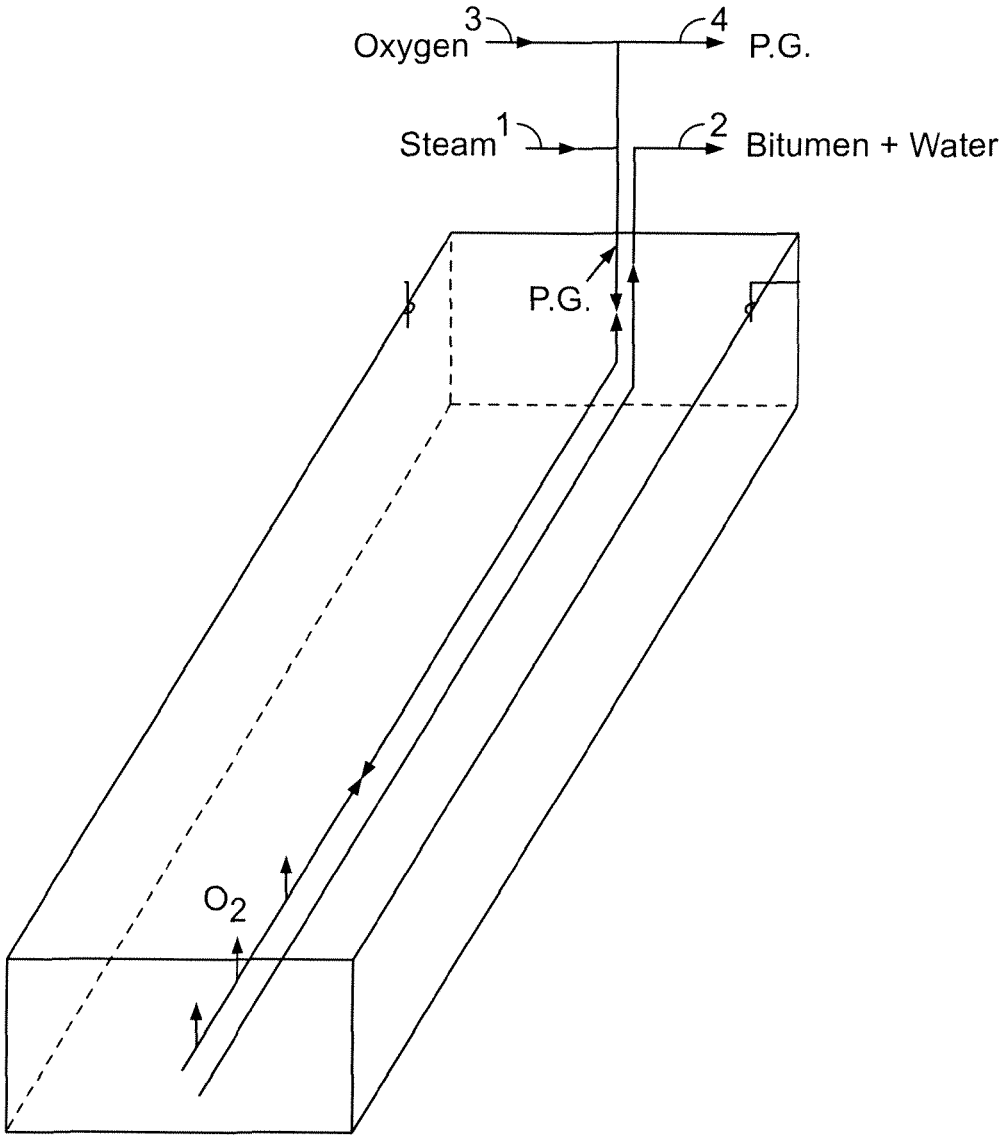
FIG. 12 is a SAGDOX Geometry 9.

FIG. 12 shows another packer segregating part of the vertical rise section of the steam injector (well 1) for produced gas removal. This version of the SAGDOX has no new SAGDOX wells. Oxygen injection and produced gas removal are small volume applications and need not occupy a lot of the steam injector capacity, especially for lower oxygen concentrations in the steam+oxygen mix.

Obviously, other geometries are possible using combination of well configurations shown in FIGS. 1, 3, 5, 6, 7, 8, 9, 10, 11, 12.

4.6 Energy Efficiency

Let's define EOR energy efficiency as:

$$E=[(B-S)/BJ]\times 100$$

Where E=(%) energy efficiency; B=fuel value of bitumen (6 MMBTU/bbl); and S=energy used on the surface to produce bitumen (MMBTU/bbl)

For SAGD; B=6 and for 85% boiler efficiency and 10% steam distribution losses (75% net efficiency)

$$E(\text{SAGD})=[(6-\text{ETOR}/0.75)/6]\times 100$$

For our SAGD simulation (4.1) our average ETOR=1.18 MMBTU/bbl bit, so our avg SAGD efficiency=73.8%

For SAGDOX, the efficiency calculation is more complex. The steam component (ETOR(steam)) will be similar to SAGD. If we assume our ASU plant uses 390 kWh/tonne $O_2$ (99.5% purity) and that electricity is produced from a gas-fired combined-cycle power plant at 55% efficiency, then for every MMBTU of gas consumed in the power plant, the oxygen produced (at 480 BTU/SCF) releases 5.191 MMBTU of combustion energy to the reservoir. SAGDOX efficiency is as follows:

$$E(\text{SAGDOX})=([6-(\text{ETOR(steam)}/0.75)-(\text{ETOR}(O_2)/5.191)]/6)\times 100$$

Table 3 shows the efficiencies for various SAGDOX processes using the energy consumptions of Table 2. The following points are noteworthy:

(1) SAGDOX is more efficient than SAGD for all cases.

(2) The efficiency improvement increases with increasing oxygen content in SAGDOX mixtures.

(3) The SAGD energy loss is 26%. The equivalent loss for SAGDOX is from 6 to 16%, depending on oxygen content. This is an improvement of 10 to 20% or a factor of 1.6 to 4.3.

(4) If we reduce oxygen purity to the 95-97% range (see 5.2), energy needed to produce oxygen from an ASU drops by about 25% and SAGDOX efficiencies improve significantly (see Table 3).

4.7 $CO_2$ Emissions

For SAGD and SAGDOX we can expect $CO_2$ emissions from the following sources:

(1) Boiler Flue Gas—Using methane fuel in air we can expect $CO_2$ concentrations in flue gas up to 12% (v/v), for a stoichiometric burn.

(2) Produced Gas—with oxygen combustion we expect produced gas to be mostly $CO_2$, or with a small amount of hydrogen gas.

(3) Incineration—Produced gas may (probably) contain some sour gas components (eg. $H_2S$). At least, this gas should be incinerated prior to venting. Assuming we use a gas-fired incinerator, we need about 10% of the dry gas volumes as incinerator fuel. This will add to produced gas volumes and add to $CO_2$ emissions. If we capture produced gas for sequestration or retained in the reservoir, our $CO_2$ emissions are reduced twice—directly by capture and indirectly by incinerator gas savings.

(4) Electricity Use—We use electricity to separate oxygen from air. As an indirect $CO_2$ source we can consider $CO_2$ associated with electricity generation. We will assume as gas-fired power plant, using a combined-cycle with an overall 55% efficiency to calculate indirect $CO_2$ emissions.

For SAGD we will assume gas-fired boilers at 85% efficiency and a further 10% steam loss in distribution. Then for each MMBTU steam delivered to the reservoir we need 1.333 MMBTU of boiler gas fuel or 1333 SCF/MMBTU of $CO_2$ emissions or 0.070 tonnes $CO_2$/MMBTU.

Using our previous SAGDOX chemistry (4.3) our $CO_2$ make is 0.9302 SCF/SCF $O_2$ or 1937.9 SCF/MMBTU in the reservoir due to combustion or 0.1018 tonnes $CO_2$/MMBTU.

If we also incinerate our produced gases our incremental $CO_2$ emissions are another 213 SCF/MMBTU ($O_2$).

Our total direct $CO_2$ emissions are 2151 SCF/MMBTU ($O_2$) or 0.1130 tonnes/MMBTU ($O_2$). We also have indirect $CO_2$ from electricity used to make $O_2$. If we assume 95-97% $O_2$ purity our electricity use is 292.5 kWh/tonne $O_2$. If we assume a 55% efficient combined cycle plant our $CO_2$ emissions are 145 SCF $CO_2$/MMBTU ($O_2$) or 0.0076 tonnes $CO_2$/MMBTU ($O_2$).

Table 4 shows expected $CO_2$ emissions for SAGD and various versions of SAGDOX. Table 5 show expected $CO_2$ emissions if the pure $CO_2$ streams are captured or sequestered on-site. The following comments are noteworthy:

(1) If we use a worst case assumption—all combustion gas is produced and incinerated and we count indirect $CO_2$ from electricity use—then the least $CO_2$ emissions are from SAGD and SAGDOX emissions vary from 142 to 234% of SAGD
(2) If we don't include indirect $CO_2$, SAGD is still the lowest and SAGDOX varies from 136 to 219% of SAGD
(3) If we capture and sequester the "pure" $CO_2$ vent gas from SAGDOX and back out associated incineration $CO_2$ increments, then SAGDOX is the lowest $CO_2$ emitter, from 19 to 58% of SAGD emissions.
(4) The lowest emitter, with capture, is SAGDOX (75) with 19% of SAGD $CO_2$ emissions.

4.8 SAGDOX Water Use/Production

SAGDOX uses water directly as steam injected, but it also produces water directly from 2 sources—water produced as a combustion product and connate water vaporized in the combustion-swept zone. Our net combustion chemistry (4.3) was:

$$CH_{0.5}+1.075O_2 \rightarrow 1.0CO_2+0.15H_2O+HEAT$$

Where $CH_{0.5}$ is the reduced formula for coke and hydrogen produced was from shift reactions downstream of the combustion zone (favored by excess steam). The combustion water make is 0.140 SCF/SCF $O_2$ or 0.0351 bbl/MMBTU ($O_2$).

If we have a reservoir with 80% initial bitumen saturation, connate water occupies 20% of the pore space. In the steam swept zone with 15 to 20% residual bitumen, per barrel of bitumen produced our connate water is 0.308 to 0.333 bbl/bbl bit. Assuming all the connate water is mobilized by combustion, we will produce 0.31 to 0.33 bbl water/bbl bitumen. Table 6 shows SAGDOX water make, assuming 20% residual bitumen in the steam swept zone and all injected steam is produced as water.

As a percent of steam injected, SAGDOX produces 20 to 260% excess water (excess to steam injected). No make-up water should be needed for SAGDOX steam generators.

4.9 Energy Injectivity

Figure 13:
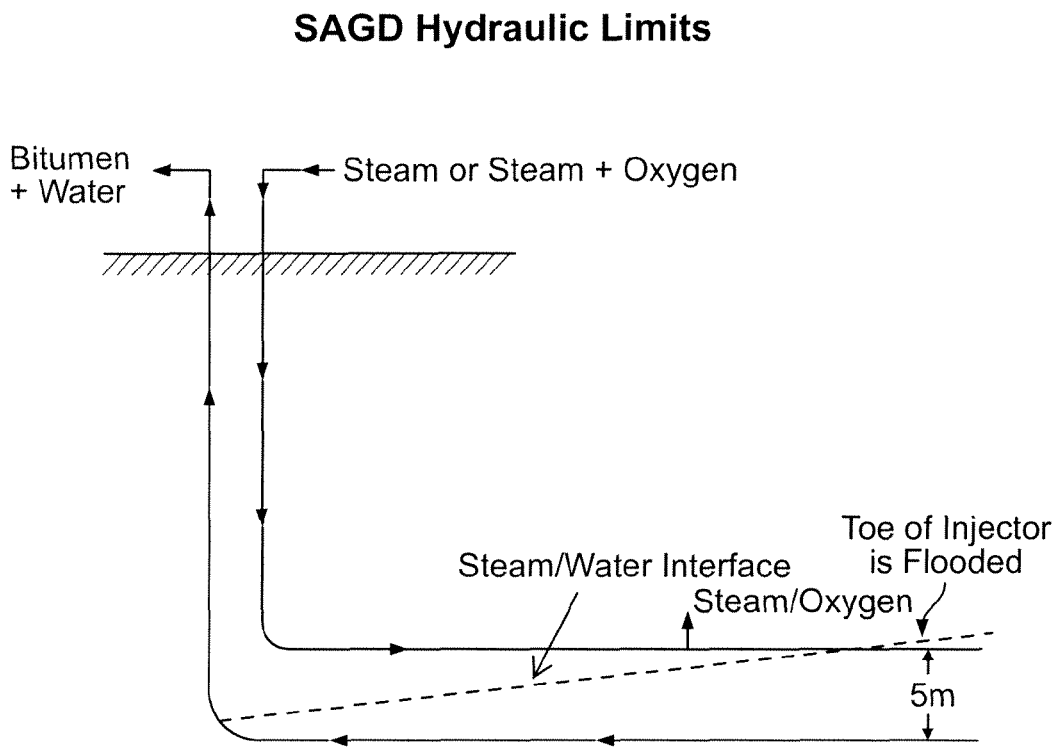
FIG. 13 is a SAGD Hydraulic Limits.
Figure 14:
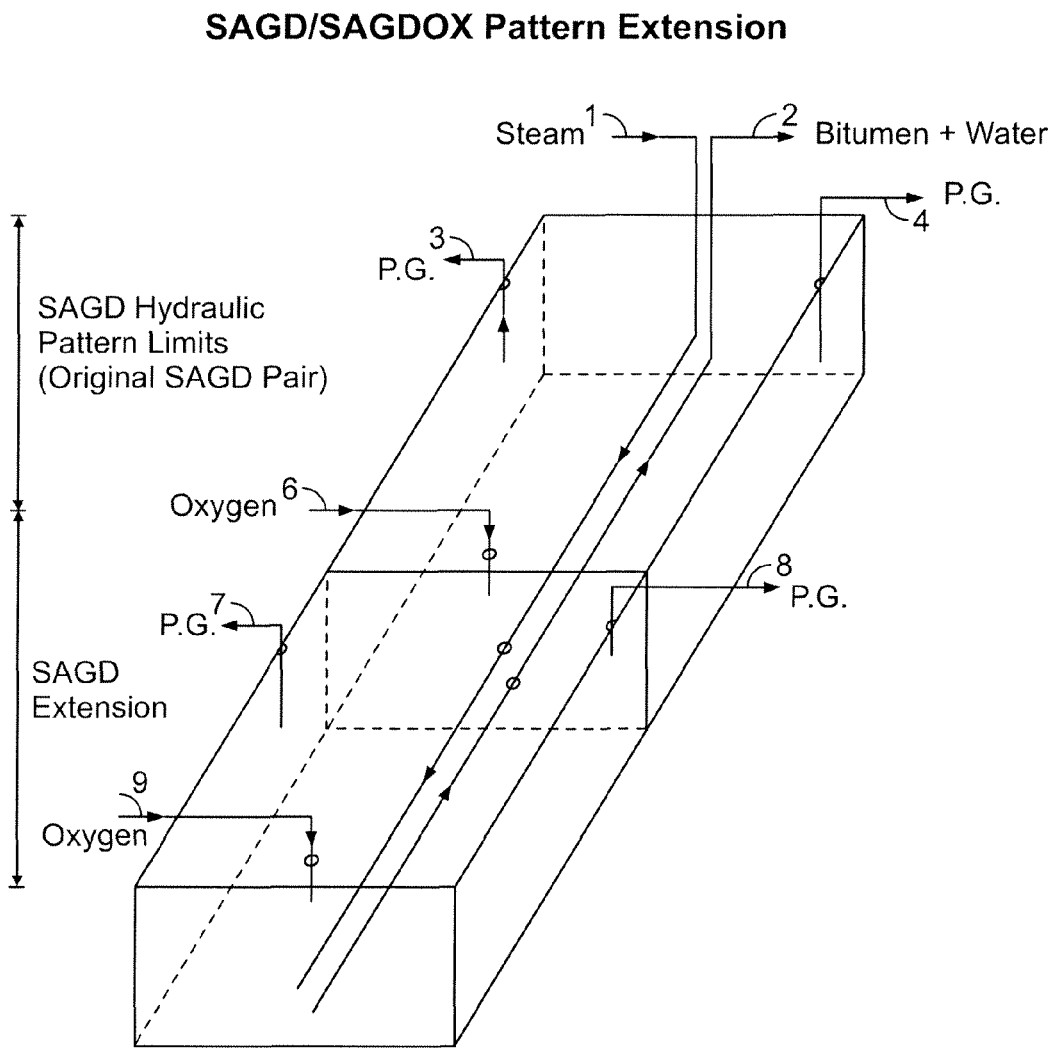
FIG. 14 is a SAGD/SAGDOX Pattern Extension.

SAGD steam (energy) injection is usually controlled by a target pressure for a reservoir (i.e. we can increase steam injection rates until we hit a target pressure). This may work well if the reservoir has no "leaks" and we can increase pressures beyond the original native reservoir pressures. But, if we have a "leaky" reservoir or even if we have a contained chamber, our injection rates may be limited by hydraulic effects in our production well. The bitumen and water flow in the horizontal production well cannot create pressure drops that cause the steam/water interface to tilt and flood the toe of the steam injector or to allow gas/steam to enter near the heel of the production well (FIG. 13). This can create a fundamental limit on energy injectivity (steam) for SAGD. Depending on actual well geometry and reservoir characteristics, this limit may supersede our pressure target limit.

SAGDOX can have the same behavior. The process still produces a bitumen and water mix in the lower horizontal well. But, the limits on energy injection are changed because a significant part of the energy injected is due to oxygen, which produces little water compared to steam. Also, if we have separate wells to remove produced gases (e.g. FIG. 3), we can control pressure by produced gas removal rates. So, if our energy injectivity is limited by fluid flows in the production well, Table 10 shows potential bitumen productivity increases, assuming fluid flow rate in the production well is constant. Extra bitumen productivity potential varies from 21 to 148% for our preferred oxygen concentration range (5 to 50% (v/v)). Our preferred case (SAGDOX (35)) can more than double bitumen production.

4.10 Pattern Extensions

As previously discussed steam (energy) injectivity for SAGD can be limited by one of two factors—the pressure in the reservoir or the hydraulic limits of the production well. If the pressure drop in the production well is the limiting factor, and if we convert SAGD to SAGDOX we can increase energy injectivity because per unit energy injected SAGDOX produces less water and less fluid in the production well than does SAGD.

If reservoir pressure is the limiting factor we cannot increase energy injectivity per unit length of our horizontal producer, but we can certainly increase the length of the producer without hitting the hydraulic limits and we can also thus increase bitumen production and increase reserves (by increasing the pattern size).

The above is a balancing act. SAGD operators have settled on a 5 m well spacing which for normal pipe sizes sets a hydraulic limit on well length at about 1000 m for bitumen production rates of about 1000 bbls/day. A conversion to SAGDOX would lower water production and allow possible well extensions (or longer initial well lengths) for the same hydraulic limits. Table 7 shows the estimated produced volumes of bitumen and water for our SAGDOX cases. The following points are noteworthy:

(1) As the oxygen injection increases for the same bitumen production, produced fluid volumes drop from 100% for SAGD to 35% for SAGDOX (75).
(2) Our preferred case SAGDOX (35) has 46% of the fluid volumes of SAGD.
(3) The bitumen cut in produced fluids rises from 23% for SAGD to 57% for SAGDOX (75).

So, if we intend to operate SAGDOX and if pressure is our limit on injectivity, we can drill longer horizontal wells and achieve higher productivity and reserves. Table 10 shows the expected production volumes (water+bitumen), per unit bitumen production, for each of our SAGDOX cases compared to SAGD. There are 2 competing factors that will determine pressure drops in production wells:

(1) The production volume decreases as the oxygen content in steam increases, even including connate water production and water produced directly by combustion. Compared to SAGD produced water+bitumen volumes decrease by 18 to 60% as we progress from SAGDOX (5) to SAGDOX (50) mixtures. By itself, this can reduce pressure drops in the production well considerably and enable extended well lengths, if desired. Pressure drop is a strong function of volume throughput (much stronger than a linear relationship).
(2) The oil cut increases in the production well as we progress to higher oxygen contents. For SAGD, the expected oil cut is 23%. For SAGDOX, the oil cut increases from 28% for SAGDOX (5) to 57% for SAGDOX (50) (Table 10). For water-continuous emulsions (oil-in-water emulsions) this should not have a dramatic effect on pressure drops but it will increase bulk viscosity. Water-continuous emulsions can be stable for up to about 80% oil cut, so we can expect all SAGDOX cases to exhibit low viscosity flows.

Our expectation is that the first effect (1) will dominate and that we expect SAGDOX cases to have much lower pressure drops in the horizontal section of the production well than for SAGD for equal well lengths. Thus, for the same sized pipes, we can extend SAGD patterns significant distances if we convert to SAGDOX.

4.11 Multiple Pattern Options

Figure 15:
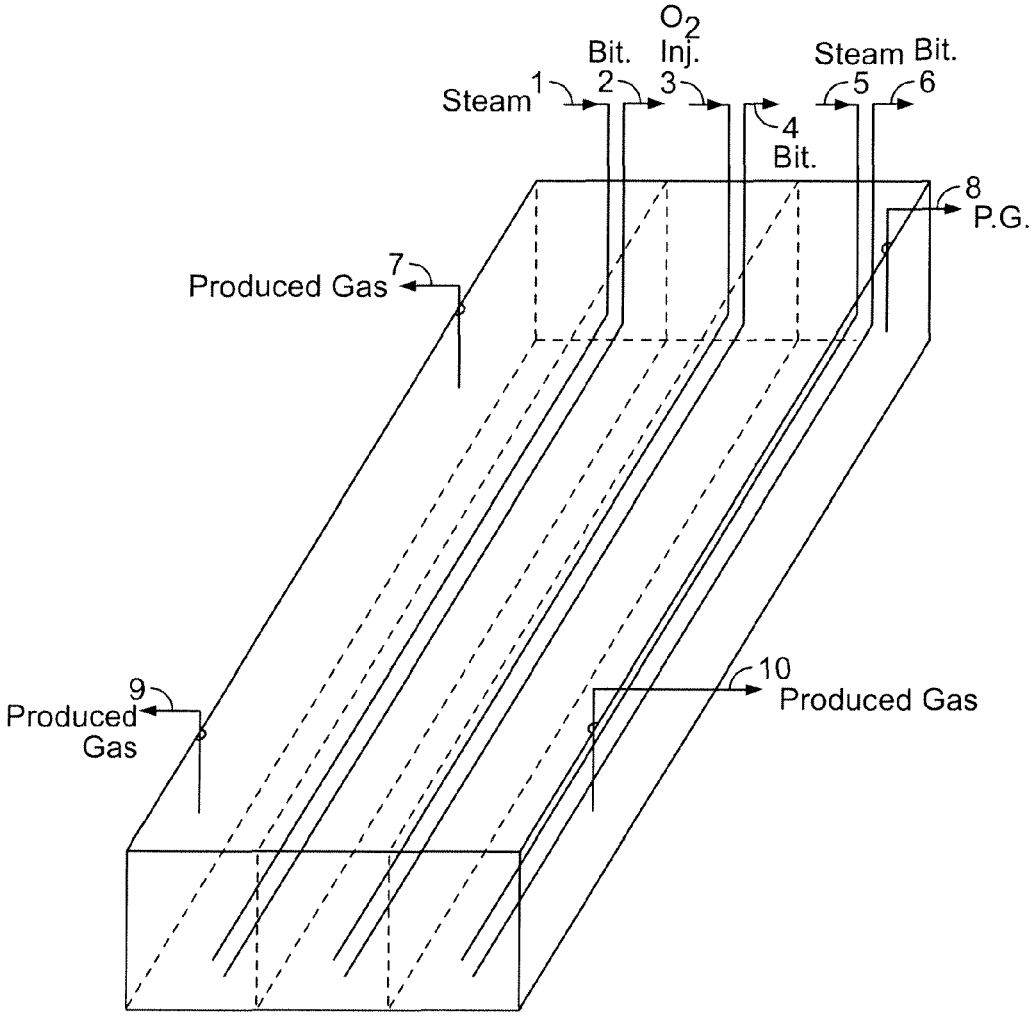
FIG. 15 is a SAGDOX-3 well-pair pattern.

If we apply SAGDOX to a mature SAGD project, neighboring patterns are in communication. We can take advantage of this by using a central steam injector for oxygen injection (FIG. 15) and placing produced gas removal wells on the boundary of neighbor patterns. This reduces SAGDOX incremental wells to less than 1.0 per pattern.

Obviously for mature SAGD pattern that have established communication between pattern, other geometries are possible using the principles demonstrated in FIGS. 3, 5, 6, 7, 8, 9, 10, 11, 12, 14, and 15.

4.12 Distinguishing Features of SAGDOX (1) Applies to bitumen (not heavy oil).
(2) Obviates hydraulic limits of SAGD.
(3) Has a preferred range of $O_2$ concentrations in steam and $O_2$.
(4) Injects steam and oxygen separately.
(5) Has a preferred range of $O_2$ purity (95 to 99.9%).
(6) Separate well(s) to remove non-condensable gases.
(7) A procedure to start-up combustion component.
(8) A procedure to control/operate SAGDOX.
(9) A tapered strategy to inject oxygen.
(10) Specific proposed SAGDOX well geometries.
(11) A preferred way to produce steam and oxygen.
(12) A higher efficiency c/w SAGD.
(13) Reduced $CO_2$ emissions (with some $CO_2$ capture) c/w SAGD.
(14) Reduced water use c/w SAGD.
(15) Separate (or segregated) oxygen injector, with limited reservoir exposure (high flux rates).
(16) Can be added on to existing SAGD.
(17) Recognition of steam/oxygen synergies.
(18) Compared to SAGD, for the same energy injected, SAGDOX produces less fluid; this can allow higher energy injectivity rates or a lengthened pattern. The former will accelerate bitumen production; the latter will accelerate production and increase reserves.

5. Preferred Embodiments 5.1 Bitumen

The difference between bitumen and heavy oil is an important distinction for this invention. Bitumen is essentially immobile in a reservoir. Most bitumen reservoirs have no initial gas injectivity, so it is difficult (impossible) to initiate an EOR process with a combustion component without presteaming to heat and remove bitumen to create some gas injectivity. SAGD can accomplish this objective.

Although, in principle, SAGDOX can work on a heavy oil reservoir (where there is some initial gas injectivity) the preference is a bitumen reservoir, where SAGDOX is initiated using SAGD methods.

For the purposes of this document we will define "bitumen" as <10 API gravity and <1 million c.p. in situ viscosity. Heavy oil is then defined as between 10 and 20 API and 1 million c.p.

5.2 Separate Oxygen Injection

It has been suggested that EOR using a conventional SAGD geometry could be conducted by substituting an oxygen and steam mixture for steam (Yang (2009); Pfefferle (2008)). This is not a good idea for two reasons:

(1) Oxygen is different in its effectiveness compared to steam. Steam has a positive effect (adding heat) no matter how low the flux rate is or no matter how low the concentration. For oxygen to initiate and sustain the desired HTO combustion there is a minimum flux rate (FIG. 25). This minimum rate is expected to depend on the properties of reservoir fluids, the properties of the reservoir, and the condition of the reservoir. If oxygen flux is too low either oxygen will break through, unused, to the produced gas removal well or the production well or remain in the reservoir, or the oxygen will initiate undesirable LTO reactions. If oxygen is mixed with steam and injected into a long horizontal well (500 to 1000 m) the oxygen flux is dispersed/diluted over a long distance. Even if the average oxygen flux is suitable to initiate and sustain HTO combustion, heterogeneities in the reservoir can cause local flux rates to be below the minimum needed.
(2) Oxygen and steam mixtures are very corrosive particularly to carbon steel. The metallurgy of a conventional SAGD steam injector well could not withstand a switch to steam and oxygen mixtures without significant corrosion that could (quickly) compromise the well integrity. Corrosion has been cited as one of the issues for ISC projects that used enriched air or oxygen (Sarathi (1999)).

The SAGDOX preferred embodiment solution to these issues is to inject oxygen and steam in separate wells to minimize corrosion. Secondly the injector well (either a separate vertical well or the segregated portion of a horizontal well) should have a maximum perforated zone (or zone with slotted liners) of about 50 m so that oxygen flux rates can be maximized. Please refer to FIGS. 3A, 3B, 3C, and 3D in this regard.

5.3 Oxygen Concentration Ranges

Oxygen concentration in steam/oxygen injectant mix is a convenient way to quantify oxygen levels and to label SAGDOX processes (e.g. SAGDOX (35) is a process that has 35% oxygen in the mix). But, in reality we expect to inject oxygen and steam as separate gas streams without any real expectations of mixing in the reservoir or in average or actual in situ gas concentration. Rather than controlling "concentrations", in practice we would control to flow ratios of oxygen/steam (or the inverse). So SAGDOX (35) would be a SAGDOX process where the flow ratio of oxygen/steam was 0.5385 (v/v).

Our preferred range for SAGDOX has minimum and maximum oxygen/steam ratios, with the following rationale:

(1) Our minimum oxygen/steam ratio is 0.05 (v/v) (oxygen concentration of about 5%). Below this we start getting increasing problems as follows:
  i. HTO combustion starts to become unstable. It becomes more difficult to attain minimum oxygen flux rates to sustain HTO, particularly for a mature SAGDOX process where the combustion front is far away from the injector.
  ii. It also becomes difficult to vaporize and mobilize all connate water.
(2) Our maximum oxygen/steam ratio is 1.00 (v/v) (oxygen concentration of 50.0%). Above this limit we start getting the following problems:
  iii. The reflux rates in the reservoir to sustain steam inventories exceed 70% of the total steam (Table 2). This may be difficult to attain in practice.
  iv. The net bitumen ("coke") fuel that is consumed by oxidation starts to exceed the residual fuel left behind in the SAGD steam-swept zone. So compared to SAGD, SAGDOX (50+) may have lower recoveries and reserves.
  v. Above this limit it becomes difficult (impossible) to produce steam and oxygen from an integrated ASU: Cogen plant.

So the preferred range for oxygen/steam ratios is 0.05 to 1.00 (v/v) corresponding to a concentration range of 5 to 50% (v/v) of oxygen in the mix. A separate economic study shows the preferred range of oxygen/steam ratios to be about 0.4 to 0.7 (v/v) or an average concentration of about 35% (v/v) oxygen in the mix. SAGDOX (35) is our preferred case.

5.4 Tapered Oxygen Strategy

Oxygen is more cost-effective than steam as a way to inject energy (heat) into a bitumen reservoir. Per unit heat delivered, all-in oxygen costs (including capital charges) are about one third the equivalent steam costs. So, at least ultimately, there is an economic incentive to maximize the oxygen concentration in our SAGDOX gas mixture. Also, as a SAGDOX process matures, the combustion front will move further away from the oxygen injector. In 3-D, the front will appear as an expanding sphere. To sustain oxygen flux rates at the sphere surface we may require increasing oxygen rates to sustain HTO reactions.

But, near the beginning, for safety reasons we may wish to minimize oxygen rates. Also, in the early SAGDOX operations, oxygen injection can produce back pressure (injectivity) constraints with a build-up of non-condensable combustion gases.

So, for at least a few reasons, there is a logical basis to conduct a SAGDOX process by starting at low oxygen concentrations (>5(v/v) %) and ramping up concentrations as the project matures (<50(v/v) %).

For operations that are expected to continue indefinitely (>a week) our oxygen levels should be within the specified (preferred) ranges. But, in the wind-down phase of operations (close to the economic limits), we can take advantage of the existing steam inventory in the reservoir, by shutting in steam injection and continuing oxygen injection until we reach the more-favorable economic limit when oxygen costs=bitumen revenues, per barrel of bitumen produced.

5.5 Oxygen Purity

A cryogenic air separation unit (ASU) can produce oxygen gas with a purity variation from about 95 to 99.9 (v/v) % oxygen concentration. The higher end (99.0-99.9%) purity produces chemical grade oxygen. The lower end of the range (95-97%) purity consumes about 25% less energy (electricity) per unit oxygen produced (Praxair, (2010)). The "contaminant" gas is primarily argon. Argon and oxygen have boiling points that are close, so cryogenic separation becomes difficult and costly. If argon and nitrogen in air remain unseparated, the resulting mixture is 95.7% "pure" oxygen (see Table 8).

For EOR purposes, argon is an inert gas that should have no impact on the process.

The range of oxygen purity is 95 to 99.5% (v/v) purity.

The preferred oxygen concentration is 95-97% purity (i.e. the least energy consumed in ASU operations).

5.6 Production

Figure 16:
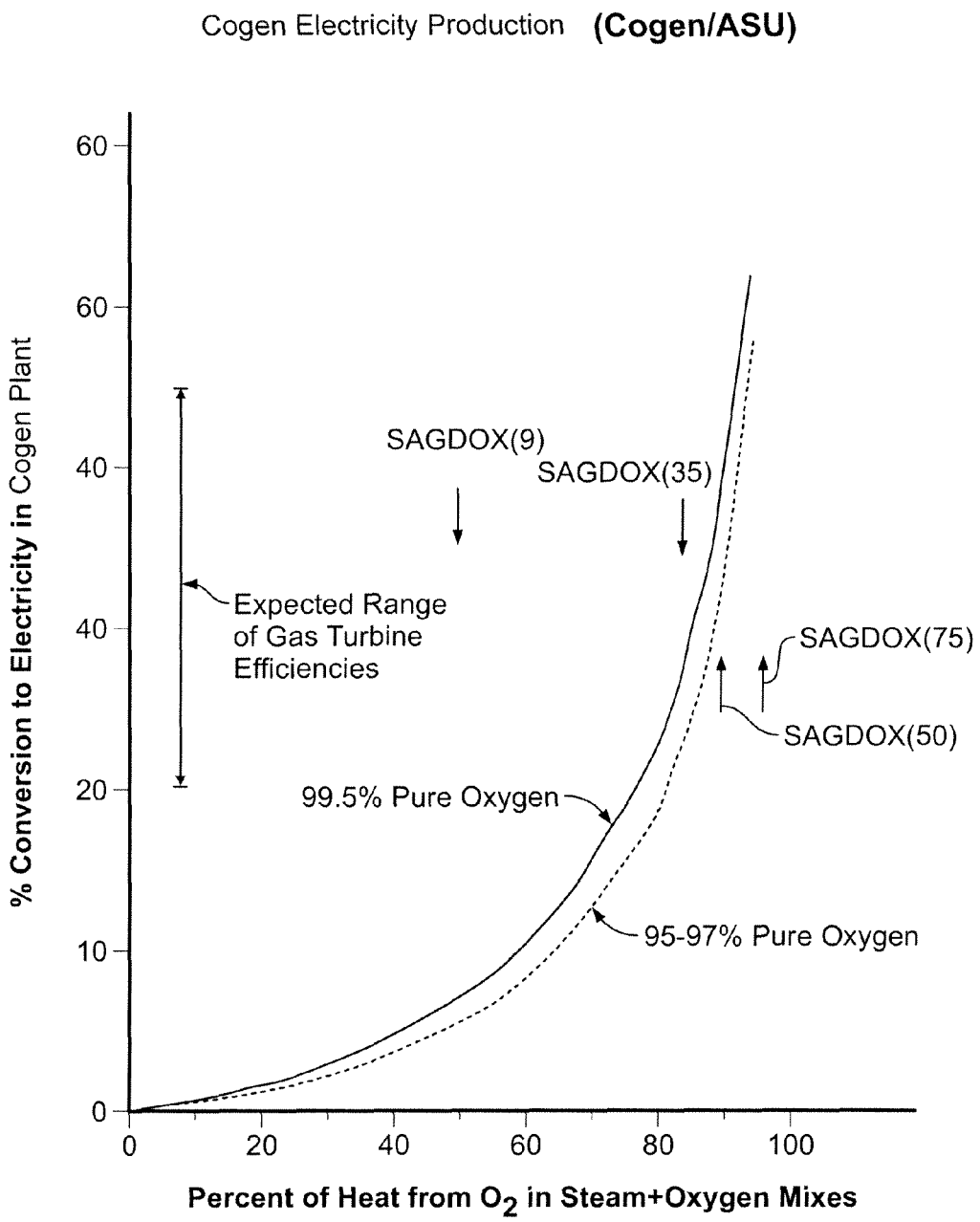
FIG. 16 is a Cogen Electricity Production (Cogen/ASU).
Figure 16A:
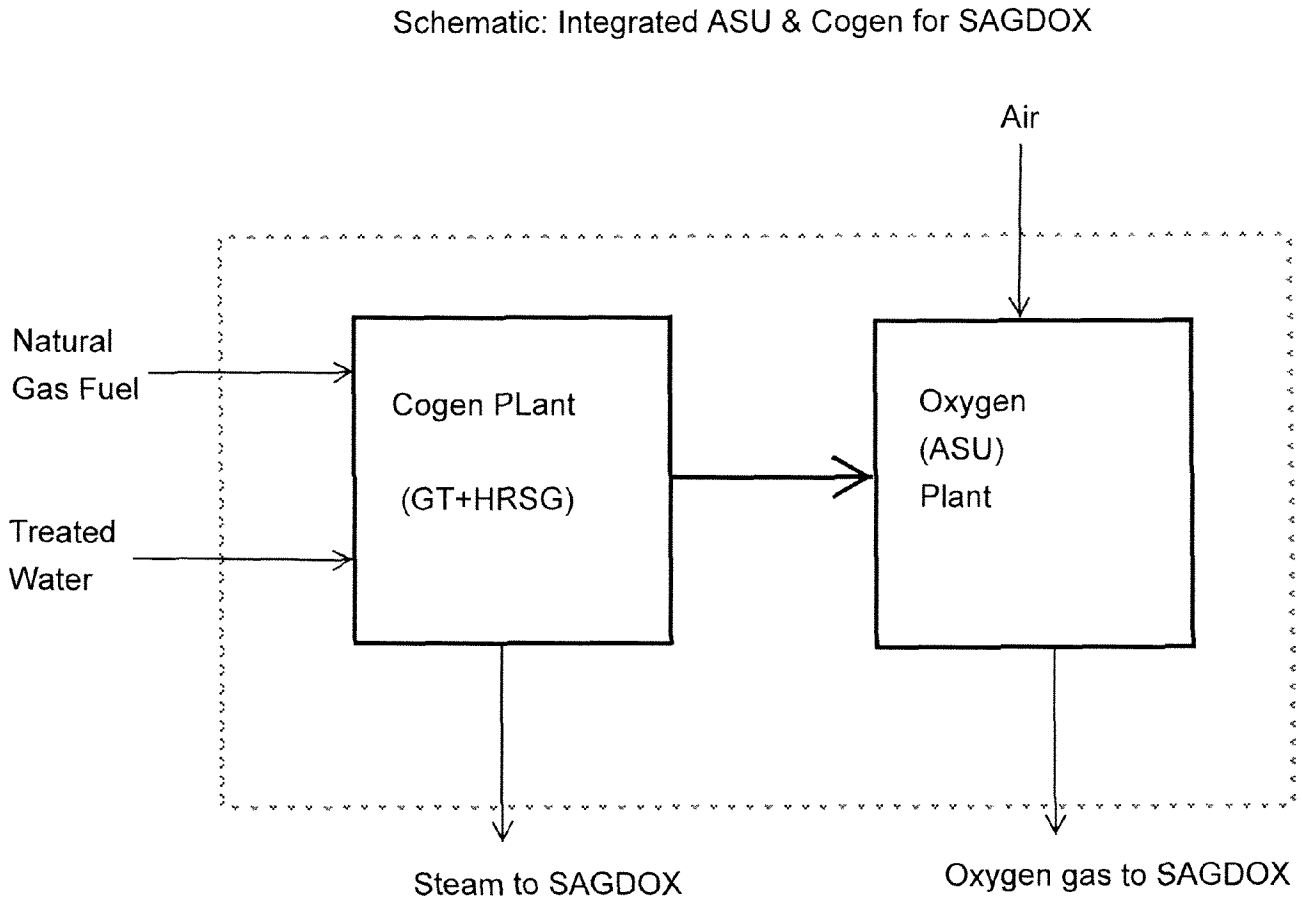
FIG. 16A is a schematic representation of an integral ASU & COGEN for a SAGDOX process.
Figure 17:
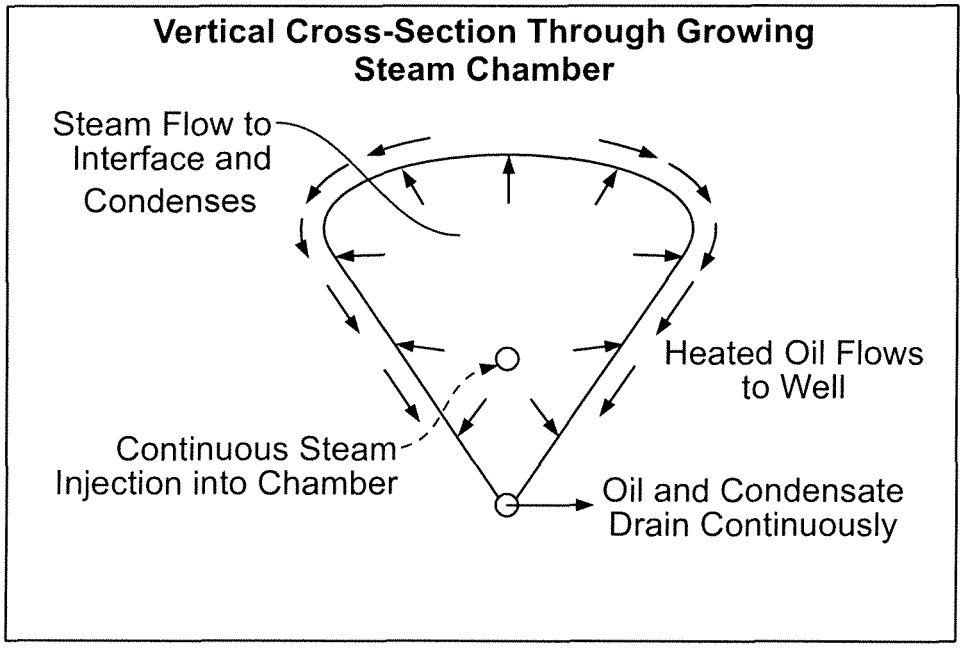
FIG. 17 is a SAGD Steam Chamber.
Figure 17:
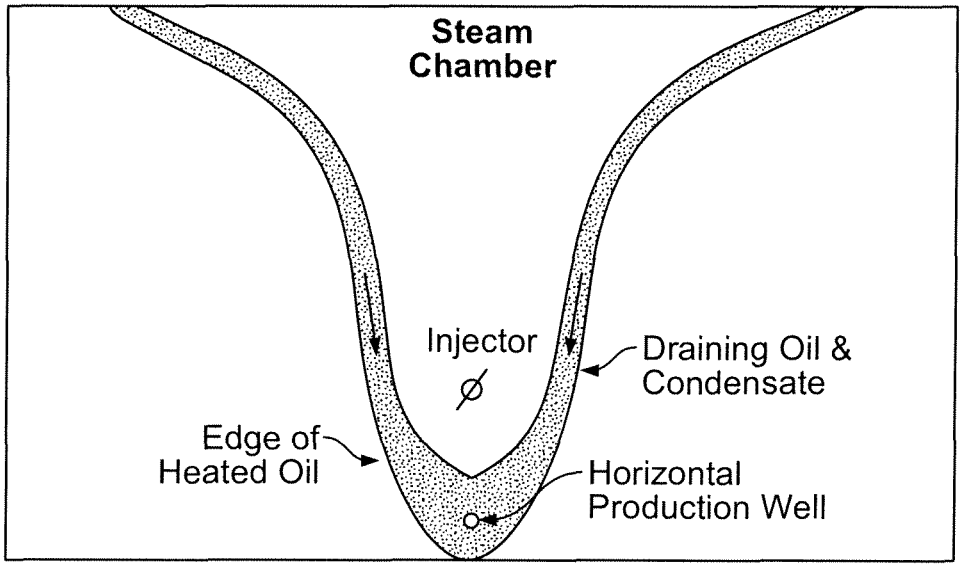
Figure 18:
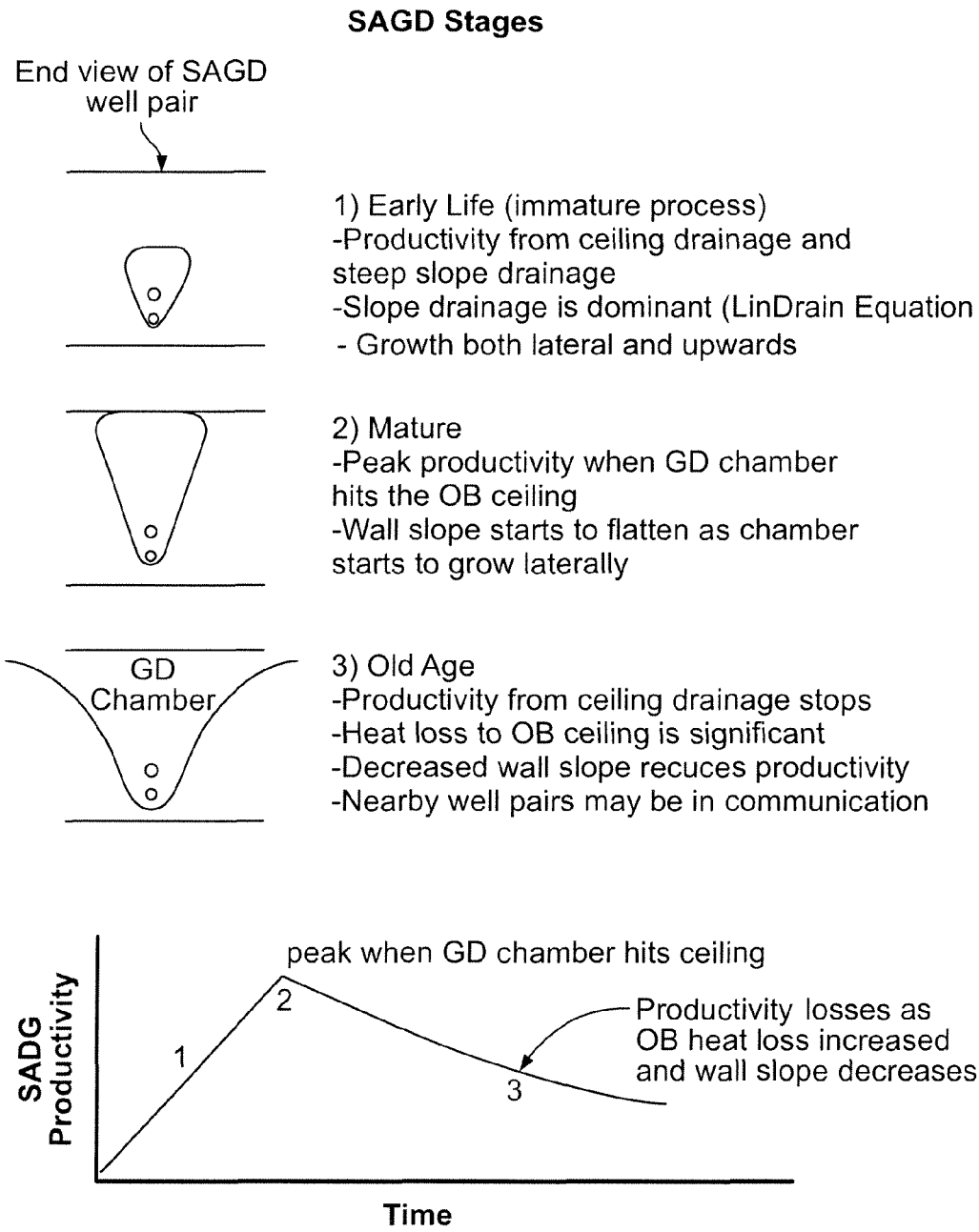
FIG. 18 is SAGD stages.
Figure 19:
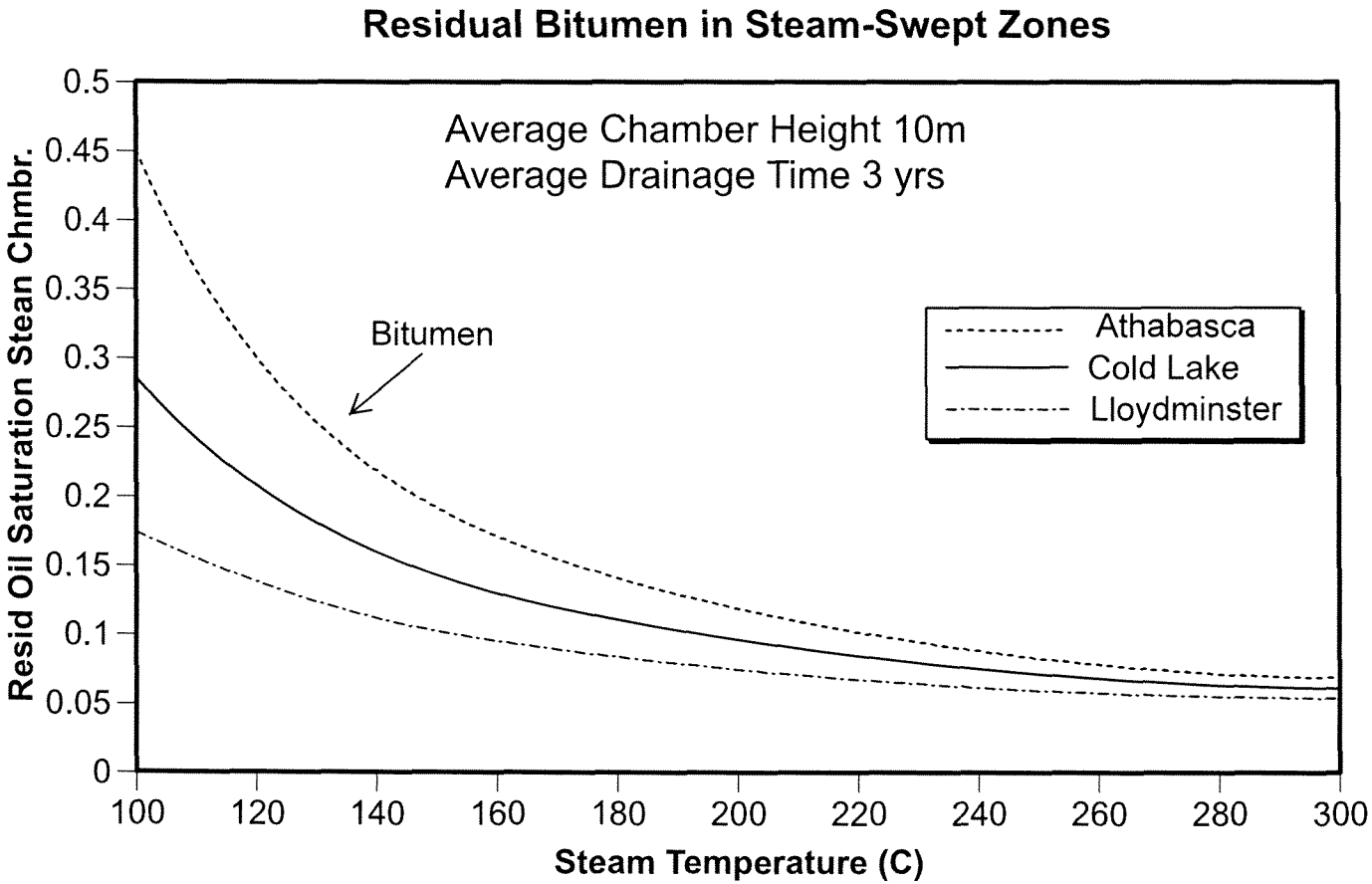
FIG. 19 is a Residual Bitumen in Steam-Swept Zones.
Figure 20:
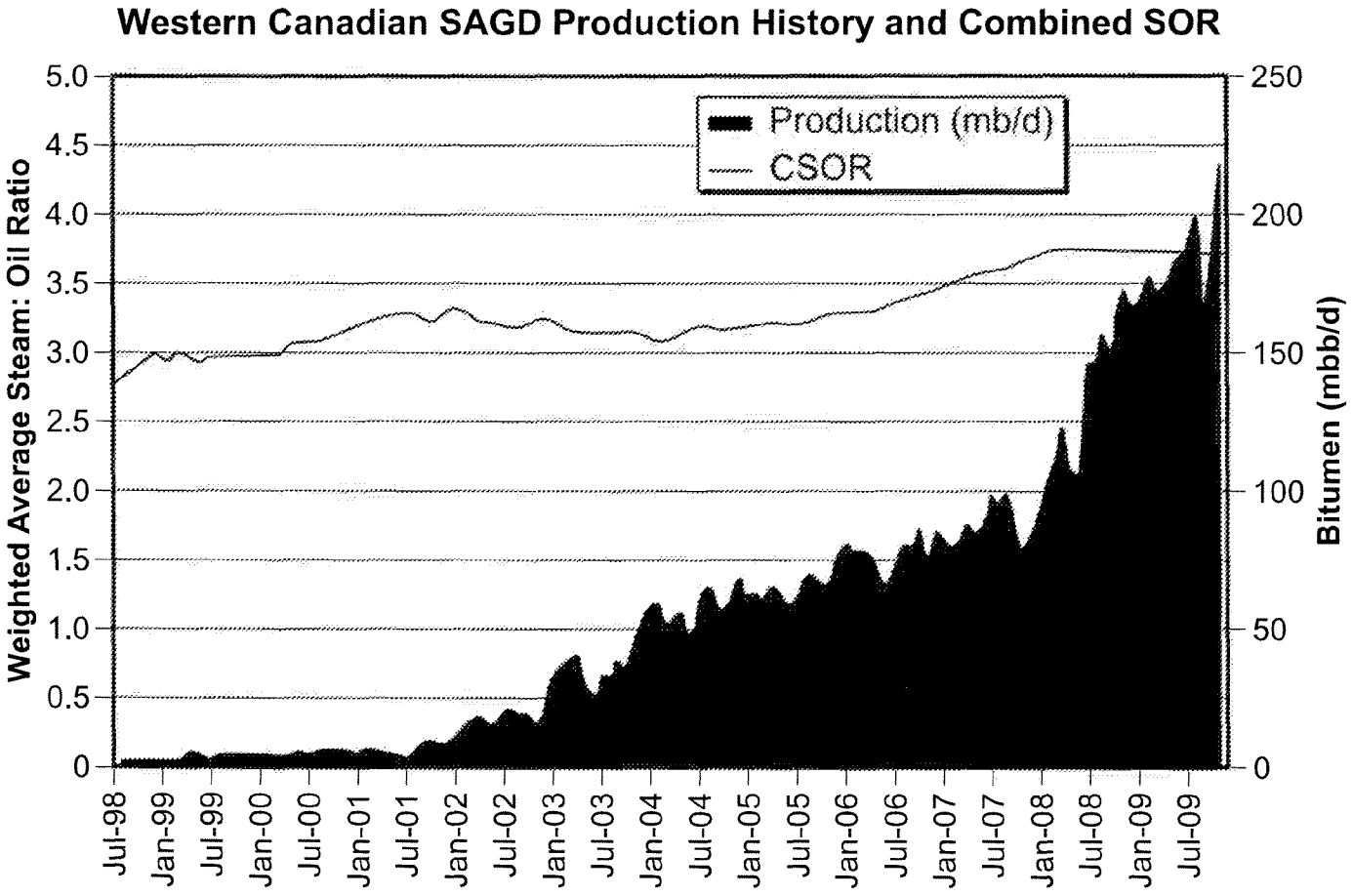
FIG. 20 is a SAGD Production History.
Figure 21:
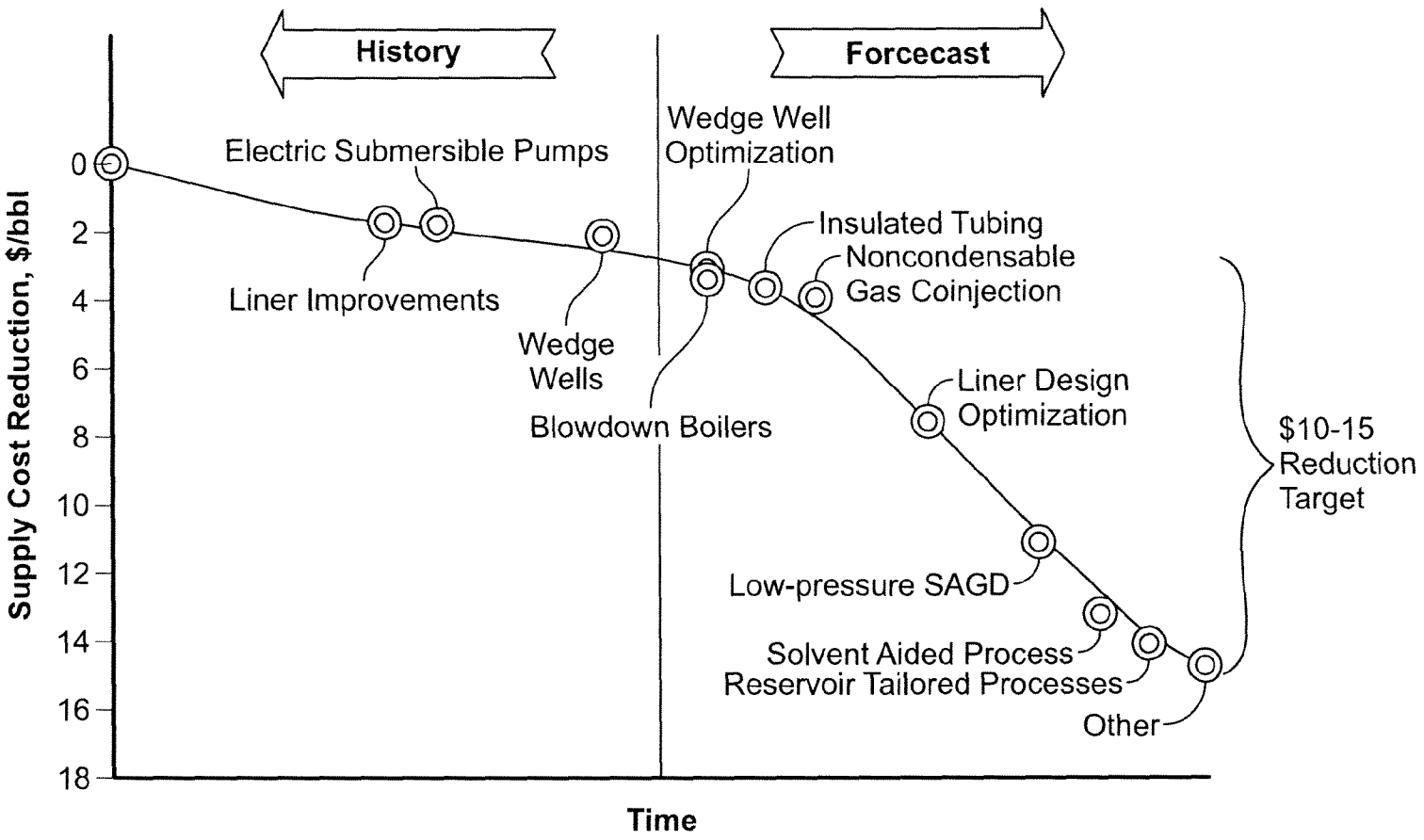
FIG. 21 is SAGD Technology.
Figure 22:
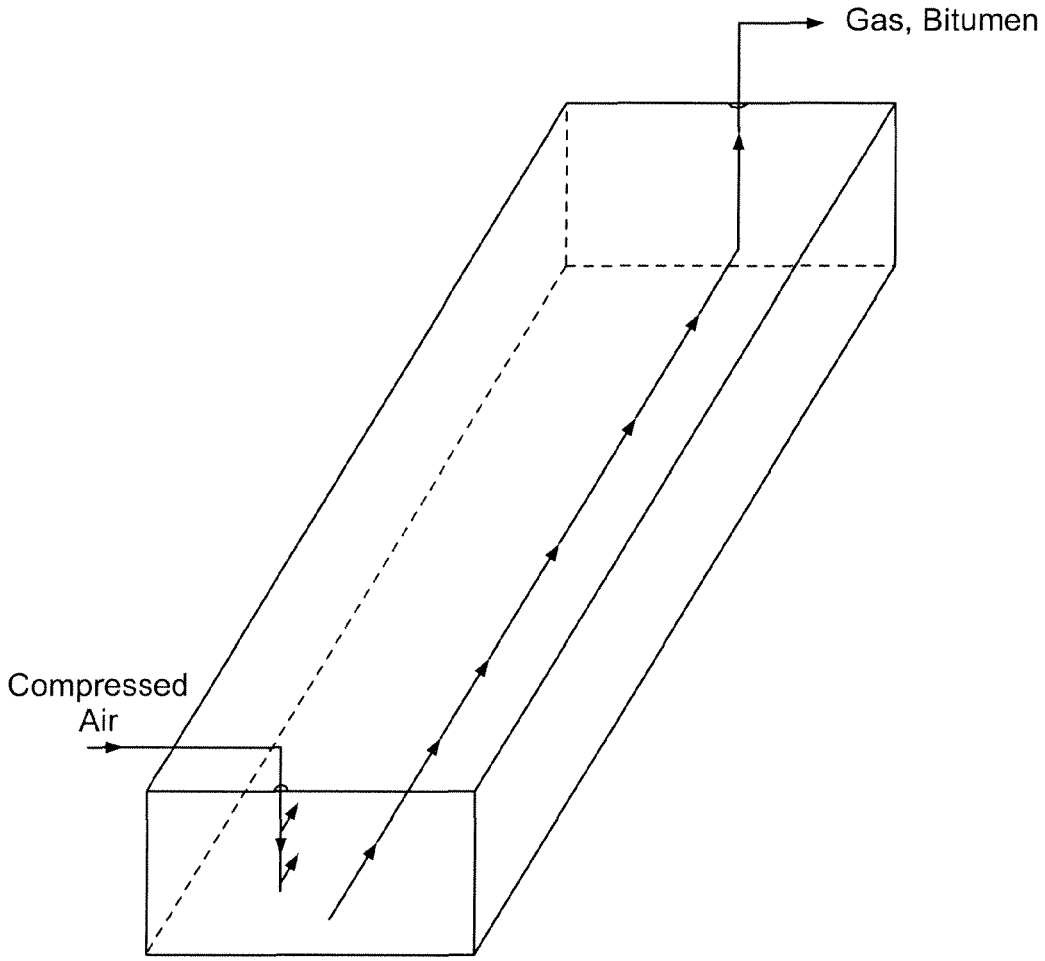
FIG. 22 is the THAI Process.
Figure 23:
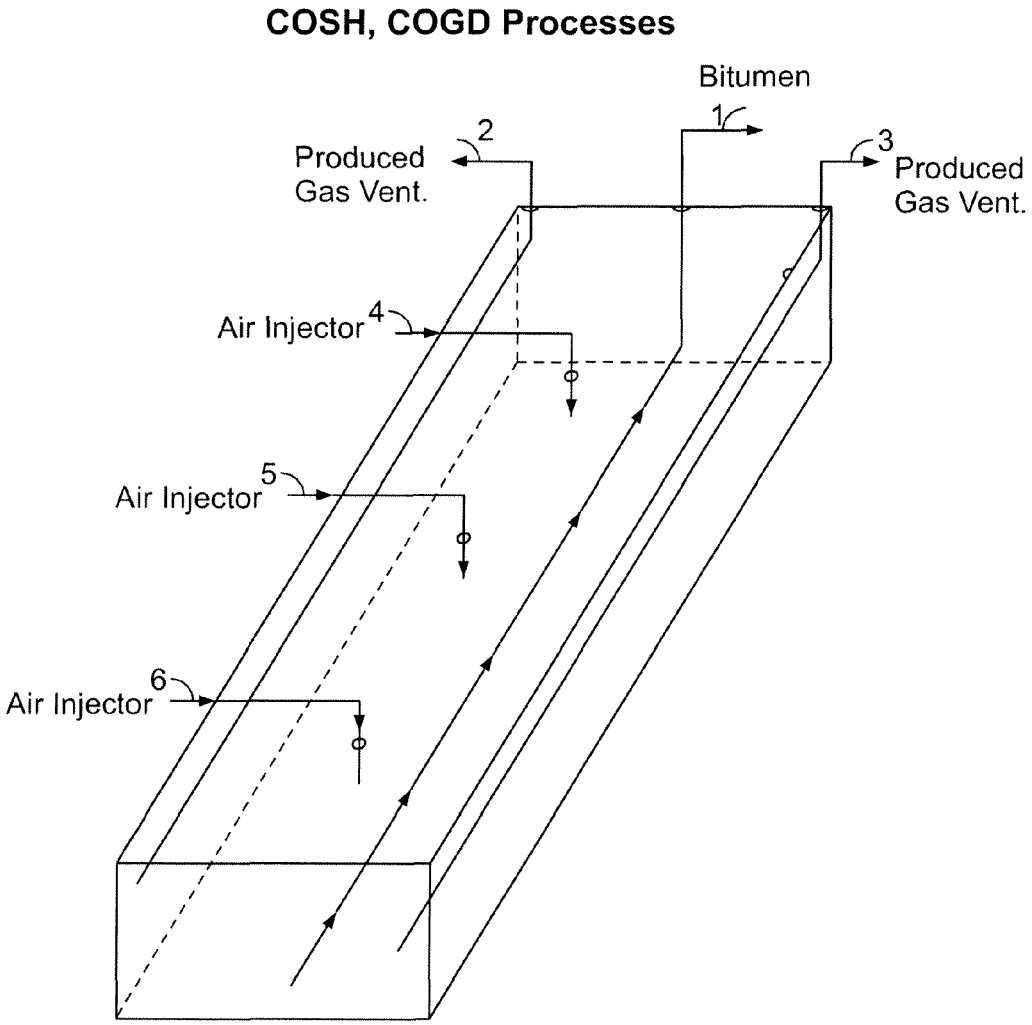
FIG. 23 is COSH, COGD Processes.
Figure 24:
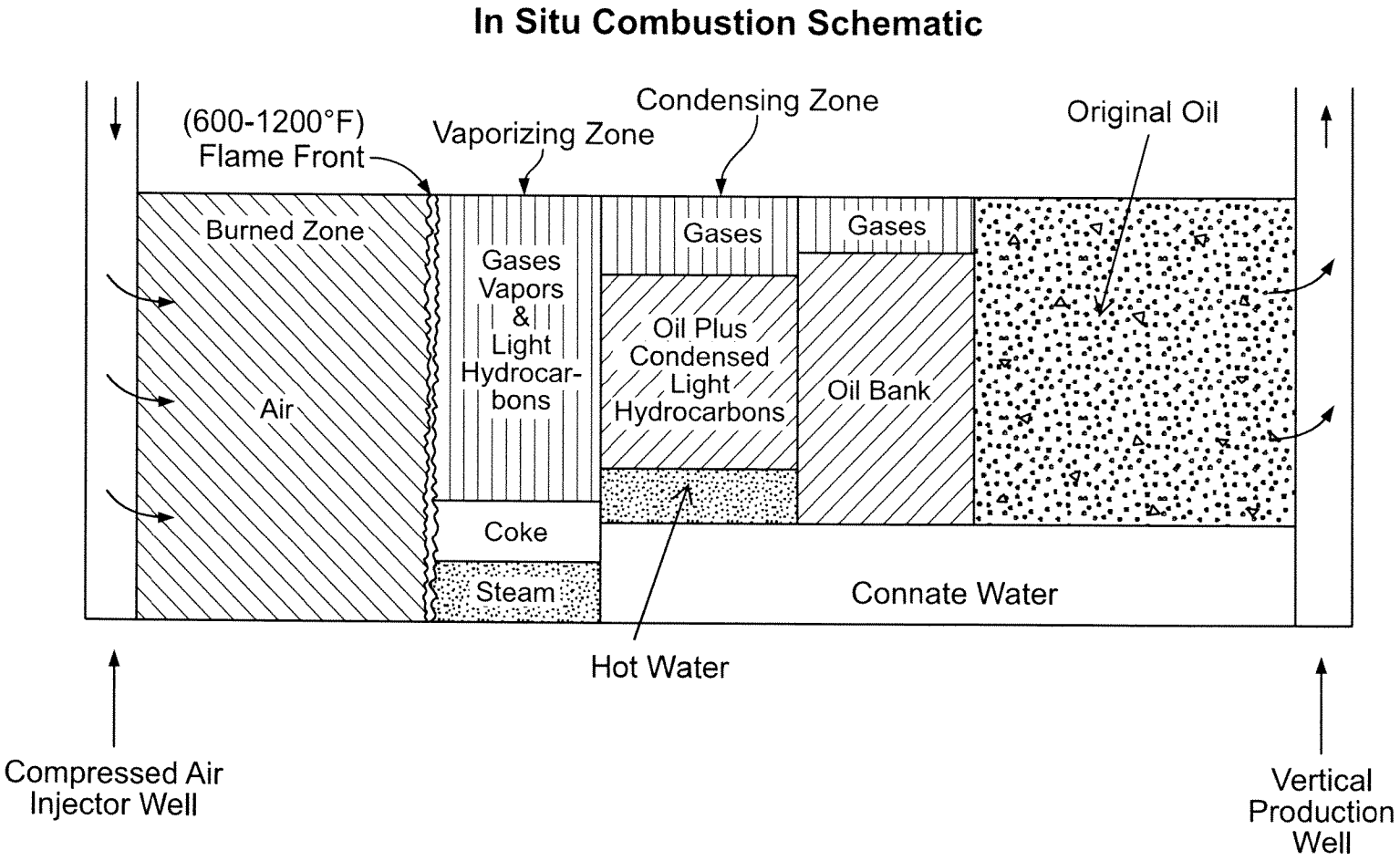
FIG. 24 is an In situ Combustion Schematic.

Oxygen and steam for SAGDOX can be produced in separate steam generator (boiler) and ASU facilities. Steam generators (boilers) require fuel—usually natural gas—and ASU requires electricity to operate. As an alternate to separate production we can integrate steam generation and oxygen production. A cogen plant can produce steam and electricity, with steam used for SAGDOX steam and electricity used for ASU oxygen production. The net effect is to use natural gas to produce steam and oxygen in volumes needed for SAGDOX. The advantages of the integrated cogen: ASU plant are reduced cost, improved energy efficiency, improved reliability (compared to grid power purchase) and reduced surface footprints. FIG. 16A is a schematic representation of an integral ASU & COGEN for a SAGDOX process.

To analyze the applicability of the integrated system, we will assume the following:

(1) The cogen plant has 20% waste energy, 80% of the inlet natural gas is converted to either steam or electricity.
(2) There is a 10% steam loss in distribution to the wellhead.
(3) We have two oxygen cases to span the design of ASU plants—99.5% pure oxygen, using 390 kWh (e)/tonne $O_2$; and 95 to 97% pure oxygen, using 292.5 kWh (e)/tonne $O_2$.
(4) Oxygen heat release in the reservoir is 480 BTU/SCF (Butler, (1991)).
(5) Steam heat release (or net steam release) is 1000 BTU/lb.

Using these assumptions we can calculate the total gas demand to cogen (MMBTU/bbl bit.) and the fraction of cogen energy input that produces electricity (i.e. the efficiency of the gas turbine). FIG. 16 shows this plot, for the range of oxygen purity between about 95 to 99.5%.

If we consider that conventional gas turbine efficiency varies from about 20-45%, our associated SAGDOX gas oxygen concentrations range from about 20 to 50%. This range is almost independent of oxygen purity (FIG. 16).

So, if we wish to reduce costs and maximize efficient by producing SAGDOX gas mixtures from an integrated cogen & ASU plant, our preferred SAGDOX gas mix is between 20 and 50% (v/v), oxygen in the steam/oxygen mixture.

Our preferred SAGDOX (35) fits in the middle of this range.

5.7 SAGDOX Operation

In order to start SAGDOX using one of the configurations shown in FIG. 3, 5, 6, 7, 8, 9, 10, 11, 12, 14, or 15, we need to meet the following criteria:

(1) When oxygen is first injected the injection point (well completion) is near to or inside a steam swept zone, so we can minimize temperatures at/near the well, consume bitumen that would otherwise not be produced in a steam-only process, and we have good gas injectivity.
(2) The injection point needs to be preheated to about 200° C. so oxygen will spontaneously react with residual fuel ("auto ignition").
(3) We have separate control of oxygen and steam injection.
(4) Start-up time between SAGD and SAGDOX is minimized.
(5) Communication is established between all wells, or at least between one oxygen injector, one produced gas removal well and the horizontal well pair. Steam circulation or steam injection is used for SAGDOX vertical wells.
(6) The oxygen flux rate is high enough to initiate and sustain HTO combustion in situ.

If we satisfy the above criteria we start up SAGDOX as follows:

1) Start oxygen and reduce steam to achieve a proscribed oxygen concentration target at the same energy rates as SAGD (see Table 1).
2) After a while, or as reservoir pressures approach a target pressure, partially open one (or more) produced gas (PG) removal wells to remove non-condensable combustion gases and to control P.
3) If we have split/multiple PG wells (i.e. FIGS. 3, 7, 9, 10, 11, 14, 15), we can adjust PG removal rates to improve/optimize $O_2$ conformance.
4) There should be no/little oxygen gas in PG removal well gas. If there is, the well should be choked back or shut in.

5) There should be no/little non-condensable gas ($CO_2$, CO, $O_2$ . . . ) in the horizontal producer fluids. If there is, the production rate should be slowed and/or oxygen conformance adjusted and/or PG removal rates increased.

For steady-state SAGDOX operations we need to monitor the following:

(1) P, T, gas concentrations and steam content in PG removal wells.

(2) P and rates of steam injection.

(3) P and rates of oxygen injection (also oxygen purity).

(4) T, water, bitumen, P, fluid rates and steam/gas concentrations in horizontal production wells.

The preferred steady-state operation strategy includes the following:

(1) Adjust steam and oxygen rates to meet energy injection and oxygen/steam targets.

(2) Adjust PG removal well rates to control pattern pressures and to control/optimize oxygen conformance.

(3) Adjust horizontal well production rates for steam-trap control, assuming that region around the well is steam-saturated at reservoir pressures (i.e. sub cool control).

These monitored measurements can be used to adjust operation targets and optimize sweep/conformance.

6. SAGDOX Uniqueness (1) There should be limits on the preferred oxygen concentration ranges for SAGDOX injection gases. On the low end (5% (v/v) oxygen) the stability of in situ combustion has not been widely studied nor reported. Nor has it been reported that due to steam "helping" (see (2)), the low end concentration is lower than oxygen diluted with the same amount of nitrogen. On the high end (50% (v/v) oxygen) the limits due to fuel availability as residual bitumen or production from an integrated ASU: cogen plants are not in the literature, nor are they obvious.

(2) The synergistic benefits of oxygen and steam are not well recognized. Oxygen helps steam by the following:

i. Surface steam demand is reduced directly by the energy delivered in oxygen.

ii. Extra steam is created by oxygen heat via oxidation of hydrocarbons, vaporization of connate water and reflux of water/steam.

iii. This improves overall energy efficiency (see 4.6).

iv. Non-condensable combustion gases migrate to the top of the pay zone and insulate the ceiling to reduce heat losses.

v. Non-condensable gases can increase lateral growth rates of the gas (steam) chamber).

vi. Because SAGDOX mixes cost less than pure steam, for the same energy content, production can be extended beyond the SAGD economic limit and increase ultimate recovery.

vii. If some $CO_2$ is retained in the reservoir, $CO_2$ emissions can be reduced compared to SAGD.

Steam can also help oxygen/combustion by the following:

i. Steam pre-heats the reservoir so oxygen will auto-ignite to start combustion.

ii. Near the combustion zone, steam can add OH and H radicals to improve and stabilize combustion reactions (Similar to smokeless flare technology) (see Kerr (1975)).

iii. Steam added (and created) is an efficient fluid for heat transfer to convey heat to the cold bitumen interface. This can improve EOR productivity.

iv. Steam stimulates increased combustion completeness (more $CO_2$, less CO).

v. Steam favors HTO over LTO combustion. Low temperature oxidation (LTO) can produce acids that cause emulsions and treating problems. LTO also releases less heat per unit $O_2$ consumed than HTO.

(3) Oxygen gas is more effective than air. In air, oxygen is diluted by nitrogen that is not beneficial in the reservoir. Although compressed air may be less costly than oxygen gas, if the produced gas must be treated (e.g. incinerated) before venting, air costs, all-in, can easily exceed oxygen costs (4) The well configurations for SAGDOX are unique.

(5) SAGDOX can have higher energy injectivity than SAGD.

(6) SAGDOX can result in longer horizontal wells than SAGD (i.e. bigger patterns).

(7) No one has proposed/contemplated an integrated ASU/Cogen plant to make SAGDOX gases.

(8) Others that have contemplated using steam and oxygen "mixtures" (Yang (2009), Pfefferle (2008)), but proposed schemes that would not work because:

i. No provision for produced gas removal wells (both).

ii. No concern about corrosion if steam and oxygen mixtures are used (both).

iii. No provision for specific oxygen concentration ranges similar to SAGDOX (both).

iv. No combustion at chamber walls (Pfefferle (2008)).

v. No control of oxidation temperatures by increasing oxygen concentration (Pfefferle (2008)).

vi. No provision for concentrated, high flux oxygen injection (both).

vii. No specificity to bitumen (both).

TABLE 1

SAGDOX Injection Gases

| | SAGD | SAGDOX (5) | SAGDOX (9) | SAGDOX (35) | SAGDOX (50) | SAGDOX (75) |
|---|---|---|---|---|---|---|
| % (v/v) oxygen | 0 | 5 | 9 | 35 | 50 | 75 |
| % heat from O2 | 0 | 34.8 | 50.0 | 84.5 | 91.0 | 96.8 |
| BTU/SCF mix | 47.4 | 69.0 | 86.3 | 198.8 | 263.7 | 371.9 |
| MSCF/MMBTU | 21.1 | 14.5 | 11.6 | 5.0 | 3.8 | 2.7 |
| MSCF $O_2$/MMBTU | 0.0 | 0.7 | 1.0 | 1.8 | 1.9 | 2.0 |
| MSCF Steam/MMBTU | 21.1 | 13.8 | 10.6 | 3.3 | 1.9 | 0.7 |

Where:

(1) Steam heat value = 1000 BTU/lb (2) $O_2$ heat/combustion value = 480 BTU/SCF $O_2$ (3) SAGD = pure steam

TABLE 2

| SAGD Productivity/Gas Injection | | | | | | |
|---|---|---|---|---|---|---|
| | SAGD | SAGDOX (5) | SAGDOX (9) | SAGDOX (35) | SAGDOX (50) | SAGDOX (75) |
| Totals | | | | | | |
| ETOR (MMBTU/bbl) | 1.180 | 1.210 | 1.230 | 1.387 | 1.475 | 1.623 |
| (MSCF/bbl) | 24.89 | 17.43 | 14.25 | 6.98 | 5.61 | 4.37 |
| Steam Component | | | | | | |
| (% (v/v)of mix) | 100 | 95 | 91 | 65 | 50 | 25 |
| ETOR(steam) | 1.180 | 0.789 | 0.615 | 0.215 | 0.133 | 0.052 |
| (% total heat) | 100 | 65.2 | 50.0 | 15.5 | 9.0 | 3.2 |
| (MSCF/bbl) | 24.89 | 16.55 | 12.97 | 4.54 | 2.81 | 1.10 |
| Oxygen Component | | | | | | |
| (%(v/v) of mix) | 0.0 | 5 | 9 | 35 | 50 | 75 |
| ETOR ($O_2$) | 0.0 | 0.421 | 0.615 | 1.172 | 1.342 | 1.571 |
| (% total heat) | 0.0 | 34.8 | 50.0 | 84.5 | 91.0 | 96.8 |
| (MSCF/bbl) | 0.0 | 0.88 | 1.28 | 2.44 | 2.80 | 3.27 |

Where:

(1) SAGDOX (5)—5% (v/v) $O_2$ in the steam and oxygen mix.

(2) ETOR ($O_2$)—reservoir heat due to $O_2$ combustion.

(3) 480 BTU/SCF $O_2$; 1000 BTU/lb steam.

(4) Entries are average performance based on SAGD simulation.

(5) Same productivity (SAGD) assumed for all.

(6) Total ETOR is prorated based on $O_2$ content in SAGDOX, between SAGD and 1.375x SAGD for SAGDOX (75).

TABLE 3

| SAGDOX Energy Efficiency | | | | | | | |
|---|---|---|---|---|---|---|---|
| | SAGD | SAGDOX (5) | SAGDOX (9) | SAGDOX (35) | SAGDOX (50) | SAGDOX (75) | SAGDOX (100) |
| ETOR (steam) | 1.180 | 0.789 | 0.615 | 0.215 | 0.133 | 0.052 | 0 |
| ETOR (O2) | 0 | 0.421 | 0.615 | 1.172 | 1.342 | 1.571 | 1.770 |
| Total ETOR | 1.180 | 1.210 | 1.230 | 1.387 | 1.475 | 1.623 | 1.770 |
| % Energy Efficiency | | | | | | | |
| 99.5% pure $O_2$ | 73.8 | 81.1 | 84.4 | 91.5 | 92.7 | 93.8 | 94.3 |
| 95-97% pure $O_2$ | 73.8 | 81.5 | 85.4 | 92.4 | 93.8 | 95.1 | 95.7 |

Where:

(1) ETOR taken from Table 2.

(2) Energy Efficiency defined in text.

(3) 99.5% pure $O_2$ uses 390 kWh/tonne $O_2$ (4) 95-97% pure $O_2$ uses 292.5 kWh/tonne

TABLE 4

SAGDOX $CO_2$ Emissions

| | SAGD | SAGDOX (5) | SAGDOX (9) | SAGDOX (35) | SAGDOX (50) | SAGDOX (75) |
|---|---|---|---|---|---|---|
| MMBTU/bbl) | | | | | | |
| ETOR($O_2$) | 0 | 0.421 | 0.615 | 1.172 | 1.342 | 1.571 |
| ETOR(steam) | 1.180 | 0.789 | 0.615 | 0.215 | 0.133 | 0.052 |
| Total ETOR | 1.180 | 1.210 | 1.230 | 1.387 | 1.475 | 1.623 |
| $CO_2$ Emissions | | | | | | |
| Boiler (SCF/bbl) | 1573 | 1052 | 820 | 287 | 177 | 69 |
| Incinerator (SCF/bbl) | 0 | 90 | 131 | 250 | 286 | 335 |
| Combustion (SCF/bbl) | 0 | 816 | 1192 | 2272 | 2601 | 3045 |
| Direct $CO_2$ totals (SCF/bbl) | 1573 | 1958 | 2143 | 2809 | 3064 | 3449 |
| (tonnes/bbl) | 0.0826 | 0.1029 | 0.1126 | 0.1476 | 0.1610 | 0.1812 |
| Ind. Elect. (SCF/bbl) | 0 | 61 | 89 | 170 | 194 | 227 |
| Dir. and Ind. Totals (SCF/bbl) | 1573 | 2019 | 2232 | 2979 | 3258 | 3676 |
| (tonnes/bbl) | 0.0826 | 0.1061 | 0.1173 | 0.1565 | 0.172 | 0.1931 |

Where:

(1) ETOR from Table 2.

(2) Assumes all produced gas is incinerated with fuel use at 10% of gas volume and the fuel gas is vented (no sequestration/retention).

(3) Boiler $CO_2$ emissions = 1333 SCF/MMBTU (steam) in reservoir.

(4) Incinerator $CO_2$ = 213 SCF/MMBTU ($O_2$) in reservoir.

(5) Combustion $CO_2$ = 1938 SCF/MMBTU ($O_2$) in reservoir.

(6) Ind. Elec. $CO_2$ = 144.5 SCF/MBTU ($O_2$) in reservoir.

TABLE 5

SAGDOX $CO_2$ Emissions with Sequestration

| SCF $CO_2$/bbl | SAGD | SAGDOX (5) | SAGDOX (9) | SAGDOX (35) | SAGDOX (50) | SAGDOX (75) |
|---|---|---|---|---|---|---|
| Boiler Flue Gas | 1573 | 1052 | 820 | 287 | 177 | 69 |
| Pure $CO_2$ Vent (comb) | 0 | 816 | 1192 | 2272 | 2601 | 3045 |
| Incin. Fuel | 0 | 90 | 131 | 250 | 286 | 335 |
| Total direct $CO_2$ | 1573 | 1958 | 2143 | 2809 | 3064 | 3449 |
| Total direct with pure $CO_2$ capture | 1573 | 1052 | 820 | 287 | 177 | 69 |
| Elec. Indirect $CO_2$ | 0 | 61 | 89 | 170 | 194 | 227 |
| Total direct and indirect $CO_2$ | 1573 | 2019 | 2232 | 2979 | 3258 | 3676 |
| Total with pure $CO_2$ capture | 1573 | 1113 | 909 | 457 | 371 | 296 |
| % of SAGD | 100 | 70.8 | 57.8 | 29.1 | 23.6 | 18.8 |

Where:

(1) If pure $CO_2$ is captured and sequestered, no incineration fuel is needed.

(2) See Table 4 for other assumptions.

TABLE 6

| SAGDOX Water Make | | | | | |
|---|---|---|---|---|---|
| | SAGDOX (5) | SAGDOX (9) | SAGDOX (35) | SAGDOX (50) | SAGDOX (75) |
| Energy (MMBTU/bbl) | | | | | |
| ETOR ($O_2$) | 0.421 | 0.615 | 1.172 | 1.342 | 1.571 |
| ETOR (steam) | 0.789 | 0.615 | 0.215 | 0.133 | 0.052 |
| ETOR Total | 1.210 | 1.230 | 1.387 | 1.475 | 1.623 |
| Produced Water (bbls/bbl bit) | | | | | |
| Connate Water | 0.333 | 0.333 | 0.333 | 0.333 | 0.333 |

TABLE 6-continued

| SAGDOX Water Make | | | | | |
|---|---|---|---|---|---|
| | SAGDOX (5) | SAGDOX (9) | SAGDOX (35) | SAGDOX (50) | SAGDOX (75) |
| Combustion Water | 0.015 | 0.022 | 0.041 | 0.047 | 0.055 |
| Steam Condensate | 2.254 | 1.757 | 0.614 | 0.380 | 0.149 |
| Totals | 2.602 | 2.112 | 0.988 | 0.760 | 0.537 |
| % Extra Water | 15.4 | 20.2 | 60.9 | 100.0 | 260.4 |

Where:
(1) % extra water = % excess c/w steam condensate.
(2) Steam at 1000 BTU/lb.
(3) No reflux.
(4) All connate water, associated with bitumen, is produced.
(5) All steam injected is produced as steam condensate.
(6) ETOR as per Table 2.

TABLE 7

| SAGDOX Produced Fluid Volumes | | | | | | |
|---|---|---|---|---|---|---|
| | SAGD | SAGDOX (5) | SAGDOX (9) | SAGDOX (35) | SAGDOX (50) | SAGDOX (75) |
| ETOR | 1.180 | 1.210 | 1.230 | 1.387 | 1.475 | 1.623 |
| ETOR(steam) | 1.180 | 0.789 | 0.615 | 0.215 | 0.133 | 0.052 |
| Fluid Produced (bbl) | | | | | | |
| Bitumen | 1.000 | 1.000 | 1.000 | 1.000 | 1.000 | 1.000 |
| Steam Condensate | 3.371 | 2.254 | 1.757 | 0.614 | 0.380 | 0.149 |
| Connate Water | 0 | 0.33 | 0.33 | 0.33 | 0.33 | 0.33 |
| Comb. Water | 0 | 0.015 | 0.024 | 0.046 | 0.053 | 0.062 |
| Total | 4.371 | 3.602 | 3.111 | 1.990 | 1.763 | 1.541 |
| %(v/v) Bit. In mix | 22.9 | 27.8 | 32.1 | 50.3 | 56.7 | 64.9 |
| % of SAGD vol. | 100 | 82.4 | 71.2 | 45.5 | 40.3 | 35.3 |

Where:
(1) ETOR (MMBTU/bbl bit) as per Table 2.
(2) Assumes no net reflux, in steady state.
(3) All connate water is produced.
(4) All combustion water is produced.
(5) SAGD = 100% steam.

TABLE 8

| Air Composition (Dry basis) | |
|---|---|
| | % (v/v) |
| $N_2$ | 78.084 |
| $O_2$ | 20.946 |
| $CO_2$ | 0.033 |
| Ar | 0.934 |
| Others | 0.003 |
| Totals | 100.000 |

Where:
(1) Source - 'Handbook of Chemistry and Physics' 58th Ed., 1977-79.
(2) "Others" includes Ne, He, Kr, Xe, $H_2$, $CH_4$, $N_2O$.

TABLE 9

| SAGDOX Steam Use (Inventory) in Reservoir | | | | | | |
|---|---|---|---|---|---|---|
| | SAGD | SAGDOX (5) | SAGDOX (9) | SAGDOX (35) | SAGDOX (50) | SAGDOX (75) |
| ETOR($O_2$) | 0 | 0.421 | 0.615 | 1.172 | 1.342 | 1.571 |
| ETOR(steam) | 1.180 | 0.789 | 0.615 | 0.215 | 0.133 | 0.052 |
| Total ETOR | 1.180 | 1.210 | 1.230 | 1.387 | 1.475 | 1.623 |
| Wellhead Steam (bbl/bblbit) | 3.371 | 2.254 | 1.757 | 0.614 | 0.380 | 0.149 |
| Reservoir Steam(bbl/bbl) | | | | | | |
| Sand Face Steam | 2.360 | 1.578 | 1.230 | 0.430 | 0.266 | 0.104 |
| Connate Steam | 0 | 0.330 | 0.330 | 0.330 | 0.330 | 0.330 |
| Combustion Steam | 0 | 0.015 | 0.024 | 0.046 | 0.053 | 0.062 |
| Reflux Steam | 0 | 0.437 | 0.776 | 1.554 | 1.711 | 1.864 |
| Totals | 2.360 | 2.360 | 2.360 | 2.360 | 2.360 | 2.360 |
| Reflux (%) | 0 | 19 | 33 | 66 | 73 | 79 |

Where:
(1) ETOR as per Table 2.
(2) Sand face steam vapor = 0.7 × well head steam (reflects losses down hole).
(3) All connate water in steam-swept zone is vaporized to steam.
(4) Assuming 80% initial bitumen saturation and 20% residual bitumen.
(5) Combustion steam as per 4.3.
(6) Reflux steam = plug for same total steam use.
(7) Reflux % = % of total steam.

TABLE 10

| SAGDOX Potential Productivity (Energy Injection) Increases | | | | | | |
|---|---|---|---|---|---|---|
| | SAGD | SAGDOX (5) | SAGDOX (9) | SAGDOX (35) | SAGDOX (50) | SAGDOX (75) |
| At SAGD Rates (/bbl bit) | | | | | | |
| ETOR | 1.180 | 1.210 | 1.230 | 1.387 | 1.475 | 1.623 |
| ETOR(steam) | 1.180 | 0.789 | 0.615 | 0.215 | 0.133 | 0.052 |
| Steam (bbls) | 3.371 | 2.254 | 1.757 | 0.614 | 0.380 | 0.149 |
| Connate Water(bbls) | 0 | 0.330 | 0.330 | 0.330 | 0.330 | 0.330 |
| Comb. Water(bbls) | 0 | 0.017 | 0.024 | 0.046 | 0.053 | 0.062 |
| Total Water(bbls) | 3.371 | 2.601 | 2.111 | 0.990 | 0.763 | 0.541 |
| Prod. Well Vol.(bbls) | 4.371 | 3.601 | 3.111 | 1.990 | 1.763 | 1.541 |
| At Const. Prod. Well Rate | | | | | | |
| Bitumen(bbls) | 1.000 | 1.214 | 1.405 | 2.196 | 2.479 | 2.836 |
| % Prod. Increase | 0 | 21.4 | 40.5 | 119.6 | 147.9 | 183.6 |
| % Bit Cut | 22.9 | 27.7 | 32.1 | 50.3 | 56.7 | 64.9 |

Where:
(1) Assumes all connate water and combustion water is condensed and produced in horizontal production well.
(2) ETOR taken from Table 2.
(3) Connate water and combustion water as per Table 7.

TABLE 11

| Steam Assisted Gravity Drainage (SAGD) Alberta Projects | | | |
|---|---|---|---|
| Company | Project | Size (mbopd) | On Production |
| ConocoPhillips | Surmount | 100 | 2006-2012 |
| Total | Joslyn | 45 | 2010 |
| Devon | Jackfish | 35 | 2008 |
| Encana | Christina Lake | 18 | 20008 |
| Encana | Foster Creek | 40-60 | now |
| Husky | Sunrise | 50-200 | 2008- |
| Husky | Tucker Lake | 30 | 2006 |
| JACOS | Hangingstone | 10 | now |
| MEG Energy | Christina Lake | 25 | 2008 |
| North American | Kai Kos Dehseh | 10 | 2008 |
| Petro Canada | MacKay River | 30-74 | now-2010 |
| OPTI/Nexen | Long Lake | 72 | 2007 |
| Suncor | Firebag 1 & 2 | 70 | now |

(CHOA June 2007)
Total capacity above = 530-744 KBD

TABLE 12

| World Active ISC Projects (1999) | | | |
|---|---|---|---|
| Country | No. of Projects | KB/D Production | (%) |
| USA | 9 | 5.1 | 18 |
| Canada | 4 | 6.5 | 23 |
| India | 5 | 0.4 | 1 |
| Romania | 4 | 11.4 | 40 |
| Others | 6 | 5.3 | 18 |
| Totals | 28 | 28.7 | 100 |

(Sarathi (1999))

As many changes therefore may be made to the embodiments of the invention without departing from the scope thereof. It is considered that all matter contained herein be considered illustrative of the invention and not in a limiting sense.

The invention claimed is:

1. A process to recover hydrocarbons from a hydrocarbon reservoir, namely bitumen, said process comprising;

establishing a horizontal production well in the hydrocarbon reservoir;

injecting an oxygen-containing gas in a first stream through a first injector and steam in a second stream through a second injector separate from the first stream but simultaneously and continuously into the hydrocarbon reservoir to cause heated hydrocarbons and water to drain, by gravity, to the horizontal production well;

maintaining, when injecting the oxygen-containing gas and the steam, an oxygen/steam injectant gas ratio from 0.05 to 1.00 (v/v); and removing non-condensable combustion gases from hydrocarbon reservoir to avoid undesirable pressures in the hydrocarbon reservoir, wherein the non-condensable combustion gases are removed from at least one separate vent-gas well.

2. The process of claim 1, wherein the steam is injected into the hydrocarbon reservoir through a horizontal injection well positioned above the horizontal production well by about 4 to about 10 meters, wherein the horizontal injection well and the horizontal production well are, parallel to one another and have lengths substantially equivalent to one another.

3. The process of claim 2, wherein the horizontal production and horizontal inject wells are part of an existing SAGD recovery process, and the process further comprises:

establishing the oxygen injection and vent gas wells to the existing SAGD recovery process.

4. The process of claim 2, further comprising: extending, in an existing SAGD design, horizontal well length.

5. The process of claim 4, wherein the horizontal production well length extends beyond 1000 meters.

6. The process of claim 1, further comprising:

establishing vertical oxygen injection and vent gas wells in the hydrocarbon reservoir.

7. The process of claim 6, wherein vertical oxygen injection and vent gas wells comprise tubing strings inserted within the existing horizontal steam injection well proximate a vertical section of the horizontal injection well, and wherein packers segregate one or both of oxygen injection and vent gas venting.

8. The process of claim 1, wherein the oxygen-containing gas has an oxygen content from 95 to 99.9% (v/v).

9. The process of claim 1, wherein the oxygen-containing gas is air enriched with oxygen, wherein the air enriched with oxygen has an oxygen content from 20 to 95% (v/v).

10. The process of claim 1, wherein the oxygen-containing gas has an oxygen content from 95 to 97% (v/v).

11. The process of claim 1, wherein the oxygen-containing gas is air.

12. The process of claim 1, further comprising:

an oxygen contact zone within the hydrocarbon reservoir and proximate a portion of the oxygen injection well, wherein the oxygen contact zone has a length of less than 50 meters long.

13. The process of claim 12, wherein the oxygen injection well contacts i no more than 50 meters of the hydrocarbon reservoir.

14. The process of claim 13, wherein the steam provides energy to the hydrocarbon reservoir and oxygen-containing gas provides energy by combusting bitumen contained in the hydrocarbon reservoir.

15. The process of claim 1, wherein the combusting of the bitumen is controlled to produce minimal amounts of one or more of live steam, non-condensable combustion gases and unused oxygen.

16. The process of claim 14, wherein the combusting of the bitumen further produces one or more of:

a combustion-swept zone with substantially zero residual bitumen and connate water;

a combustion front;

a bank of heated bitumen;

superheated steam zone;

a saturated-steam zone;

combustion gases;

carbon dioxide; and a gas/steam bitumen interface where the steam condenses and releases latent heat.

17. The process of claim 16, wherein the heated bitumen drains, by gravity, from the gas/steam interface and the bank of heated bitumen, and wherein water drains, by gravity, from the saturated steam zone and the gas/steam interface, and wherein heat from the bank of heated bitumen and the superheated-steam zone is used to reflux some steam.

18. The process of claim 17, wherein the steam-swept zone provides a source of bitumen for the bank of heated bitumen and combusting of the bitumen, and wherein the combusting of the bitumen is substantially contained inside of a steam chamber.

19. The process of claim 16, wherein the hot combustion gases transfer heat to the bank of heated bitumen and to steam mechanisms.

20. The process of claim 16, wherein the carbon dioxide, dissolves into the bitumen and reduces the viscosity of the bitumen.

21. The process of claim 16, wherein the steam is further supplied by the combusting of the bitumen connate water vaporized in the combustion-swept zone.

22. The process of claim 1, wherein the step of separately injecting the oxygen-containing gas and steam into the hydrocarbon reservoir continuously further comprises:

operating a horizontal well pair in an existing SAGD process;

circulating steam in incremental SAGDOX wells until all the incremental SAGDOX wells are communicating; and starting, after all the incremental SAGDOX wells are communicating, oxygen injection and vent gas removal.

23. The process of claim 1, further comprising:

circulating steam in the horizontal production, horizontal inject, oxygen injection and vent gas wells until the horizontal production, horizontal inject, oxygen injection and vent gas wells are communicating; and starting, after the horizontal production, horizontal inject, oxygen injection and vent gas wells are communicating, oxygen injection and vent gas removal.

24. The process of claim 1, further comprising one or both of:

i. adjusting the step of separately injecting the oxygen-containing gas and steam into the hydrocarbon reservoir continuously to attain a predetermined oxygen/steam ratio and energy injection rate targets; and ii. controlling bitumen and water production rates to attain sub-cool targets.

25. The process of claim 1, wherein the oxygen/steam injectant gas ratio is from 0.4 to 0.7 (v/v).

26. The process of claim 1, further comprising:

converting of a mature SAGD project whereat adjacent patterns are in communication, to a SAGDOX project using three adjacent patterns wherein a steam injector well of a central pattern is converted to the oxygen injector well and wherein injector wells of peripheral patterns are continued to be used as steam injector wells.

27. The process of claim 1, wherein the oxygen/steam injectant gas ratio is from 0.25 to 1.00 (v/v), and wherein the oxygen-containing gas and the steam are produced separately by an integrated ASU: Cogen Plant.

28. The process of claim 1,wherein the process further includes at least one of the following:

i. the ratio of oxygen/steam injectant gases is from 0.4 to 0.7 (v/v);

ii. the oxygen-containing gas contains from 95 and 97% (v/v) oxygen;

iii. the steam and the oxygen-containing gas are produced in an integrated ASU: Cogen plant; or iv. the hydrocarbon reservoir contains an oxygen contact zone proximate a portion of the of the oxygen injection well, wherein the oxygen contact zone has a length of less than 50 meters.

29. The process of claim 1, wherein the oxygen-containing gas contains from 95 to 97% (v/v) oxygen.

30. The process of claim 1, wherein the oxygen/steam injectant gas ratio is 1.00 (v/v) and wherein the oxygen-containing gas has an oxygen concentration of 50.0%.

31. The process of claim 1, wherein as a combusting of the bitumen moves further away from the oxygen injections well, greater amounts of oxygen is required.

32. The process of claim 1, wherein the maintaining step further includes, maintaining a gas mix of the oxygen-containing gas and steam having from between 20 and 50% (v/v) oxygen.

33. The process of claim 32, wherein the gas mix contains 35% oxygen (v/v).

34. The process of claim 1, wherein the oxygen contact zone is preheated to about 200° C.

* * * * *